US005976771A

United States Patent [19]

Kosugi et al.

[11] Patent Number: 5,976,771

[45] **Date of Patent: *Nov. 2, 1999**

[54] SILVER HALIDE COLOR LIGHT-SENSITIVE MATERIAL AND METHOD OF FORMING COLOR IMAGES

[75] Inventors: Takuji Kosugi; Kazuki Uehara; Makoto Kikuchi, all of Minami-ashigara, Japan

[73] Assignee: Fuji Photo Film Co., Ltd., Kanagawa, Japan

[ * ] Notice: This patent is subject to a terminal disclaimer.

[21] Appl. No.: 08/916,581

[22] Filed: Aug. 22, 1997

[30] Foreign Application Priority Data

| | | | |
|---|---|---|---|
| Aug. 22, 1996 | [JP] | Japan | 8-238637 |
| Aug. 22, 1996 | [JP] | Japan | 8-238662 |
| Aug. 22, 1996 | [JP] | Japan | 8-238672 |

[51] Int. Cl.[6] ..... G03C 8/40

[52] U.S. Cl. ..... 430/351; 430/203; 430/234; 430/235; 430/354; 430/405; 430/415; 430/505

[58] Field of Search ..... 430/203, 234, 430/351, 235, 405, 415, 567, 440, 354, 505, 380, 383

[56] References Cited

U.S. PATENT DOCUMENTS

| | | | |
|---|---|---|---|
| 4,435,499 | 3/1984 | Reeves | 430/350 |
| 5,494,789 | 2/1996 | Daubendiek et al. | 430/567 |
| 5,503,970 | 4/1996 | Olm et al. | 430/567 |
| 5,503,971 | 4/1996 | Daubendiek et al. | 430/567 |
| 5,667,945 | 9/1997 | Takeuchi et al. | 430/380 |
| 5,677,104 | 10/1997 | Hirai et al. | 430/203 |

*Primary Examiner*—Thorl Chea

*Attorney, Agent, or Firm*—Sughrue, Mion, Zinn, Macpeak & Seas, PLLC

[57] ABSTRACT

A heat-developable light-sensitive material including a support and at least one light-sensitive silver halide emulsion layer provided on the support, the light-sensitive silver halide emulsion layer containing light-sensitive silver halide grains, a compound to form a dye through coupling reaction with an oxidized product of a developing agent, and a binder, characterized in that the light-sensitive silver halide emulsion layer includes an emulsion containing a developing agent and tabular silver halide grains having a mean grain thickness of 0.01–0.07 $\mu$m. The light-sensitive material enables to provide a convenient and quick method of forming color images.

23 Claims, No Drawings

SILVER HALIDE COLOR LIGHT-SENSITIVE MATERIAL AND METHOD OF FORMING COLOR IMAGES

BACKGROUND OF THE INVENTION

1. Field of the Invention

The present invention relates to a novel silver halide color light-sensitive material, in particular, a novel light-sensitive material adapted to a heat development process (hereinafter may be referred to merely as a light-sensitive material) and a method of forming color images utilizing said light-sensitive material.

2. Description of the Related Art

Owing to remarkable development of light-sensitive materials utilizing silver halides, high-quality color images are now easily obtainable. For example, according to ordinary color photography, a color print is obtained by the process comprising taking a photograph utilizing a color negative film, developing the film, and printing the image information, which is recorded in the color negative film, on color photographic paper in an optical way. Recently, this process has made remarkable progress, and large-scale, color development laboratories, in which a large quantity of color prints are produced in a very efficient way, have spread along with the so-called mini-laboratories which are now in shops and are designed to provide small-scale, handy printer processing. Therefore, anybody can enjoy color photography easily.

The color photography, now in common use, reproduces color by the subtractive color process. Generally, a color negative film comprises a transmittable substrate and light-sensitive layers thereon utilizing a silver halide emulsion as a light-sensitive component having a sensitivity to the blue, green or red wavelength region of light, and a so-called color coupler capable of producing a yellow, magenta or cyan dye as a complementary hue of the sensitive wavelength region of the layer. A color negative film, which has been exposed while taking a photograph, is developed in a color developer containing an aromatic primary amine developing agent. In this process, the developing agent develops, i.e., reduces the exposed silver halide grains, and the oxidation product of the developing agent, which are formed concurrently with the forgoing reduction, undergoes the coupling-reaction with the color coupler to form a dye. The silver (developed silver) generated by the development and the unreacted (unexposed) silver halide are removed by means of a bleaching process and fixing rocess. This creates a color image on the color negative film. Consequently, a color photographic paper which comprises a reflective substrate and light-sensitive layers formed thereon having the same combinations of light-sensitive wave length region and hue to be produced as in the color negative film, through the developed negative film, and color-developing, bleaching and fixing the color photographic paper in the same manner as in the case of the negative film to obtain a color print having a color image as a reproduction of an original image thereon.

Although these systems are widely adopted at the present time, there is a growing demand for a simpler system. First reason for this is that expertise and skilled operation are necessary, due to the requirement of strict control of the composition and the temperature of the processing solution in a processing bath for the above-mentioned procedure consisting of color development, bleaching and fixation. Second reason for this is that closed equipment exclusively for the use in the developing process is often required, due to substances, such as a developing agent and an iron chelate compound, the discharge of which is regulated from the standpoint of environmental protection, contained as a bleaching agent in the processing solution. Third reason for this is that the currently available system does not perfectly fulfill the requirement for a rapid reproduction of image, as the above-mentioned developing process still requires a long time, although the time is shorted by the recent advance in technology. Based on this background, there has been a strong demand for a simpler system which does not utilize the developing agent and bleaching agent now in use for a conventional color image forming system and which accordingly minimizes the adverse effect on the environment.

In light of the aforementioned problems, various improved techniques have been proposed. Particularly, diverse techniques which utilize heat development have been proposed in order to achieve simple and rapid developing step.

Heat-developable light-sensitive materials and a process for their development are described in, for example, published by Shashin Kogaku no Kiso—Higin'en Shashin ("Fundamentals of Photographic Engineering—Non-silver Salt Photography"), Corona Publishing Co., Ltd. (1982), pp. 242–255.

Also, many methods of obtaining color images through heat development have been proposed. For example, a method of forming color images through the coupling of an oxidized product of a developing agent with a coupler is proposed in U.S. Pat. Nos. 3,531,286, 3,761,270, and 4,021,240, Belgium Patent No. 802,519, and Research Disclosure (hereinafter abbreviated as RD), pp. 31–32 (Sep. 1975).

However, the aforementioned methods require a relatively long time for development, and images obtained thereby are highly fogged and low in image density.

Also, IS & T's 48th Annual Conference Proceedings, pp. 180, discloses a system in which the dye formed in the developing reaction is transferred to a mordant layer and thereafter stripping a light-sensitive material from an image receiving material bearing the mordant layer to separate the developed silver and unreacted silver halide from an image formed by the dye without the use of a bleaching-fixing bath which has been indispensable to a conventional photographic process. However, this technique cannot perfectly solve the environmental problems, because it still needs a developing process by use of a processing bath containing a developing agent.

Fuji Photo Film Co., Ltd. has proposed a Pictrography System and the Pictrostat System which dispenses with a processing solution containing a developing agent. In this system, a small amount of water is supplied to a light-sensitive material containing a base precursor which reacts with water to generate a base. The light-sensitive material and an image receiving material are placed face to face and heated to promote the developing reaction. This system does not use the aforementioned processing bath and, in this regard, is advantageous with respect to environmental protection. However, in these systems, the thus-formed dyes are fixed in a dye-fixing layer to thereby form dye images to be viewed. Therefore, it has been desired to develop a system capable of applying this technique to recording materials for photographing use.

Since silver halide light-sensitive materials for photographing use must have high sensitivity, improving the sensitivity of silver halide grains is essential. To attain this end, preferably tabular silver halide grains have been used.

There have been proposed various kinds of silver halide grains suited for a heat development system wherein development is performed at high temperature. For example, Japanese Patent Application Publication (JP-B) No. 2-48101 discloses a technique for improving the progress in heat development step through the use of a heat-developable light-sensitive material containing tabular silver halide grains whose diameter is at least 5 times the thickness thereof. Also, Japanese Patent Application Laid Open (JP-A) No. 62-78555 discloses a technique for improving long-term storage stability of a heat-developable light-sensitive material through providing therein tabular light-sensitive silver halide grains whose silver iodide content is 4–40 mol % and which have a diameter-to-thickness ratio of 5 or greater in an amount of 0.05–1 mol with respect to 1 mol of organic silver salts. Further, JP-A No. 62-79447 discloses a technique for improving sensitivity and maximum density at the time of heat development through combined use of tabular light-sensitive silver halide grains having a diameter-to-thickness ratio of 5 or greater and light-sensitive silver halide grains having a silver iodide content of 4–40 mol % and a mean diameter of 0.4 $\mu$m or less.

However, these techniques are intended for use in light-sensitive materials for printing use. Therefore, it has been desired to develop a system capable of applying these techniques to recording materials having sufficient sensitivity for photographing use. Also, these emulsions have been experimentally applied to the aforementioned heat development system in an attempt to obtain a light-sensitive material for photographing use which can be processed in a simple, quick manner. However, the experiments revealed that the use of tabular grains tended to impair mar resistance, indicating a potential problem in practical use.

In order to prepare a light-sensitive material for photographing use through the use of the above-mentioned system, a silver halide emulsion to be used must have higher sensitivity.

One technique for improving sensitivity of a sliver halide emulsion is to use tabular sliver halide grains.

With regard to tabular grains used in ordinary solution development type photographic systems, methods for their preparation and techniques for their use are disclosed in, for example, U.S. Pat. Nos. 4,434,226, 4,439,520,4, 414,310, 4,433,048, 4,414,306, and4,459,353, JP-A Nos. 59-99433 and 62-209445.

Studies have been conducted on the use of the tabular grains disclosed in the above publications in order to obtain a color light-sensitive material which contains a color developing agent and which enables simple image recording, and these studies have revealed that granularity of the attempted system is poorer than that of a conventional color negative development system. Also, an attempt to meet the demand that color light-sensitive materials have high sensitivity resulted in fog formation, poor picture quality, and a tendency toward an increase in fog formation in light -sensitive materials during their storage.

SUMMARY OF THE INVENTION

An object of the present invention is to provide a color light-sensitive material which enables simple and rapid image formation while minimizing adverse effects on the environment, as well as to provide a method of forming color images utilizing the light-sensitive material.

According to a first aspect of the present invention, there is provided a heat-developable color light-sensitive material capable of providing high sensitivity and good granularity even in a simple and rapid process, as well as a method of forming color images utilizing the light-sensitive material.

According to a second aspect of the present invention, there is provided a color light-sensitive material capable of providing excellent pressure characteristics and improved relationship between sensitivity and granularity.

According to a third aspect of the present invention, there is provided a light-sensitive material for photographing use capable of decreasing a load imposed on the environment and recording images in a simple manner, particularly a light-sensitive material having high sensitivity and excellent storage stability, as well as a method of forming color images through use of the same.

The aforementioned object of the present invention can be effectively achieved by the following:

(1) A heat-developable light-sensitive material comprising a support and at least one light-sensitive silver halide emulsion layer provided on the support, the light-sensitive silver halide emulsion layer containing light-sensitive silver halide grains, a developing agent, a compound to form a dye through a coupling reaction with an oxidized product of the developing agent, and a binder, wherein the light-sensitive silver halide emulsion layer comprises an emulsion containing tabular silver halide grains having a mean grain thickness of 0.01–0.07 $\mu$m.

(2) A heat-developable light-sensitive material described above in (1), wherein the developing agent is a compound represented by the following formulas I, II, III, or IV:

I

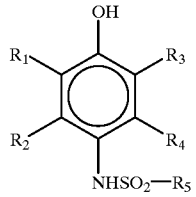

II

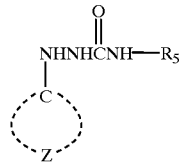

III

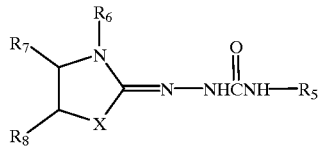

IV

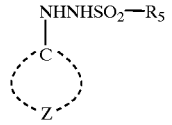

wherein each of $R_1$ through $R_4$ represents a hydrogen atom, a halogen atom, an alkyl group, an aryl group, an alkylcarbonamide group, an arylcarbonamide group, an alkylsulfonamide group, aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form (hetero)aromatic rings wherein, when Z is a benzene ring, the sum of the Hammett's substitution constant (σ) values of its substituents is not less than 1; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through IV has at least one ballast group having 8 or more carbon atoms in order to impart oil solubility to the molecule.

(3) A method of forming color images comprising a step of heating the heat-developable light-sensitive material described in above (1) or (2) at a temperature between 60° C. and 100° C. for 5 to 60 seconds to form color images.

The use of an emulsion which contains tabular grains having a thickness of less than 0.07 μm has recently be disclosed in, for example, U.S. Pat. Nos. 5,494,789, 5,503,970, and 5,503,971.

However, these U.S. patents relate to conventional silver halide color light-sensitive materials which are developed in a processing bath through use of a known color developing agent contained in a processing solution, and these patents aim to provide a technique for obtaining high sensitivity and high contrast. That is, such a conventional system does not produce the effects of the present invention.

In a silver halide color light-sensitive material which undergoes heat development through use of a self-contained color developing agent, use of an emulsion of the present invention which contains grains of a high aspect ratio significantly improves the sensitivity/granularity ratio. The reason for such improvement is not clear, but a change in developing performance may be a potential cause.

The aforementioned object of the present invention is effectively attained by the following second aspect of the present invention.

(4) A silver halide color light-sensitive material comprising a first support and a first photographic constitutive layer provided thereon by way of coating and including at least one light-sensitive layer, the light-sensitive layer containing light-sensitive silver halide grains, a compound to form a dye through a coupling reaction with an oxidized product of a developing agent, and a binder, wherein the silver halide color light-sensitive material, after exposure, is adhered to a processing material comprising a second support and a second photographic constitutive layer provided on the second support and including a processing layer, the processing layer, in the presence of water between the surface of the light-sensitive layer and the surface of the processing layer in an amount of 10% to 100% that required to maximally swell the layers of the materials, and subsequently heated to for m an image in the silver halide color light-sensitive material, wherein at least one light-sensitive layer of the silver halide color light-sensitive material comprises an emulsion containing tabular silver halide grains each of which has an average equivalent circle diameter of at least 0.7 μm, and a mean thickness of less than 0.07 μm.

(5) A silver halide color light-sensitive material described above in (4), wherein tabular silver halide grains have a (111) plane as their main surfaces.

(6) A silver halide color light-sensitive material described above in (4), wherein the processing layer contains a base and/or a precursor of a base.

(7) A silver halide color light-sensitive material described above in (4), wherein tabular silver halide grains have a (111) plane as their main surfaces and the processing layer contains a base and/or a precursor of a base.

(8) A silver halide color light-sensitive material described above in (4), wherein the silver halide emulsion contains bromides in excess of 70 mol % and at least 0.30 mol % of iodides with respect to the content of silver grains and that latent-image-forming, chemically sensitized sites are present on the grain surfaces.

(9) A silver halide color light-sensitive material described above in (4), wherein the silver halide color light-sensitive material containing either a slightly-soluble metal compound or a compound capable of increasing pH through complex-forming reaction with a constituent metal ion of the slightly-soluble metal compound, while the processing material contains the other.

(10) A silver halide color light-sensitive material described above in (9), wherein the slightly-soluble metal compound is represented by the following formula (A):

$$TpQq \qquad (A)$$

wherein T represents a multivalent metal ion; Q represents a substance which exhibits alkalinity and which is capable of functioning as a counter ion, in water, to a constituent ion of a complex-forming compound; and p and q represent integers to balance valences of T and Q with each other.

(11) . A silver halide color light-sensitive material described above in (9), wherein two silver halide emulsions sensitive to light of the same wavelength region and having different mean grain projected areas are used together.

(12) A silver halide color light-sensitive material described above in (9), wherein the slightly-soluble metal compounds are oxides, hydroxides, or basic carbonates of zinc or aluminum.

(13) A silver halide color light-sensitive material described above in (9), wherein the complex-forming compound is represented by the following formula (B):

(B)

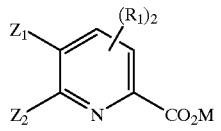

wherein each of $R_1$, $Z_1$, and $Z_2$ represents a hydrogen atom, an aryl group, a halogen atom, an alkoxy group, —$CO_2M$, a hydroxycarbonyl group, an amino group, or an alkyl group, wherein the two $R_1$s may be identical to or different from each other, and $Z_1$ and $Z_2$ may join each other to form a ring that is condensed into a pyridine ring; and M represents an alkali metal, guanidine, amidine, or a quaternary ammonium ion.

A technique regarding thin tabular silver halide grains having an average equivalent circle diameter of less than 0.7 μm (hereinafter referred to as "very thin tabular grains") is disclosed in, for example, U.S. Pat. No. 5,250,403. According to the publication, such silver halide grains have various merits such as efficient use of silver and an improved relationship between sensitivity and granularity value. However, such publications do not refer to actions and effects of a heat development system, indicating the novelty of the fact that the use of the method of forming images of the present invention improves mar resistance as well as the relationship between sensitivity and granularity value.

The aforementioned object of the present invention is effectively attained by the following third aspect of the present invention.

(14) A method of forming color images comprising the steps of;

exposing a silver halide color light-sensitive material comprising a first support and at least one light-sensitive layer provided on the first support, the light-sensitive layer containing light-sensitive silver halide grains, a compound to form a dye through a coupling reaction with an oxidized product of a developing agent, and a binder;

feeding water to the light-sensitive layer surface of the light-sensitive material and/or the processing layer surface of a processing material comprising a second support and a processing layer provided on the second support;

adhering the light-sensitive layer surface and the processing layer surface to each other; and heating the resultant assembly to thereby form an image in the light-sensitive material;

wherein the silver halide color light-sensitive material contains a silver halide emulsion containing tabular silver halide grains having an average equivalent circle diameter of at least 0.7 $\mu$m and a mean thickness of less than 0.07 $\mu$m in at least one light-sensitive layer; and the silver halide color light-sensitive material contains either one of a slightly-soluble metal compound or a compound capable of increasing pH through a complex-forming reaction with a constituent metal ion of the slightly-soluble metal compound, while the processing material contains the other.

(15) A method of forming color images described above in (14), wherein the slightly-soluble metal compound and the complex-forming compound react with each other by the application of heat in the presence of water and a developing agent to thereby form an image in the silver halide color light-sensitive material.

(16) A method of forming color images described above in (14), wherein after the step of exposing, feeding dampening water having a temperature of 40° C. or higher to the light-sensitive layer surface of the light-sensitive material or the processing layer surface of the processing material in an amount of 10% to 100% that required to maximally swell the layers of the materials, adhering the light-sensitive layer surface and the processing layer surface to each other, and heating the resultant assembly to a temperature between 60° C. and 100° C. and holding the temperature for 5 to 60 seconds to thereby form color images.

(17) A method of forming color images described above in (16), wherein dampening water is fed in an amount of 10% to 50% that required to maximally swell the light-sensitive layer and the processing layer.

DESCRIPTION OF THE PREFERRED EMBODIMENTS

The present invention can basically employ color reproduction through a subtractive color process in preparation of a light-sensitive material used for recording original scenes and reproducing recorded scenes in the form of color images. That is, there are provided at least three light-sensitive layers which have individual photosensitivities in blue, green, and red regions, each of which layers contains a color coupler capable of forming dyes of yellow, magenta, or cyan having the relation of a complementary color to its own light-sensitive wavelength region, thereby recording color information regarding original scenes. Color photographic printing paper having the relationship between light-sensitive wavelengths and hues to be developed similar to that of the light-sensitive material is exposed to light which has passed through the thus-obtained dye images, to thereby reproduce original scenes. Alternatively, information regarding dye images obtained through the photographing of original scenes may be read by a scanner or the like, and based on the thus-read information, images may be reproduced for viewing. According to the third aspect of the present invention, a light-sensitive layer contains a compound to form a dye through coupling reaction with an oxidized product of a developing agent, i.e. a coupler.

A light-sensitive material of the present invention may comprise a light-sensitive layer sensitive to light of three or more wavelength regions.

Also, light-sensitive wavelength regions and hues to be developed may have relationship other than the above-mentioned relationship of a complementary color and light sensitive. In such a case, read image information may undergo image processing such as hue conversion so as to reproduce original color information.

Conventionally, in order to attain a desired granularity value in a color negative film used for photographing, not only has a silver halide emulsion been improved, but also there has been used a so-called DIR coupler which releases a development-inhibiting compound upon coupling reaction with an oxidized product of a developing agent. A light-sensitive material of the present invention provides an excellent granularity value even when no DIR coupler is used, and will provide a more improved granularity value when a DIR compound is used in combination.

According to the second and third aspects of the present invention, it is preferable that at least two kinds of silver halide emulsions sensitive to light of the same wavelength region and having different mean grain projected areas be contained. The expression "sensitive to light of the same wavelength region" appearing in the second aspect of the present invention means "effectively sensitive to light of the same wavelength region." Accordingly, even when emulsions are somewhat different in spectral sensitivity, the emulsions are considered as sensitive to light of the same wavelength region if their major light-sensitive regions overlap each other.

In this case, difference in mean grain projected area between the emulsions is preferably 1.25 times, more preferably 1.4 times or greater, most preferably 1.6 times or greater. When three kinds or more of emulsions are used, this relationship is preferably satisfied between emulsions having a smallest mean grain projected area and a largest mean grain projected area.

According to the second and third aspects of the present invention, in order to contain in a light-sensitive material a plurality of emulsions sensitive to light of the same wavelength region and having different mean grain projected areas, separate light-sensitive layers may be provided for respective emulsions, or alternatively a single light-sensitive layer may mixedly contain these emulsions.

When these emulsions are contained separately in respective layers, an emulsion having a greater mean grain projected area is preferably contained in an upper layer (positioned closer to an incident light source).

When these emulsions are contained separately in respective layers, color couplers to be combined preferably have the same hue. However, light-sensitive layers may have different hues to be developed through the mixing of couplers which develop into different hues. Alternatively, couplers having different hue-absorbing profiles may be contained in respective light-sensitive layers.

In the second aspect of the present invention, emulsions sensitive to light of the same wavelength region are preferably applied such that the number of silver halide grains per unit area of a light-sensitive material becomes greater than a value obtained by dividing the amount of silver of an applied emulsion by the mean grain projected area of silver halide grains contained in the emulsion to the three-half power and such that this tendency is more remarkable for an emulsion having a greater mean grain projected area. This provides images having good granularity even when development is performed at high temperatures. Also, high developing performance and wide exposure latitude are both attained.

Conventionally, in order to attain a desired granularity value of a color negative for photographing use, not only has a silver halide emulsion been improved, but also there has been used a so-called DIR coupler which releases a development-inhibiting compound upon coupling reaction with an oxidized product of a developing agent. A light-sensitive material of the present invention provides an excellent granularity value even when no DIR coupler is used, and will provide a more improved granularity value when a DIR compound is used in combination.

According to the third aspect of the present invention, the silver halide color light-sensitive material contains either one of a slightly-soluble metal compound or a complex-forming compound (a compound to undergo complex-forming reaction with a constituent metal ion of the slightly-soluble metal compound), while the processing material contains the other. After exposure, the light-sensitive material is adhered to the processing material in the presence of water. The resultant assembly is heated to thereby increase the pH of an image-forming reaction system.

The image-forming reaction system in the third aspect of the present invention means a region where an image-forming reaction takes place, specifically, a layer belonging to each of the light-sensitive material and the processing material, or when two or more layers are present, all of or any one of the layers.

In the third aspect of the present invention, a known technique described in, for example, JP-A No. 62-245262 maybe used in order to generate alkali through use of water, a slightly-soluble metal compound, and a complex-forming compound.

In the third aspect of the present invention, water serving as medium may be fed from the outside. Alternatively, there may be employed water-contained capsules which are present in an image-forming reaction system and are broken through the application of heat or the like to thereby feed water.

Examples of a slightly-soluble metal compound used in the third aspect of the present invention include carbonates, phosphates, silicates, borates, aluminates, hydroxides, oxides, and their double salts such as basic salts, which all have a water solubility (grams of a substance soluble in 100 g of water) of not greater than 0.5.

Of the slightly-soluble metal compounds, those represented by the following formula (A) are preferred:

$$TpQq \quad (A)$$

wherein T represents a multivalent metal ion, e.g. $Zn^{2+}$, $Ni^{2-}$, $Co^{2-}$, $Fe^{3+}$, $Mn^{2+}$, Ca, Ba, Mg, Sr, Sn, Al, Sb, or Bi; Q represents a substance which is alkaline in water and capable of functioning as a counter ion to an constituent ion of a complex-forming compound; preferably a substance which is alkaline in water and capable of functioning as a counter ion to M appearing later in the description of a complex-forming compound, also preferably a substance which is alkaline in water and capable of functioning as a counter ion to M representing an alkali metal, guanidine, amidine, or a quaternary ammonium ion; examples of Q including a carbonate ion, a phosphate ion, a silicate ion, a borate ion, an aluminate ion, a hydroxyl ion, or an oxygen atom; and p and q represent integers to balance valences of T and Q with each other.

Preferred specific examples of a slightly-soluble metal compound may include calcium carbonate, barium carbonate, magnesium carbonate, zinc carbonate, strontium carbonate, magnesium calcium carbonate ($CaMg(CO_3)_2$), magnesium oxide, zinc oxide, tin oxide, cobalt oxide, zinc hydroxide, aluminum hydroxide, magnesium hydroxide, calcium hydroxide, antimony hydroxide, tin hydroxide, iron hydroxide, bismuth hydroxide, manganese hydroxide, calcium phosphate, magnesium phosphate, magnesium borate, calcium silicate, magnesium silicate, zinc aluminate, calcium aluminate, basic zinc carbonate ($2ZnCO_3.3Zn(OH)_2.H_2O$), basic magnesium carbonate ($3MgCO_3.Mg(OH)_2.3H_2O$), basic nickel carbonate ($NiCO_3.2Ni(OH)_2$), basic cobalt carbonate ($2CoCO_3.3Co(OH)_2$), and aluminum magnesium oxide.

Of these compounds listed above, uncolored compounds are particularly preferred.

Particularly preferred slightly-soluble metal compounds are oxides, hydroxides, and basic carbonates of zinc or aluminum, particularly zinc oxide, zinc hydroxide, and basic zinc carbonate.

A slightly-soluble metal compound is used in the form of grains dispersed in a hydrophilic binder as described in JP-A No. 59-174830. The mean grain size is 0.001–5 $\mu$m, preferably 0.01–2 $\mu$m.

Complex-forming compounds used in the third aspect of the present invention forms complex salts having a stability constant represented by log K of 1 or greater, in combination of a constituent metal ion of a slightly-soluble metal compound.

Complex-forming compounds in the third aspect of the present invention may be known chelating agents used in analytical chemistry and water softeners used in photographic chemistry. Such complex-forming compounds are described in detail in A. Ringbom, translated by Nobuyuki TANAKA and Haruko SUGI, "Saku Keisei Hanno" ("Complex-forming Reaction"), Sangyo Tosho, as well as in the aforementioned patent specifications.

Such complex-forming compounds are also described in, for example, A. E. Martell and R. M. Smith, "Critical Stability Constants," vol. 1–5, by Plenum Press.

Specific examples of complex-forming compounds include salts produced by reaction of an alkali metal, guanidine, amidine, or a quaternary ammonium substance and any of the following acids or compounds: aminopolycarboxylic acid, iminodiacetic acid and its derivatives, aniline carboxylic acid, pyridine carboxylic acid, aminophosphonic acid, carboxylic acid (mono-, di-, tri-, or tetra-carboxylic acid, and compounds having substituents such as phosphono, hydroxy, oxo, ester, amide, alkoxy, mercapto, alkylthio, and phosphino), hydroxamic acid, polyacrylate, and polyphosphoric acid.

Preferred complex-forming compounds include salts produced by reaction of an alkali metal, guanidine, amidine, or a quaternary ammonium substance and any of the following acids: picolinic acid, 2,6-pyridinedicarboxylic acid, 2,5-pyridinedicarboxylic acid, 4-dimethylaminopyridine-2,6-dicarboxylic acid, 5-ethyl-2-picolinic acid, quinoline-2-carboxylic acid, 2-pyridylacetic acid, oxalic acid, citric acid, tartaric acid, isocitric acid, malic acid, gluconic acid, ethylenediaminetetraacetic acid (EDTA), nitrilotriacetic acid (NTA), cyclohexanediaminetetraacetic acid (CDTA), diethylenetriaminepentaacetic acid, hexametaphosphoric acid, tripolyphosphoric acid, tetraphosphoric acid, polyacrylic acid, amino-tris- (methylenephosphonic acid) ethylenediamine-tetramethylenephosphonic acid,

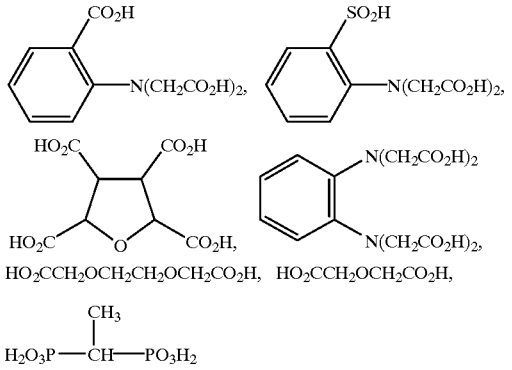

Of these complex-forming compounds, preferred compounds are aromatic heterocyclic compounds having at least one —$CO_2M$ group and also having one nitrogen atom in the ring. The ring may be monocyclic or condensed. For example, the ring may include a pyridine ring and a quinoline ring. The group —$CO_2M$ is preferably located on the ring at the α-position with respect to the nitrogen atom. M represents any of an alkali metal, guanidine, amidine, and a quaternary ammonium ion.

Examples of particularly preferred compounds include those represented by the following formula (B):

(B)

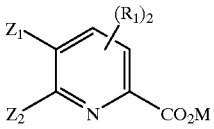

wherein $R_1$ represents a hydrogen atom, a substituted or unsubstituted aryl group, a halogen atom, a substituted or unsubstituted alkoxyl group, —$CO_2M$, a hydroxycarbonyl group, a substituted or unsubstituted amino group, or a substituted or unsubstituted alkyl group, and the two $R_1$s may be identical to or different from each other; each of $Z_1$ and $Z_2$, which may join each other to form a ring that is condensed to a pyridine ring, has the same meaning as defined for $R_1$. The substituents on the aryl group, alkoxyl group, amino group, and the alkyl groups may be alkyl, carboxy, hydroxy, etc.

Examples of preferred combinations of a slightly-soluble metal compound and a complex-forming compound include the following, in which $M^+$ represents an alkali metal ion, substituted or unsubstituted guanidium ion, amidinium ion, or a quaternary ammonium ion. However, the third aspect of the present invention is not limited by these exemplary combinations.

| | |
|---|---|
| Basic zinc carbonate - | 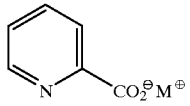 |
| Basic magnesium carbonate - | 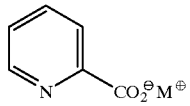 |
| Zinc oxide - | 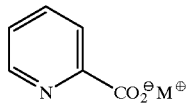 |
| Basic zinc carbonate - | 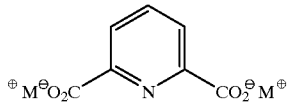 |
| Basic magnesium carbonate - | 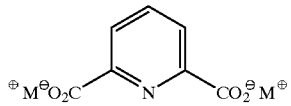 |
| Calcium carbonate - | 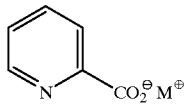 |
| Calcium carbonate - | 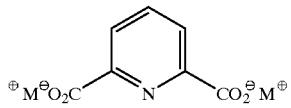 |
| Zinc oxide - | 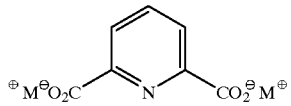 |
| Calcium carbonate - | $^{\oplus}M^{\ominus}O_2C.CO_2^{\ominus}M^{\oplus}$ |
| Calcium carbonate - | 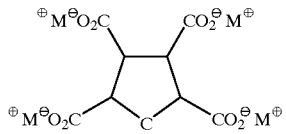 |
| Barium carbonate - | $^{\oplus}M^{\ominus}O_2C—CO_2^{\ominus}M^{\oplus}$ |
| Calcium carbonate - | $M^{\oplus}$ salt of tripolyphosphoric acid |
| Calcium carbonate - | $M^{\oplus}$ salt of citric acid |
| Calcium carbonate - | $M^{\oplus}$ salt of polyacrylic acid |
| Calcium carbonate - | 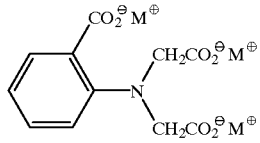 |

-continued

Magnesium oxide -

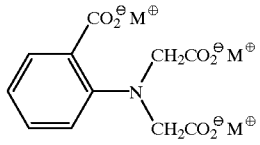

Zinc hydroxide -

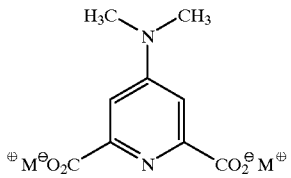

Zinc hydroxide -

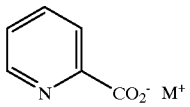

Zinc hydroxide -

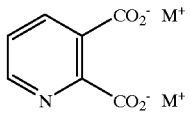

Tin hydroxide -

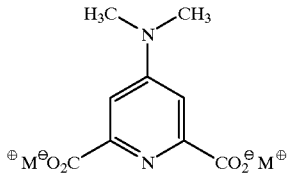

$M^+$salt of magnesium hydroxide and hexametaphosphoric acid

Calcium carbonate -

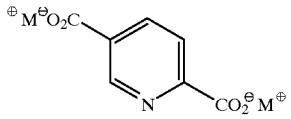

Basic magnesium carbonate - $^{\oplus}M^{\ominus}O_2C.CO_2^{\ominus}M^{\oplus}$

Calcium carbonate -

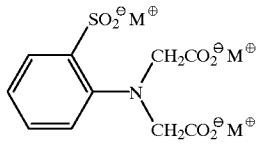

Basic zinc carbonate -

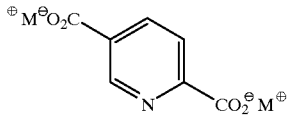

Only one of the above-listed combinations, or two or more of them, may be used. Also, these combinations may be used in further combination with a known base or a basic precursor.

The mechanism of increasing the pH of a reaction system in the third aspect of the present invention will now be described taking an example of combined use of potassium picolinate and zinc hydroxide.

The reaction of potassium picolinate and zinc hydroxide is represented by, for example, the following reaction scheme.

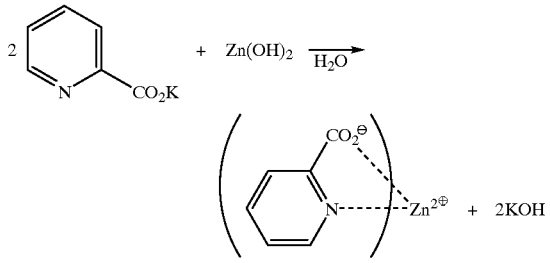

In the presence of water as medium, picolinic ions and zinc ions undergo complex-forming reaction as shown by the above scheme. Thus the resultant product assumes high alkalinity.

According to the third aspect of the present invention, a slightly-soluble metal compound is contained in at least one layer provided on a support, while a complex-forming compound is contained in at least one layer provided on another support.

Preferably, for example, a slightly-soluble metal compound is contained in a light-sensitive material, while a complex-forming compound is contained in a processing material.

In the third aspect of the present invention, a slightly-soluble metal compound and a complex-forming compound may be used in such an amount that the pH of an image-forming reaction system is increased to 8 or greater, preferably 9–13. Depending on the species of the compound, the grain size of the slightly-soluble metal compound, the complex-forming reaction rate, etc., the amount of the slightly-soluble metal compound or complex-forming compound to be added is preferably not greater than 50% by weight for each applied film, more preferably 0.01–40% by weight. Further, in the reaction system of the third aspect of the present invention, the molar ratio of the complex-forming compound content to the slightly-soluble metal compound content is preferably 1/100 to 100/1, particularly preferably 1/10 to 20/1.

In the case where a slightly-soluble metal compound is incorporated into the light-sensitive material, the amount of the slightly-soluble metal compound is 0.01–5 g/m$^2$, preferably 0.05–2 g/m$^2$. In the case where a complex-forming compound is added to a processing material, the former is contained in an amount of 0.01–10 g/m$^2$, preferably 0.05–5 g/m$^2$.

Emulsions used in the present invention will next be described.

In the present invention, "a tabular grain" is referred to as a silver halide grain having two opposed parallel main planes.

The tabular grain in the present invention has one set of twinning crystal planes or two or more sets of parallel twinning crystal planes.

Twinning crystal planes are (111) planes relative to which ions at all lattice points are symmetrically reflected. In the present invention, the interval of a set of twinning planes may be equal to or less than 0.012 $\mu$m as disclosedin U.S. Pat. No. 5,219,720, oralternatively, the ratio of the distance between (111) main planes to the twinning plane interval may be equal to or greater than 15 as described in JP-A No. 5-249,585.

The tabular grain has outer surfaces which are arranged in parallel with each other and which, as viewed from above, have a triangular shape, a hexagonal shape, a rounded triangular shape, or a rounded hexagonal shape.

Emulsions used in the present invention are preferably such that the projected area of the tabular silver halide grains is 50–100%, more preferably 80–100%, particularly preferably 90–100%, of the total projected area of silver halide grains.

Projected areas of less than 50% fails to sufficiently utilize the merits of the tabular shape (sensitivity/granularity ratio and improved sharpness)

For tabular grains used in the present invention, the mean grain thickness thereof is preferably 0.01 to 0.07 μm, more preferably 0.01 to 0.06 μm, particularly preferably 0.01 to 0.05 μm.

The mean grain thickness is the arithmetic average of the measurements of the thickness of all tabular grains contained in the emulsion.

A mean grain thickness of less than 0.01 μm causes mar resistance to be impaired and is not preferable, whereas a mean grain thickness in excess of 0.07 μm results in difficulties in obtaining the advantages of the present invention.

For tabular grains used in the present invention, the average equivalent circle diameter thereof is preferably 0.7 to 5 μm, more preferably 1 to 4.5 μm, particularly preferably 1 to 4 μm.

The average equivalent circle diameter is the arithmetic average of the measurements of the equivalent circle diameter of all tabular grains contained in the emulsion.

An average equivalent circle diameter of less than 0.7 μm is not preferred because difficulties arise in obtaining the advantages of the present invention. An average equivalent circle diameter in excess of 5 μm causes mar resistance to be impaired, which is not preferred.

The ratio of thickness of a silver halide grain to equivalent circle diameter is called aspect ratio.

That is, the aspect ratio of a silver halide grain is obtained by dividing diameter of a circular area equivalent to a projected area (hereinafter referred to as "equivalent circle diameter") of the silver halide grain by thickness of the grain.

The aspect ratio is obtained from, for example, a transmission electron micrograph of grains, through calculation based on the equivalent circle diameter (i.e., the diameter of a circle having an area equal to the projected area of a grain) and thickness of each grain.

In this case, the thickness of a grain is calculated from the length of the shadow of a replica of the grain.

The average aspect ratio of the total tabular grains contained in emulsion of the present invention is preferably 10–100, more preferably 12–80, and particularly preferably 15–50.

The average aspect ratio is the arithmetic average of the measurements of the aspect ratio of all tabular grains contained in the emulsion.

An average aspect ratio of less than 1.0 μm is not preferred because difficulties arise in obtaining the advantages of the present invention, whereas an average aspect ratio in excess of 100 causes mar resistance to be impaired, which is not preferred.

Tabular grains used in the present invention and having a small grain thickness and a high aspect ratio may be obtained by a variety of methods such as the grain formation method described in U.S. Pat. No. 5,494,789.

In order to form tabular grains having a high aspect ratio, it is important to generate small twin crystal nuclei. To this end, it is preferred to form nuclei at a low temperature, high pBr, and a low pH, by use of special type of gelatin, e.g., gelatin of low methionine content, gelatin having a low molecular weight, or a phthlated gelatin derivative, within a shortened nuclei forming time.

After nuclei are formed, tabular grain nuclei (parallel multi-twin crystal nuclei) are solely grown through physical aging, to thereby eliminate other nuclei, i.e., nuclei of normal crystals, singlet twin crystals, and non-parallel multi-twin crystals, while selectively growing the nuclei of parallel multi-twin crystals. Thereafter, soluble silver salts and soluble halogen salts are added so as to grow grains, to thereby obtain an emulsion containing tabular grains.

Emulsions used in the present invention contain tabular grains of a hexagonal shape whose length ratio of a longest side to a shortest side is 2 to 1, such that such tabular grains account for preferably 100% to 50%, more preferably 100% to 70%, particularly preferably 100% to 90%, of the total projected area of all grains contained in the emulsion. Coexistence of tabular grains other than the above-described hexagonal shape is not preferred in view of homogeneity of grains.

Emulsion used in the present invention are preferably a monodispersion.

For silver halide grains used in the present invention, a coefficient of variation in the grain size distribution is preferably 35% to 3%, more preferably 25% to 3%, particularly preferably 20% to 3%. A coefficient in excess of 35% is not preferred from the viewpoint of homogeneity of grains.

The coefficient of variation in the grain size distribution is a value obtained by dividing a standard deviation of equivalent sphere diameters of silver halide grains by an average equivalent sphere diameter.

The tabular grains used in the present invention may be silver bromides, silver chlorobromides, silver iodobromides, silver chloroiodobromides. Of these compounds, silver bromides, silver iodobromides, and silver chloroiodobromides are preferred.

When the grains have phases containing iodides or chlorides, these phases may be uniformly distributed within grains or may be localized.

Other silver salts, for example, silver rhodanide, silver sulfide, silver selenide, silver carbonate, silver phosphate, and organic acid salts of silver may be contained as separate grains or part of silver halide grains.

For tabular grains used in the present invention, the silver iodide content ranges preferably from 0.1 mol % to 20 mol %, more preferably from 0.1 mol % to 15 mol %, particularly preferably from 0.2 mol % to 10 mol %.

A silver iodide content less than 0.1 mol % is not preferred, as it can bring about difficulties in intensifying adsorption, elevation of intrinsic sensitivity of dyes, etc. On the other hand, a silver iodide content in excess of 20 mol % usually causes a developing speed to decrease, which is not preferred, either.

The variation coefficient of the distribution of inter-grain silver iodide content of the emulsion grains of the present invention falls within the range between 30 and 3%, more preferably between 25 and 3%, and particularly preferably 20 and 3%. If 30% is surpassed, intergrain homogeneity decreases.

The silver iodide content of respective grains may be measured through analysis of the composition of each grain using X-ray microanalyzer.

The variation coefficient of the distribution of inter-grain silver iodide content is expressed by a value obtained by dividing the statistic dispersion of silver iodide content of respective grains (standard deviation) by an average silver iodide content.

The tabular grains of the present invention may have dislocation lines.

A dislocation line is a linear lattice defect occurring along the boundary between a region which has already slid and a region which has not slid yet.

References regarding dislocation lines of a silver halide crystal include: 1) C. R. Berry, J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Phot. Sci. Jap., 34, 16 (1971); 5) T. Shiozawa, J. Soc. Phot. Sci. Jap., 35, 213 (1972) Dislocation lines can be analyzed by the X-ray diffraction method or the direct observation method through use of a low-temperature transmission electron microscope.

When dislocation lines are to be directly observed through a transmission electron microscope, silver halide grains are sampled from an emulsion while exercising care not to apply so large a pressure as to generate a dislocation line in grains, and the thus-sampled gains are placed on a mesh for observation through an electron microscope and are then observed by the transmission method while being cooled to prevent an electron beam-induced damage (such as printout).

In this case, since thicker grains are less likely to transmit an electron beam, it is desirable to use a high-voltage (200 kV or higher for a thickness of 0.25 $\mu$m) electron microscope in order to obtain a clear view.

JP-A No. 63–220,238 discloses a technique related to controlled introduction of dislocation lines into respective silver halide grains.

This publication demonstrates that tabular grains in which dislocation lines have been introduced are superior in photographic characteristics such as sensitivity and reciprocity to tabular grains having no dislocation lines.

In the case of tabular grains, the position and number of dislocation lines as viewed in a direction perpendicular to the main plane thereof can be obtained for each grain through study of the above-described electron-microphotograph of the grains.

When the tabular grains of the present invention have dislocation lines, their location may be arbitrarily selected such that they are localized to only vertex or fringe portions or are introduced over the entire main plane. However, it is preferred that dislocation lines be localized to only fringe portions.

In the present invention, the fringe portion means the peripheral portion of a tabular grain, specifically the portion of a tabular grain located outside a point at which a silver iodide content first exceeds or falls below the average silver iodide content of the entire tabular grains as a silver iodide distribution is traced from a side of the tabular grain toward the grain center.

When the tabular grains of the present invention have dislocation lines, the density thereof is arbitrarily determined, and may be 10 or more, 30 or more, or 50 or more dislocation lines per grain depending on the case.

Emulsions used in the present invention and other photographic emulsions to be used therewith will next be described.

Specifically, the present invention can use any of silver halide emulsions prepared using various methods as described, for example, in U.S. Pat. No. 4,500,626 (column 50), U.S. Pat. No. 4,628,021, *Research Disclosure* (abbreviated as RD, hereinafter) No. 17,029 (1978), RD No. 17,643, pp.22–23 (Dec., 1978), RD No. 18,716, p.648 (Nov., 1979), RD No. 307,105, pp. 863–865 (Nov., 1989), JP-A Nos. 62-253,159, 64-13,546, 2-236,546, 3-110,555; and further, P. Grafkides, *Chemie et Phisque Photographique,* Paul Montel, Paris (1967); G. F. Duffin, *Photographic Emulsion Chemistry,* The Focal Press, London (1966); V. L. Zelikman et al., *Making and Coating Photographic Emulsion,* The Focal Press, London (1964); and so on.

In a process of preparing the present light-sensitive silver halide emulsions, it is desirable to carry out the so-called desalting operation, that is, removal of excess salts from the silver halide emulsions. The removal can be effected using the noodle washing method which comprises gelling the gelatin, or using a flocculation method which takes advantage of a polyvalent anion-containing inorganic salt (such as sodium sulfate), an anionic surfactant, an anionic polymer (such as sodium polystyrenesulfonate), or a gelatin derivative (such as an aliphatic acylated gelatin, an aromatic acylated gelatin or an aromatic carbamoylated gelatin). Preferably, a flocculation method is employed in the present invention.

The light-sensitive silver halide emulsions used in the present invention may comprise heavy metals such as iridium, rhodium, platinum, cadmium, zinc, thallium, lead, iron and osmium ions for various purposes. These substances may be used alone, or as combination of two or more thereof. The amount of heavy metals added, though it depends on their intended purpose, is generally of the order of $10^{-9}$ to $10^{-3}$ mole per mole of silver halide. Those metals may be introduced into emulsion grains so that the distribution thereof is uniform throughout the grains or localized in the inner or surface part of the grains. Specifically, the emulsions described in e.g., JP-A Nos. 2-236,542, 1-116,637 and 4-126,629 are preferably used.

In the step for the formation of silver halide grains for the present light-sensitive silver halide emulsions, a rhodanate, ammonia, a tetra-substituted thiourea compound, an organic thioether compound as described in JP-B No. 47-11,386, a sulfur-containing compound as described in JP-A No. 53-144,319 or so on can be used as a solvent for silver halides.

For details of other conditions under which silver halide emulsions used in the present invention can be prepared, descriptions in the above-cited books, namely P. Grafkides, *Chemie et Phisque Photographique,* Paul Montel, Paris (1967); G. F. Duffin, *Photographic Emulsion Chemistry,* The Focal Press, London (1966); and V. L. Zelikman et al., *Making and Coating Photoaraphic Emulsion,* The Focal Press, London (1964); can be referred to. Specifically, the present silver halide emulsions can be prepared by any of an acid process, a neutral process and an ammonia process. Further, a method suitably employed for reacting a soluble silver salt with a soluble halide may be any of a single jet method, a double jet method and a combination thereof. In order to obtain a monodisperse emulsion, a double jet method is preferably adopted.

Also, a reverse mixing method in which silver halide grains are produced in the presence of excessive silver ions may be employed. In addition, the so-called controlled double jet method may also be used, in which the pAg of the liquid phase from which silver halide grains are to be precipitated is maintained constant.

Moreover, for the purpose of increasing the speed of grain growth, the concentration, the amount, and the incorporation rate of a silver salt or a halide may be increased (as described in JP-A Nos. 55–142,329, 55-158,124 and U.S. Pat. No. 3,650,757).

Further, the agitation of a reaction solution may be carried out by any of known methods. On the other hand, the temperature and the pH of a reaction solution during the formation of silver halide grains may be chosen properly in accordance with the intended purpose. An appropriate pH range is from 2.2 to 7.0, more preferably from 2.5 to 6.0.

Light-sensitive silver halide emulsions are, in general, chemically sensitized silver halide emulsions. In chemically sensitizing silver halide emulsions used in the present invention, known chemical sensitization processes for emulsions of general light-sensitive materials, such as a chalcogen sensitization process, including a sulfur sensitization process, a selenium sensitization process and a tellurium sensitization process, a rare metal sensitization process using gold, platinum, palladium or the like, and a reduction sensitization process, can be employed alone or in combination of two or more thereof (as described, e.g. in JP-A Nos. 3-110,555 and Japanese Patent Application No. 4-75, 798). Such chemical sensitization can be also carried out in the presence of a nitrogen-containing heterocyclic compound (as described in JP-A No. 62-253,159). Further, an anti-fogging agent recited hereinafter can be added after the completion of chemical sensitization. The addition of an anti-fogging agent can be performed in the ways as described in JP-A Nos. 5-45,833 and 62-40,446.

The pH during the chemical sensitization is preferably from 5.3 to 10.5, and more preferably from 5.5 to 8.5; while the pAg is preferably from 6.0 to 10.5, and more preferably from 6.8 to 9.0.

The amount of coating of light-sensitive silver halide used in the present invention is within the range of 1 mg to 10 g, preferably 100 mg to 8 g, on a silver basis per square meter of a light-sensitive material.

Conventionally, the use of tabular silver halide grains in a heat-developable color light-sensitive material is known.

However, these emulsions has failed to show sufficient storage stability.

Emulsions of the present invention contain tabular silver halide grains which are thin and have a high aspect ratio. A technique regarding such tabular grain emulsions is disclosed in U.S. Pat. No. 5,250,403. Such tabular silver halide grains provide various merits such as efficient use of silver and an improved relationship between sensitivity and granularity. Recently, techniques regarding tabular grains which are thin and have a high aspect ratio have been proposed for the purpose of improving various photographic properties. Such techniques are described in, for example, EP-A-0699944, EP-A-0701165, EP-A-0699949, EP-A-0699947, and U.S. Pat. No. 5,494,789. However, these publications are silent about heat development. As a result of intensive studies, the inventors of the present invention have found out that a light-sensitive material having high sensitivity and excellent storage stability is obtained through combined use of the aforementioned tabular grains and the base generation method of the present invention which involves heat development. This finding has brought about surprising effects.

In order to impart color sensitivities, including green sensitivity and red sensitivity, upon light-sensitive silver halide used in the present invention, light-sensitive silver halide emulsions are spectrally sensitized with methine dyes or other dyes. Further, if necessary, a blue-sensitive emulsion may be spectrally sensitized in order to enhance sensitivity to the light of the blue color region.

Suitable dyes which can be used for the foregoing purpose include cyanine dyes, merocyanine dyes, complex cyanine dyes, complex merocyanine dyes, holopolar cyanine dyes, hemicyanine dyes, styryl dyes and hemioxonol dyes.

Specific examples of such sensitizing dyes are disclosed in U.S. Pat. No. 4,617,257, JP-A Nos. 59-180,550, 64-13, 546, 5-45,828, 5-45,834, and so on.

These sensitizing dyes may be employed individually or in combination. In particular, combinations of sensitizing dyes are often used for supersensitization or for wavelength adjustment of spectral sensitization.

Dyes which themselves do not spectrally sensitize silver halide emulsions, or compounds which do not substantially absorb light in the visible region, but each of which can exhibit a supersensitizing effect in combination with a certain sensitizing dye, may be incorporated into silver halide emulsions (see, for example, U.S. Pat. No. 3,615,641 and JP-A No. 63-23,145).

These sensitizing dyes may be added to silver halide emulsions during, before, or after the chemical aging, or before or after the formation of the nucleus of silver halide grains according to the descriptions of U.S. Pat. Nos. 4,183,756 and 4,225,666. Additionally, those sensitizing dyes and supersensitizer may be added to the emulsion as a solution in an organic solvent, such as methanol, dispersion in gelatin or solution containing a surfactant. A suitable amount of each of such ingredients added is generally in the range of from $10^{-8}$ to $10^{-2}$ mole based on 1 mole of silver halide.

Additives used in the aforementioned steps and known photographic additives which can be used in the present invention are described in the aforementioned RD Nos. 17,643, 18,716 and 307,105, the relationship in the description is shown below.

| Kinds of additives: | RD17,643 | RD18,716 | RD307,105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC ~pp. 649, RC | pp. 866–868 |
| 4. Brightening agent | pp. 24 | pp. 648, RC | pp. 868 |
| 5. Anti-fogging agent/Stabilizer | pp. 24–25 | pp. 649, RC | pp. 868–870 |
| 6. Light absorber/ Filter/ Dye/ Ultraviolet ray absorber | pp. 25–26 | pp. 649, RC ~pp. 650, LC | pp. 873 |
| 7. Dye image stabilizer | pp. 25 | pp. 650, LC | pp. 872 |
| 8. Film hardener | pp. 26 | pp. 651, LC | pp. 874–875 |
| 9. Binder | pp. 26 | pp. 651, LC | pp. 873–874 |
| 10. Plasticizer/ Lubricant | pp. 27 | pp. 650, RC | pp. 876 |
| 11. Coating aid/ Surfactant | pp. 26–27 | pp. 650, RC | pp. 875–876 |
| 12. Anti-static agent | pp. 27 | pp. 650, RC | pp. 876–877 |
| 13. Matting agent | | | pp. 878–879 |

(RC: right column, LC: left column)

In the present invention, organometal salts may be used as oxidizer together with light-sensitive silver halide. Among these organometal salts, an organic silver salts are particularly preferable.

Examples of the organic compounds which can be used for the preparation of the above-mentioned organic silver salts serving as an oxidant include benzotriazoles, fatty acids and other compounds described in U.S. Pat. No. 4,500,626, columns 52–53. The silveracetylide, which is described in U.S. Pat. No. 4,775,613, is also useful. These silver salts may be used alone or in a combination of two or more of them.

Those organic silver salts may be used in an amount of from 0.01 to 10 moles, preferably from 0.01 to 1 mole, based on 1 mol of light-sensitive silver halide. An appropriate total coated weight of light-sensitive silver halide and the organic silver salts is in the range of 0.05 to 10 g/m$^2$, preferably 0.1 to 4 g/m$^2$, based on the weight of silver.

The binder for a constituent layer of the light-sensitive material is preferably hydrophilic material, examples of which include those described in the aforementioned RD, and those described at pages 71–75 of JP-A No. 64-13546. Specifically, the binder is preferably a transparent or translucent hydrophilic binders, exemplified by a naturally occurring compound, such as a protein including gelatin and a gelatin derivative; and polysaccharides including a cellulose derivative, starch, gum arabic, dextran and pullulane, as well as a synthetic polymer such as polyvinyl alcohol, polyvinyl pyrrolidone and acrylamide polymer. Also usable as the binder is a highly water-absorbent polymer described in U.S. Pat. No. 4,960,681 and JP-A No. 62-245,260. More specifically, those polymers are homo- or copolymers of vinyl monomers having —COOM or —$SO_3M$ (wherein M stands for a hydrogen atom or an alkali metal), such as sodium methacrylate and ammonium methacrylate, and copolymers of a vinyl monomer having the foregoing group and other vinyl monomers (e.g., Sumikagel L-5H, trade name, a product of Sumitomo Chemical Co., Ltd.). The binders recited above can be used as combination of two or more thereof. In particular, it is desirable to combine gelatin with some of the foregoing binders. As for the gelatin, lime-processed gelatin, acid-processed gelatin or delimed gelatin having reduced contents of calcium and the like may be properly chosen depending on the intended purpose. Also, it is desirable that those gelatins be used in combination.

The coated weight of the binder in the present invention is preferably not more than 20 g/m$^2$, and more preferably not more than 10 g/m$^2$.

In the present invention, the emulsion layers contain a compound (hereinafter referred to as a coupler) that forms a dye through a coupling reaction with an oxidation product of a developing agent.

Both four-equivalent couplers and two-equivalent couplers may be used as dye-providing couplers in the present invention. Their nondiffusive groups may form a polymer chain. Specific examples of such couplers are described in detail in T. H. James, "The Theory of the Photographic Process," 4th edition, pages 291–334 and 354–361, and JP-A Nos. 58-123,533, 58-149,046, 58-149,047, 59-111, 148, 59-124,399, 59-174,835, 59-231,539, 59-231,540, 60-2,950, 60-2,951, 60-14,242, 60-23,474, 60-66,249, and Japanese Patent Application Nos. 6-270,700, 6-307,049 and 6-312,380.

In addition, the following couplers are preferably used in the present invention.

Yellow couplers: couplers represented by formulae (I) and (II) described in EP-A-502424, the couplers represented by formulae (1) and (2) described in EP-A-513496, the coupler represented by formula (1) in claim 1 of Japanese Pat. Application No. 4-134,523, the coupler represented by formula D in column 1, lines 45–55, of U.S. Pat. No. 5,066,576, the coupler represented by formula D in paragraph [0008] of JP-A No. 4-274,425, the coupler described in claim 1 (at page 40) of EP-A1-498,381, the coupler represented by formula (Y) at page 4 of EP-A1-447,969, and the couplers represented by formulae (I) to (IV) in column 7, lines 36 and 58, of U.S. Pat. No. 4,476,219.

Magenta couplers: couplers described in JP-A Nos. 3-39, 737, 6-43,611, 5-204,106 and 4-3,626.

Cyan couplers: couplers described in JP-A Nos. 4-204, 843, 4-43,345 and Japanese Patent Application No. 4-23, 633.

Polymeric couplers: couplers described in JP-A No. 2-43, 345.

The couplers described in U.S. Pat. Nos. 4,366,237, GB-2,125,570, EP-096570, DE-3,234,533 are preferable as a coupler which can generate a dye having an appropriate diffusive property.

Further, the light-sensitive material used in the present invention may contain a functional coupler, for example, a coupler which is designed to correct the unnecessary absorption of coloring dyes, such as the yellow colored cyan couplers described in EP-A1-456,257, the yellow colored magenta couplers described in EP, supra, the magenta colored cyan couplers described in U.S. Pat. No. 4,833,069, and the colorless masking couplers represented by (2) of U.S. Pat. No. 4,837,136 and Formula (A) in claim 1 of WO 92/11575 (especially, the exemplified compounds at pages 36–45) are examples thereof.

In the present invention, it is preferable to use a coupler or other compounds which reacts with the oxidation product of a developing agent to release a photographically important compound.

Examples of the compounds (including couplers) which reacts with the oxidation product of a developing agent to release photographically important compound residues, include a compound which release a development inhibitor such as compounds represented by formulas (I) to (IV) in EP-A1-378,236 (page 11), the compound represented by formula (I) in EP-A2-436,938 (page 7), the compound represented by formula (1) in JP-A No. 5-307,248, the compounds represented by formulae (I) , (II) and (III) in EP-A2-440,195 (pages 5-6), the compound (ligand releasing compound) represented by formula (I) in claim 1 of JP-A No. 6-59,411, and the compound represented by LIG-X in claim 1 of U.S. Pat. No. 4,555,478.

In the present invention, the amount of the coupler added is preferably 1/1,000 to 1 mole, more preferably 1/500 to 1/5 moles based on 1 mole of silver halide.

The light-sensitive material of the present invention should contain a developing agent, the oxide of which results from the silver development and is capable of coupling with the aforementioned coupler to form a dye.

Examples of such a combination of a coupler and a developing agent include a combination of p-phenylene diamines as a developing agent and a phenol or active methylene coupler described in U.S. Pat. No. 3,531,256 and a combination of p-aminophenols as a developing agent and an active methylene coupler described in U.S. Pat. No. 3,761,270.

Further, a sulfonamide phenol described in U.S. Pat. No. 4,021,240 and Japanese Patent Application Laid-Open (JP-A) No. 60-128,438, ispreferable, because this combination assures an excellent storage stability of the raw light-sensitive material.

In the present invention, a precursor of a developing agent may be used, examples of which include an indoaniline compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane compound described in Japanese Patent Application Laid-Open (JP-A) No. 53-135,628.

Other combinations, i.e., a combination of a sulfonamide phenol developing agent and a coupler as described in Japanese Patent Application Laid-Open (JP-A) No. 9-15,806 and a combination of a hydrazine developing agent and a coupler as described in Japanese Patent Application Laid- Open (JP-A) Nos. 8-286,340 and 8-234,388, are also preferable for use in the light-sensitive material of the present invention.

In the present invention, it is preferable to use a compound, which is represented by one of the formulas (I), (II), (III) or (IV), as a developing agent. Of these compounds, the compounds represented by formula I or II are particularly preferably used. According to the first aspect of the present invention, the developing agents are contained in light-sensitive silver halide emulsion layers of a light-sensitive material, whereas according to the second and third aspect of the present invention, the developing agents or reducing agents are contained in the processing sheet described below. Alternatively, they may be self-contained in the light-sensitive material. According to the third aspect of the present invention, the developing agents may be contained in water that is supplied during heat development, though they are more preferably self-contained in the light-sensitive material.

Details of these developing agents are described below.

The compounds represented by the formula (I) are generally called a sulfonamide phenol and are known compounds in the art. In these compounds, preferably at least one substituent selected from the substituents $R_1$ to $R_5$ has a ballast group having 8 or more carbon atoms.

In formula (I), each of $R_1$ to $R_4$ represents a hydrogen atom, a halogen atom (e.g., Cl or Br), an alkyl group (e.g., methyl, ethyl, isopropyl, n-butyl, or t-butyl), an aryl group (e.g., phenyl, tolyl, or xylyl), an alkylcarbonamide group (e.g., acetylamino, propionylamino, butyroylamino), an arylcarbonamide group (e.g., benzoylamino), an alkylsulfonamide group (e.g., methanesulfonylamino or ethanesulfonylamino), an arylsulfonamide group (e.g., benzenesulfonylamino or toluenesulfonylamino), an alkoxy group (e.g., methoxy, ethoxy, or butoxy), an aryloxy group (e.g., phenoxy), an alkylthio group (e.g., methylthio, ethylthio, or buthylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, or morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), an arylcarbonyl group (e.g., benzoyl or alkylbenzoyl), or an acyloxy group (e.g., acetyloxy, propionyloxy, or butyroyloxy). Of groups $R_1$ to $R_4$, $R_2$ and $R_4$ are preferably hydrogen atoms. A sum of the Hammett's substituent constant $\sigma_p$ of $R_1$ to $R_4$ is preferably not less than 0. $R_5$ represents an alkyl group (e.g., methyl, ethyl, butyl, octyl, lauryl, cetyl, or stearyl), an aryl group (e.g., phenyl, tolyl, xylyl, 4-methoxyphenyl, dodecylphenyl, chlorophenyl, trichlorophenyl., nitrochlorophenyl, triisopropylphenyl, 4-dodecyloxyphenyl, or 3,5-di-(methoxycarbonyl)), or a heterocycle (e.g., pyridyl).

The compounds represented by formula (II) are generally called carbamoylhydrazines. The above two groups of compounds are known in this technical field. When they are used in the present invention, it is preferred that the substituent on the ring or $R_5$ have a ballast group of 8 or more carbons.

In formula (II), Z represents a group of atoms that form an aromatic ring. The aromatic ring indicated by Z should be sufficiently electron-attractive in order to make the compound silver developing activity. From this standpoint, aromatic rings which form a nitrogen-containing aromatic ring or which is prepared by introducing an electon-attractive group into a benzene are preferably used. Examples of such aromatic rings include a pyridine ring, a pyrazine ring, a pyrimidine ring, a quinoline ring, or a quinoxaline ring. Examples of substituents on the benzene ring include an alkylsulfonyl group (e.g., methanesulfonyl or ethanesulfonyl), a halogen atom (e.g., chlorine or bromine), an alkylcarbamoyl group (e.g., methylcarbamoyl, dimethylcarbamoyl, ethylcarbamoyl, diethylcarbamoyl, dibutylcarbamoyl, piperidinecarbamoyl, or morpholinocarbamoyl), an arylcarbamoyl group (e.g., phenylcarbamoyl, methylphenylcarbamoyl, ethylphenylcarbamoyl, or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, orbutyroyl) , or an arylcarbonyl group (e.g., benzoyl or alkylbenzoyl). Preferably, the sum of the Hammett's constants $\sigma$ of the above-described substituents is not less than 1.

The compounds represented by formula (III) are generally called carbamoylhydrazones. The compounds represented by formula (IV) are generally called sulfonylhydrazines. These two groups of compounds are known in the art. When they are used in the present invention, preferably at least one of $R_5$ to $R_8$ has a ballast group of 8 or more carbons.

In the above formulae, $R_6$ represents an alkyl group (e.g., methyl or ethyl). X represents an oxygen atom, a sulfur atom, a selenium atom, or an alkyl-substituted or aryl-substituted tertiary nitrogen atom, with alkyl-substituted tertiary nitrogen atom being preferred. Each of $R_7$ and $R_8$ represents a hydrogen atom or a substituent (such as one listed above as a substituent for the benzene ring of Z), and $R_7$ and $R_8$ may be joined each other so as to form a double bond or a ring.

Of the compounds of formula (I) to (IV), those of (I) and (II) are particularly preferred from the viewpoint of superior storage stability of the raw light-sensitive material.

In the above compounds, the substituents $R_1$ to $R_8$ may each have a substituent, examples of which include the above examples of substituent on the above-described benzene ring Z.

Concrete examples of the compounds represented by formulas (I) through (IV) are given below, but a developing agent used in the present invention is not limited to such examples.

D-1
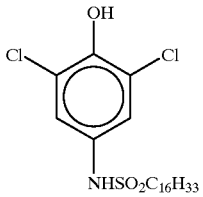
D-2
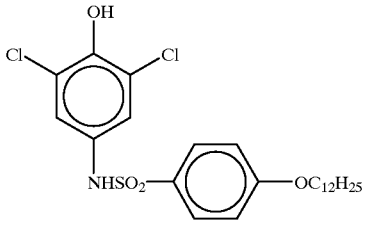
D-3
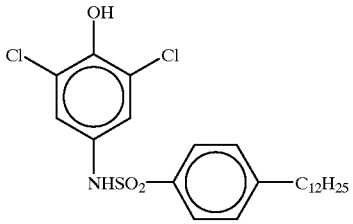
D-4
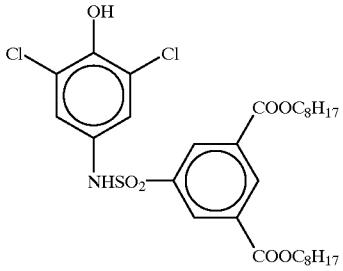
D-5
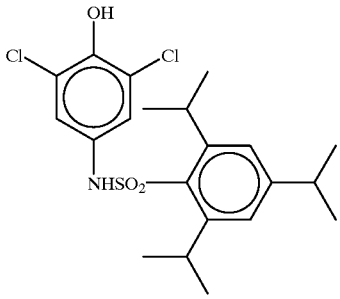
D-6
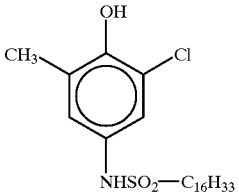

-continued
D-7
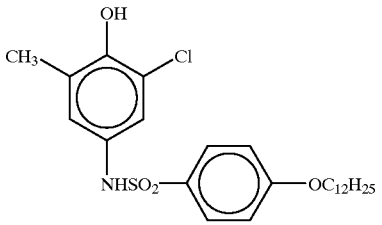
D-8
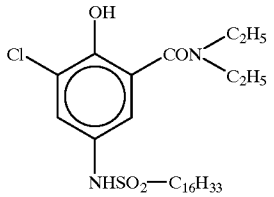
D-9
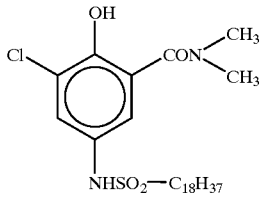
D-10
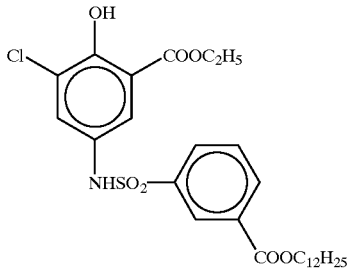
D-11
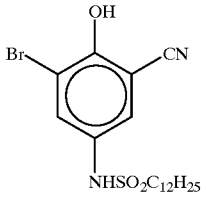
D-12
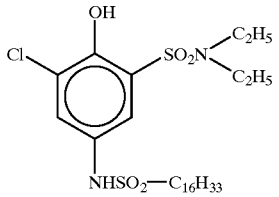
D-13
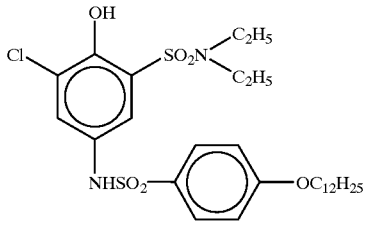

-continued
D-14
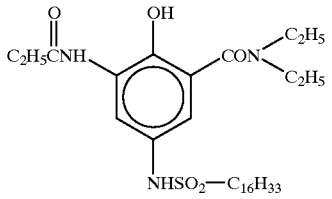
D-15
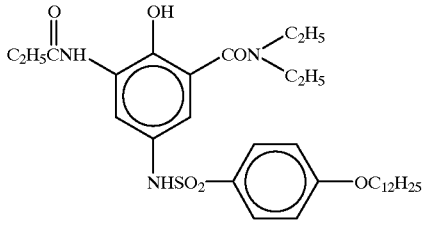
D-16
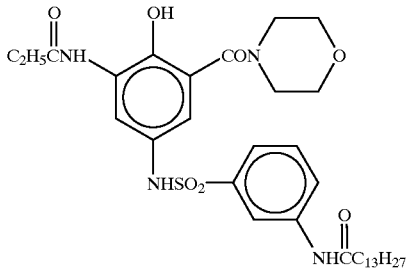
D-17
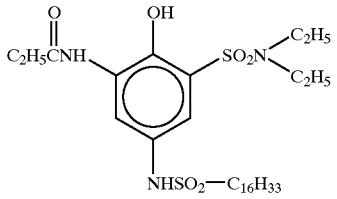
D-18
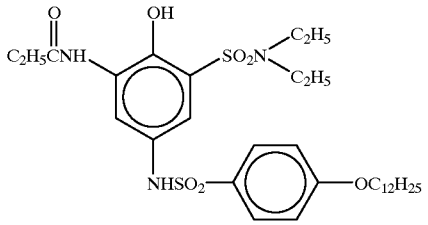
D-19
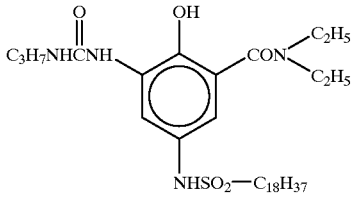

-continued
D-20
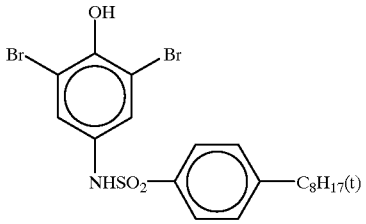
D-21
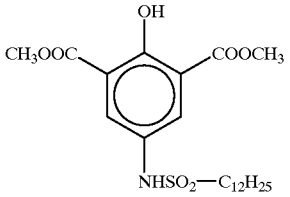
D-22
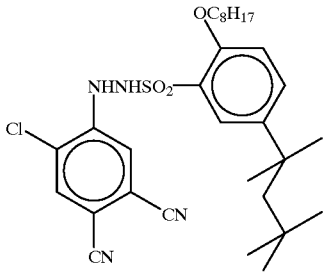
D-23
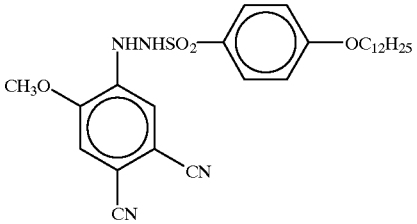
D-24
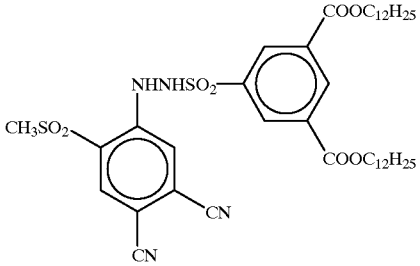
D-25
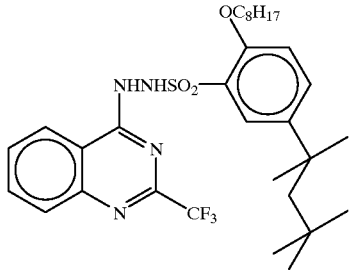

-continued
D-26
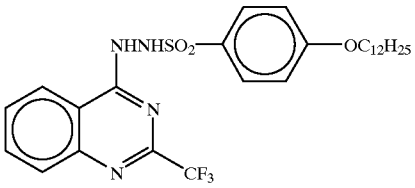
D-27
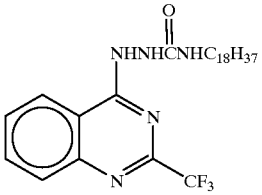
D-28
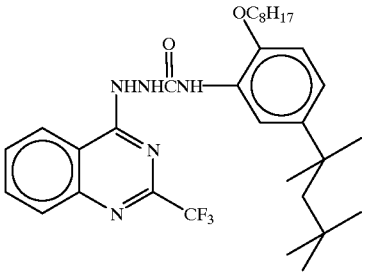
D-29
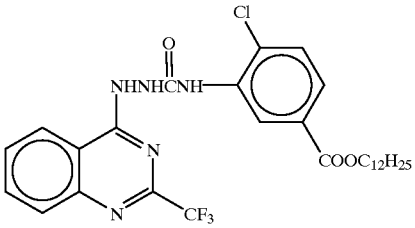
D-30
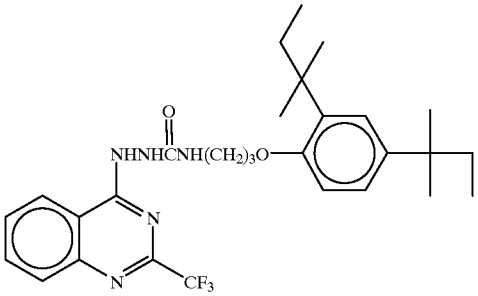
D-31
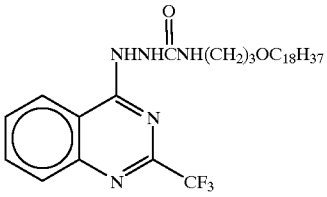

-continued
D-32
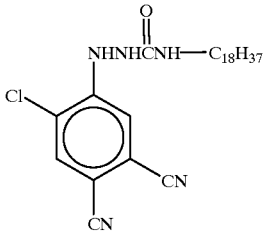
D-33
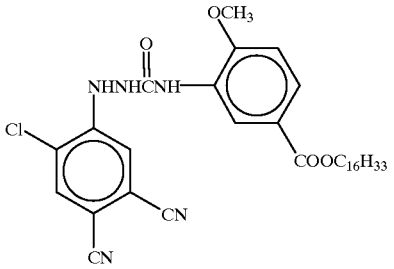
D-34
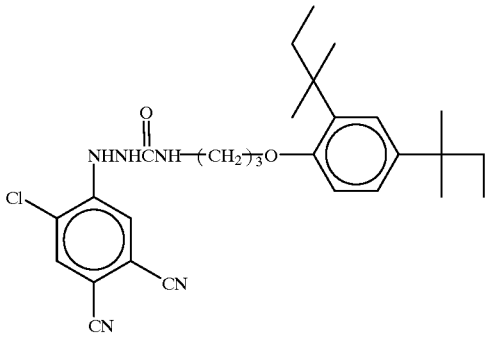
D-35
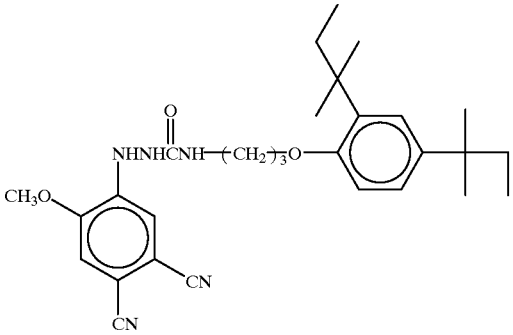
D-36
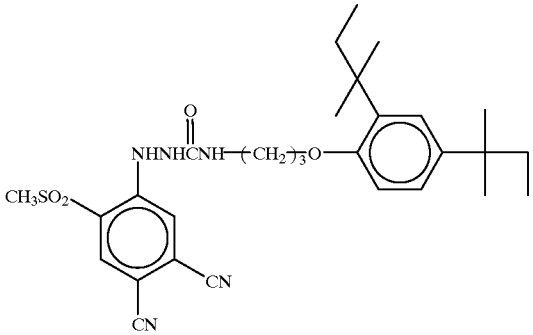

-continued
D-37
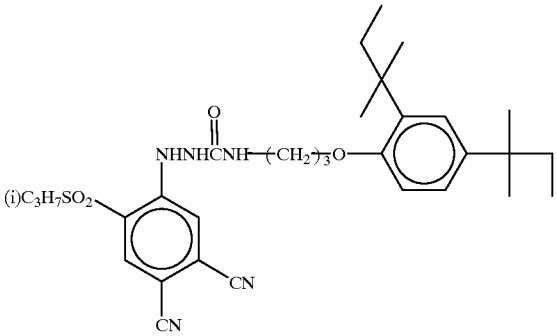
D-38
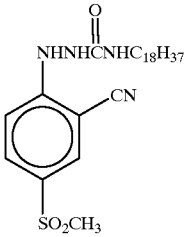
D-39
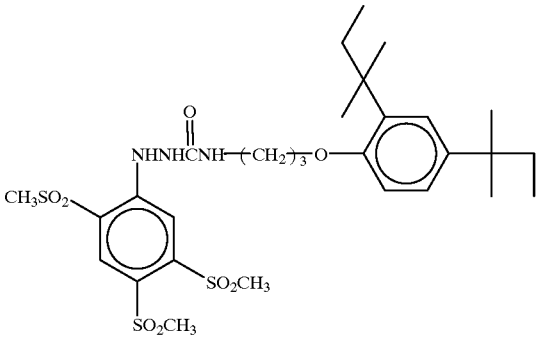
D-40
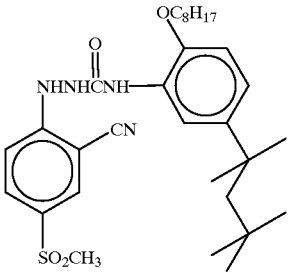
D-41
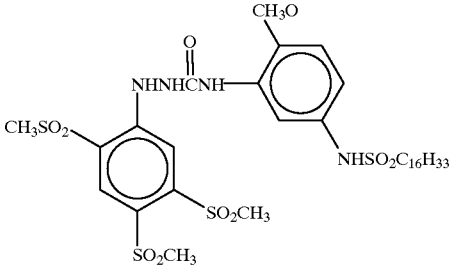

-continued
D-42
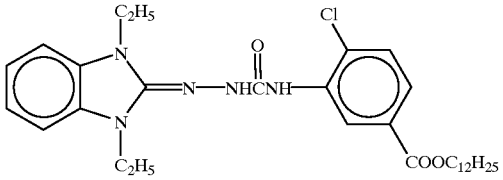
D-43
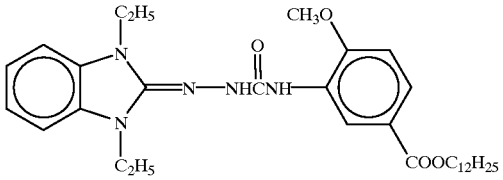
D-44
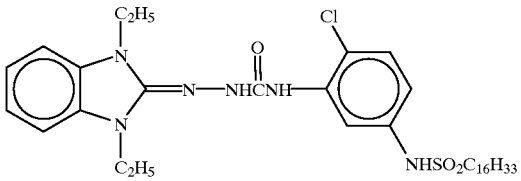
D-45
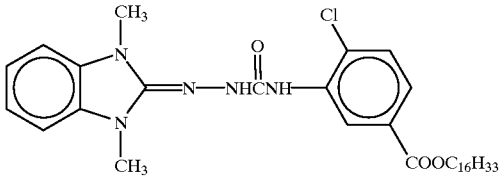
D-46
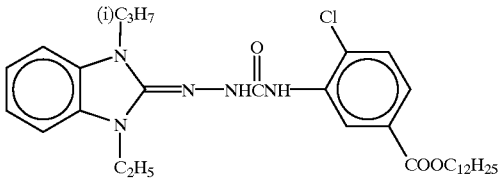
D-47
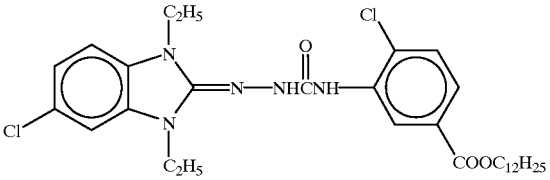
D-48
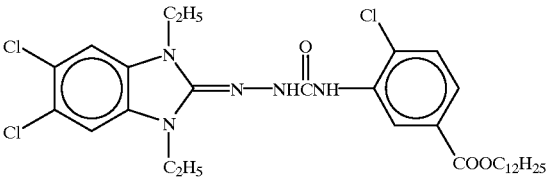
D-49
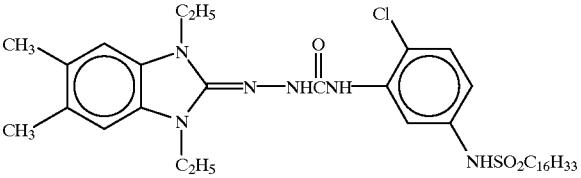

-continued
D-50
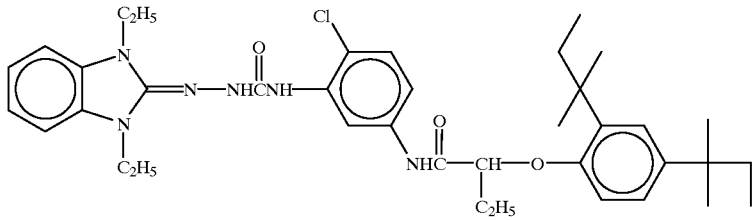
D-51
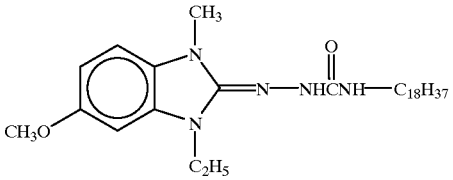
D-52
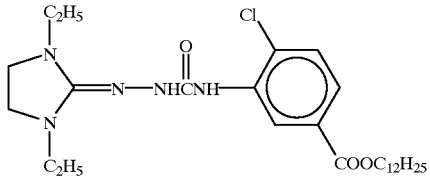
D-53
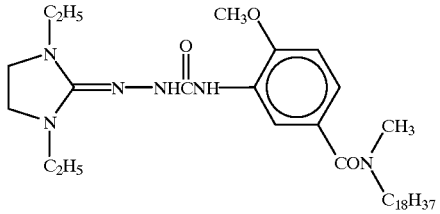
D-54
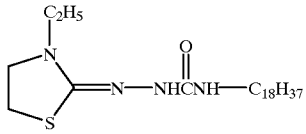
D-55
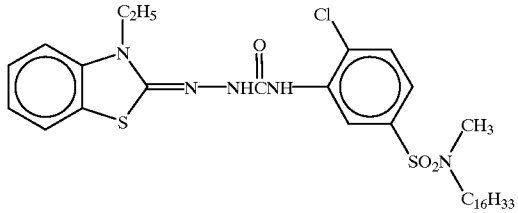
D-56
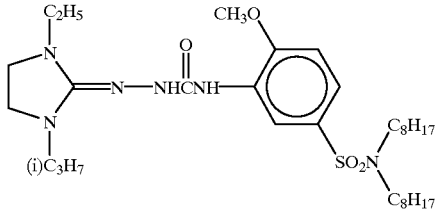
The above-illustrated compounds may generally be synthesized by use of known methods. Some simple synthesis routes are shown below.

Synthesis of Developing Agent D-2

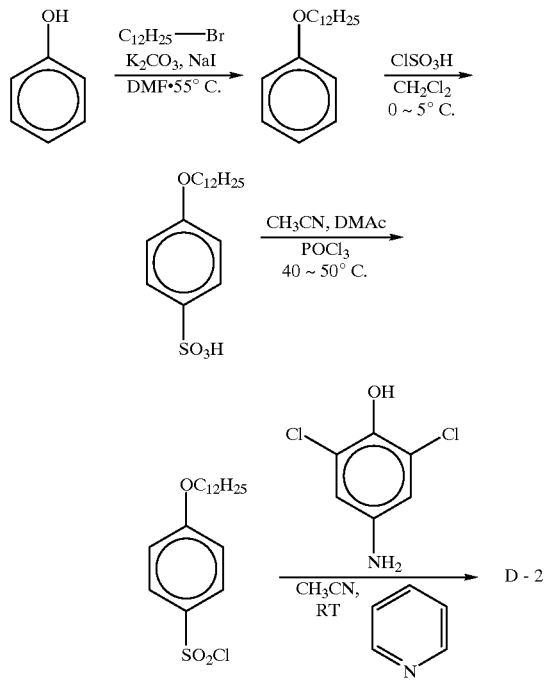

Synthesis of Developing Agent D-27

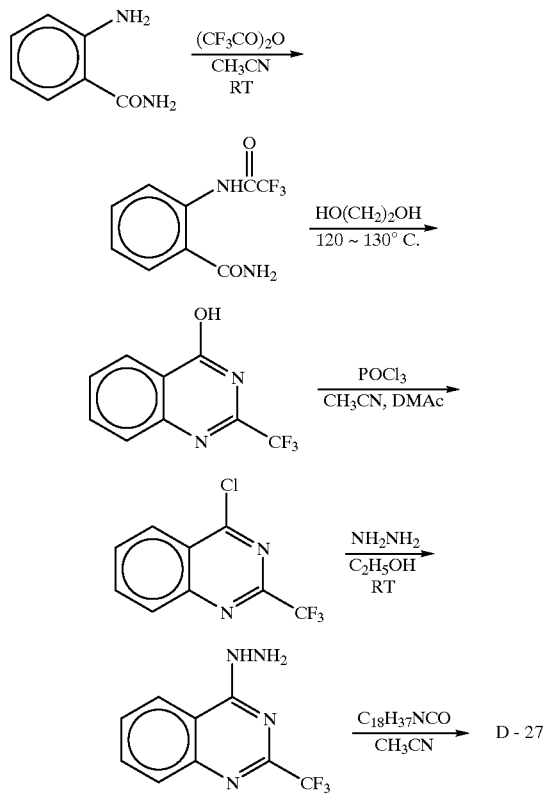

Synthesis of Developing Agent D-42

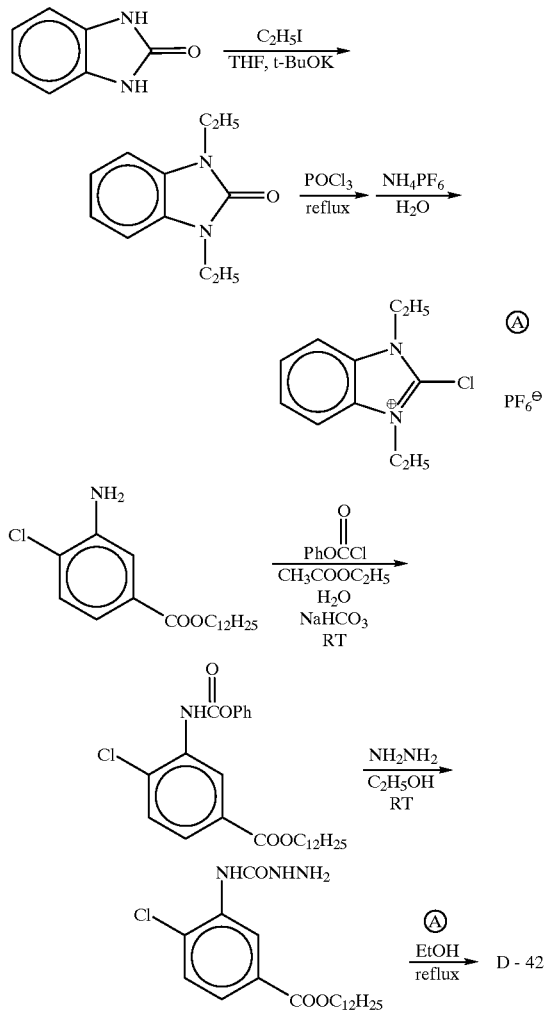

In the case where a nondiffusive developing agent is used, an electron transport agent and/or a precursor thereof may optionally be used therewith in order to accelerate the electron transfer between the nondiffusive developing agent and the silver halide to be developed. Use of electron transport agents and precursor thereof, which are described in U.S. Pat. No. 5,139,919 and EP-A-418,743 is particularly preferred in the present invention. Use of method for introducing the electron transport agent and/or precursor thereof into a layer in a stable manner, which are described in JP-A Nos. 2-230,143 and 2-235,044, is particularly preferred in the present invention.

The electron transport agent and the precursor thereof can be selected from the above-mentioned developing agents and their precursors. The mobility of the electron transport agent or a precursor thereof is preferably greater than that of a nondiffusive developing agent (electron donor) Especially useful electron transport agents are 1-phenyl-3-pyrazolidones or aminophenols.

In addition, the electron donor precursors as described in JP-A No. 3-160,443 are preferable for use in the light-sensitive material of the present invention.

For such purposes as prevention of color mixing, improvement in the color reproduction and the like, a reducing agent may be used in an intermediate layer or in a protective layer. The reducing agents, which are described in European Patent Application Laid-Open Nos. 524,649 and 357,040 and in Japanese Patent Application Laid-Open (JP-A) Nos. 4-249,245, 2-46,450 and 63-186,240, are particularly preferable for use in the present invention. Also usable are development inhibitor releasing reducers which are described in Japanese Patent Application Publication (JP-B) No. 3-63,733, Japanese Patent Application Laid-Open (JP-A) Nos. 1-150,135, 2-46,450, 2-64,634, and 3-43,735 and European Patent Application Laid-Open No. 451,833.

Further, a precursor of a developing agent, which does not have reducing properties per se but which exhibits reducing properties under the influence of a nucleophilic reagent or heat in the process of development, can be used in the light-sensitive material of the present invention.

Moreover, the following reducing agents may be included in the light-sensitive material.

Examples of the reducing agents used in the present invention includes reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A Nos. 60-140,335 (pages 17–18), 57-40,245, 56-138,736, 59-178,458, 59-53,831, 59-182,449, 59-182,450, 60-119,555, 60-128,436, 60-128,439, 60-198,540, 60-181,742, 61-259,253, 62-244,044, 62-131,253, 62-131,256, 64-13,546 (pages 40–57), 1-120,553, and EP-A2-220,746 (pages 78–96).

Also, combinations of various reducing agents as disclosed in U.S. Pat. No. 3,039,869 may be used.

In the present invention, the total amounts of the developing agent and the reducing agent is 0.01–20 moles, preferably 0.01–10 moles, per mole of silver.

In the present invention, four-equivalent couplers or two-equivalent couplers may be suitably selected in accordance with the species of the developing agent. Proper selection of couplers provents production of dull colors attributed to interlayer transfer of oxides of the develping agent. Specific examples of both types of couplers, i.e., four-equivalent couplers and two-equivalent couplers, are described in detail in "The Theory of the Photographic Process," 4th edition, edited by T. H. James, at pages 291–334, 354–361, JP-A No. 58-12,353, 58-149,046,58-149,047, 59-11,114, 59-124,399, 59-174,835, 59-231,539, 59-231,540, 60-2,951, 60-14,242, 60-23,474, 60-66,249, and other patents and literature listed hereinabove.

Hydrophobic additives such as couplers, developing agents, and non-diffusive reducing agents may be introduced into layers of a light-sensitive material by known methods. In this case, an organic solvent having a high boiling point, which is described in, for example, U.S. Pat. Nos. 4,555,470, 4,536,466, 4,536,467, 4,587,206, 4,555,476, 4,599,296, or JP-B No. 3-62,256 may be used, if necessary, in combination with an organic solvent having a low boiling point in the range of 50° to 160° C. These dye-donating compounds, non-difusive reducing agents, and high-boiling-point organic solvents may be used in combinations of two or more species.

The amount of the organic solvent having a high boiling point is not more than 10 g, preferably not more than 5 g, more preferably in the range of 1 g to 0.1 g based on 1 g of hydrophobic additive; or not more than 1 cc, preferably not more than 0.5 cc, particularly preferably not more than 0.3 cc based on 1 g of the binder.

Examples of useful methods for introducing a hydrophobic additive into the layer of a light-sensitive material include a dispersion method utilizing a polymer as described in JP-B No. 51-39,853 and JP-A No. 51-59,943 and a method wherein a hydrophobic additive, which has been converted into a dispersion of fine grains, is added to the layer as described in JP-A No. 62-30,242.

In addition to the above methods, in the case where the hydrophobic additive is a compound substantially insoluble in water, the hydrophobic compound may be dispersed in a binder.

When dispersing a hydrophobic compound to form a hydrophilic colloidal dispersion, a variety of surfactants can be used. For example, surfactants, which are described in JP-A No. 59-157,636, pp. 37–38, and in aforesaid Research Disclosure, can be used. In addition, a phosphoric ester-type surfactant, which is described in JP-A Nos. 7-56,267 and 7-228,589 and in German Patent Application Laid-Open No. 1,932,299A, can also be used in the light-sensitive material of the present invention.

The light-sensitive material of the present invention may contain a compound which activates the development and stabilizes the image. Preferred examples of these compounds are described in U.S. Pat. No. 4,500,626, columns 51–52.

A non-light-sensitive layer, such as a protective layer, a prime layer, an intermediate layer, a yellow filter layer and/or an antihalation layer, may be formed between the silver halide emulsion layers on a top emulsion layer and/or a bottom emulsion layer thereof. Further, a supplementary layer, such as aback layer, maybe formed on the reverse side of the substrate opposite to the side on which the photographic light-sensitive layer is formed. More specifically, it is possible to form, on the substrate, various layers including the above-mentioned construction, a prime layer described in U.S. Pat. No. 5,051,335, an intermediate layer containing a solid pigment described in JP-A Nos. 1-167,838 and 61-20,943, an intermediate layer containing a reducing agent or a DIR compound described in JP-A Nos. 1-120,553, 5-34,884 and 2-64,634, an intermediate layer containing an electron transport layer described in U.S. Pat. No. 5,017,454 and 5,139,919 and in JP-A No. 2-235,044 and a protective layer containing a reducing agent described in JP-A No. 4-249,245 as well as a combination of two or more of these layers.

A dye, which can be used in a yellow filter layer or in an antihalation layer, is preferably a dye which loses its color or is eliminated at the time of development so that it exerts no influence on the density of image after the process.

That the dye which is present in the yellow filter layer or in the antihalation layer loses its color or is eliminated at the time of development means that the amount of the dye remaining after the process is less than one third, preferably less than one tenth, of the amount of the dye present before the process. This may be attained by a phenomenon wherein the component of the dye is leached out of the light-sensitive material or is transferred into the processing material at the time of development, or by a phenomenon wherein the component of the dye undergoes a reaction and becomes a colorless compound at the time of development.

A known dye can be used in the light-sensitive material of the present invention. For example, employable dyes include a dye, which is soluble in an alkaline solution of a developer, and a dye which becomes colorless as a result of the reaction with an ingredient of the developing solution, sulfite ion, a developing agent or an alkali.

Concrete examples of the dyes include the dye described in EP-A-549,489A and the dye described in JP-A No. 7-152,129, ExF 2-6. A dye which is dispersed in fine solid particles and is described in JP-A No. 6-259,805 can also be used. Although this dye can also be used in the case where the light-sensitive material is developed with a processing solution, this dye is particularly suitable to the case where the light-sensitive material is subjected to a heat development utilizing a processing material which is described later.

Further, it is also possible to fix a dye to a mordant and a binder. In this case, the mordant and the dye may be those well known in the field of photography. Examples of the mordants include those described in U.S. Pat. No. 4,500,626, columns 58–59 and in JP-A Nos. 61-88,256, pp. 32–41, 62–244,043 and 62-244,036.

Furthermore, it is also possible to use a reducing agent and a compound which reacts with the reducing agent to release a diffusive dye so that the alkali generated at the time of development causes the reaction to release a mobile dye, which will be eliminated either by being dissolved in the processing solution or by being transferred to the processing material. Examples of these compounds and reducing agents are described in U.S. Pat. Nos. 4,559,290 and 4,783,369, European Patent No. 220,746A2, JIII Journal of Technical Disclosure No. 87-6,119 and JP-A No. 8-101,487, paragraph 0080–0081.

A leuco dye, which becomes colorless, can also be used in the light-sensitive material of the present invention. For example, JP-A No. 1-150,132 discloses a silver halide light-sensitive material containing a leuco dye which is given a color in advance by means of a metal salt of an organic acid as a color developer. Since a complex of a leuco dye and a developer undergoes a reaction by heat or reacts with an alkali to become colorless, the use of the combination of a leuco dye and a color developer in the light-sensitive material of the present invention is desirable if the light-sensitive material of the present invention is to be subjected to a heat development.

In the present invention, a known leuco dye can be used, examples of which are described in Moriga and Yoshida, Senryo to Yakuhin (Dyes and Chemicals)," vol. 9, pp. 84, Association of Chemical Products, "Shinban Senryo Binran (New Handbook of Dyes)", pp. 242, Maruzen Co., Ltd. (1970), R. Garner, "Reports on the Progress of Applied Chemistry," vol. 56, pp. 199 (1971), "Senryo to Yakuhin (Dyes and Chemicals)", vol. 19, pp. 230, Association of Chemical Products (1974), "Shinkizai( Color Materials),", vol. 62, pp. 288 (1989) and "Senryo Kogyo (Die Industry)," vol. 32, pp. 208.

Preferred color developers are a metal salt of an organic acid in addition to acid clay and a phenol/formaldehyde resin. Among metal salts of organic acids, metal salts of salicylic acids, a metal salt of a phenol/salicylic acid/formaldehyde resin, a rhodan salt and a metal salt of xanthogenic acid are preferable. Zinc is particularly preferable among the metals. An oil-soluble zinc salicylate described in U.S. Pat. Nos. 3,864,146 and 4,046,941 and in JP-B No. 52-1,327 can be also used as the color developers.

The light-sensitive material of the present invention is preferably hardened with a hardener.

Examples of the hardener include those described in U.S. Pat. Nos. 4,678,739, column 41 and 4,791,042, and in JP-A Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis (vinylsulfonylacetamide)ethane), a N-methylol compound (e.g., dimethylolurea), boric acid, metaboric acid and a polymeric compound (e.g., a compound described in JP-A No. 62-234,157).

These hardeners are used in an amount of 0.001 to 1 g, preferably, 0.005 to 0.5 g, per gram of a hydrophilic binder.

The light-sensitive material may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, Japanese Patent Application Laid-Open (JP-A) No. 64-13,564, pp. 7–9, pp. 57–71 and pp. 81–97, U.S. Pat. Nos. 4,775,610, 4,626,500 and 4,983,494, Japanese Patent Application Laid-Open (JP-A) Nos. 62-174,747, 62-239,148, 1-150,135, 2-110,557, 2-178,650 and RD 17,643 (1978) pp. 24–25.

The amount of these compounds added is preferably in the range of $5\times10^{-6}$ to $1\times10^{-1}$ mol, more preferably $1\times10^{-5}$ to $1\times10^{-2}$ mol, based on 1 mol of silver.

After exposure of images, the light-sensitive material of the present invention undergoes heat development to thereby form color images.

According to the second aspect of the present invention, the light-sensitive material, after being subjected to exposure, is stuck to a processing material containing a base and/or a precursor of a base, with water being present between the light-sensitive material and the processing material in an amount of 1/10 through 1 time that required to maximally swell the layers of the materials, the resultant assembly being heated to form an image in the light-sensitive material.

According to the second aspect of the present invention, good granularity and exposure latitude are sought, as well as reduction of load imposed on the environment due to solution development. However, the present invention may be applied to an activator method utilizing an alkaline processing solution, or a method in which images are developed through use of a processing solution containing a development agent and a base.

According to the third aspect of the present invention, the light-sensitive material is subjected to exposure, and subsequently, water is applied onto the surface of the light-sensitive layer of the light-sensitive material and/or the surface of the processing layer of the processing material. Thereafter, the surfaces are stuck together and heated for development.

According to the third aspect of the present invention, high sensitivity and good storage stability are sought, as well as reduction of load imposed on the environment due to solution development. However, the light-sensitive material of the third aspect of the present invention may be used in an activator method utilizing an alkaline processing solution, or in a method in which images are developed through use of a processing solution containing a development agent and a base.

A thermal process of a light-sensitive material is well known in the art. For example, a light-sensitive material for heat development and a heat development process are described in "Syashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32–pp. 33, U.S. Pat. Nos. 3,152,904, 3,301,678, 3,392,020 and 3,457,075, U. K. Pat. Nos. 1,131,108 and 1,167,777 and Research Disclosure (June, 1978), pp. 9–15 (RD-17,029).

The light-sensitive material of the present invention for use in heat development may also be used in activator process or in a method in which images are developed through use of a processing solution containing a development agent and a base, to thereby form images.

An activator process means a developing process in which a light-sensitive material containing a color developing agent is treated with a processing solution containing no color developing agent. A feature of the activator process is that the processing solution for the process does not contain a color developing agent which is contained in an ordinary developing solution. The processing solution for the activator process may contain components, such as an alkali and a co-developing agent. Examples of the activator processes are described in publicized literatures such as EP-A Nos. 545,491A1 and 565,165A1.

Methods for developing a light-sensitive material by means of a processing solution containing a developing agent and a base are described in RD Nos. 17,643, pp. 28–29, 18,716, pp. 651, left column to right column, and 307,105, pp. 880–881.

Details of the processing material and processing method to be employed in the heat developing process in the present invention are given below.

A variety of known compounds may be used as the bases or precursors of bases used in the present invention. Preferred bases include hydroxides, carbonates, bicarbonates, borates, and phosphates of alkali metals such as sodium and potassium; hydroxides, carbonates, bicarbonates, borates, phosphates, and carboxylates of quaternary alkyl ammonium substances such as tetramethylammonium and tetraethylammonium; and organic bases, such as amidines, cyclic amidines, guanidines, cyclic guanidines, aliphatic amines, aromatic amines, and heterocyclic amines, as well as their carbonates, bicarbonates, borates, phosphates, and carboxylates. Any of these bases is desirably contained in a processing material in an amount of 0.05–10 g/m$^2$or in processing water in an amount of 1–100 g/liter.

Compounds which can be used as precursors of bases for use in the present invention are those which generate bases through decomposition or reaction under heated or alkaline conditions (e.g. compounds described in JP-A No. 62-65,038 and U.S. Pat. No. 4,511,493). Particularly preferably, a slightly-water-soluble basic metal compound as described in, for example, JP-A No. 62-129,848, EP-210660A2, and U.S. Pat. No. 4,740,445 and a compound capable of undergoing a complex-forming reaction with the metal ion of the slightly-soluble metal compound (called a complex-forming compound or a complexing agent) are used in combination.

The light-sensitive material of the present invention preferably contains a base or a base precursor in order to accelerate the development of silver and the dye forming reaction. Examples of the base precursor include a salt of an organic acid and a base capable of decarboxylation by means of heat and a compound capable of releasing an amine by means of an intramolecular neucleophilic substitution reaction, a Lossen rearrangement or a Beckmann rearrangement. Examples of these compounds are described in U.S. Pat. Nos. 4,514,493 and 4,657,848 as well as in "Known Technologies" No. 5 (issued on Mar. 22, 1991, AZTEC Co., Ltd.), pp. 55–86. In addition, also usable in the present invention is a base generating method in which a combination of a sparingly water-soluble basic metal compound and a compound capable of reacting with the metal contained in the foregoing basic metal compound by use of water as a medium to form a complex compound (hereinafter referred to as a complex forming compound) is used, as described in and EP-A No. 210,660 and in U.S. Pat. No. 4,740,445.

The amount of the base or the base precursor to be used in the present invention is in the range of 0.1 to 20 g/m$^2$, preferably 1 to 10 g/m$^2$.

The light-sensitive material of the present invention may contain a thermal solvent, examples of which include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in JP-B Nos. 1-40,974 and 4-13,701), polyol compounds (e.g., a sorbitol and a polyethylene glycol).

Where the thermal solvent is insoluble in water, preferably the thermal solvent is used as a solid dispersion. Depending on the purposes, the thermal solvent may be contained in anyof a light-sensitive layer and non-light-sensitive layer.

The amount of the thermal solvent added is in the range of 10 to 500% by weight, preferably 20 to 300% by weight, based on the weight of the binder present in the layer to which the thermal solvent is to be added.

Although the heating temperature of the heat development process is in the range of about 50 to 250° C., the temperature is preferably in the range of 60 to 150° C., more preferably in the range of 60 to 100° C.

The time during which the aforementioned heating development is performed is preferably between 3 to 80 seconds, more preferably between 5 and 60 seconds, and particularly preferably between 5 and 30 seconds.

In order to supply a base, which is needed for the heat development process, to the light-sensitive material of the present invention, a processing material is used which has a processing layer containing a base or a base precursor. The processing material may have other functions, for example, a function to shut out the air at the time of heat development, a function to prevent the vaporization of the components of the light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The substrate and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in Japanese Patent Application Laid-Open (JP-A) No. 61-88,256, pp. 32–41, 62-244,043 and 62-244,036. Further, the processing material can contain a dye acceptor polymeric compound described in U.S. Pat. No. 4,463,079, or the above-mentioned thermal solvent The processing layer of the processing material contains abase and/or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

There are various conceivable methods of feeding dampening water to a light-sensitive material in the second aspect of the present invention. Examples of such methods include the following:

(1) A light-sensitive material is passed through dampening water in a dampening water bath at a constant speed, and subsequently excessive water is removed from the light-sensitive material surface through use of nip rollers to thereby apply a constant amount of water onto the light-sensitive material surface;

(2) A constant amount of dampening water is applied onto the surface of a light-sensitive material traveling at a constant speed by the use of an application head such as a coating rod; and (3) A constant amount of dampening water is sprayed onto the surface of a light-sensitive material traveling at a constant speed through use of a spraying apparatus.

These methods may generically be called (1) immersion-in-water method, (2) water application method, and (3) water spraying method. These methods may be embodied in various ways other than those described above. However, in any of these methods, excess dampening water remains in a water tank, a water application unit, etc., and a dampening water tank must be provided within an apparatus. As a result, such stagnant water causes the contamination of water over a long term. Thus, a method of the present invention is not limited to examples described above, but may be used in various applications.

In the present invention, the amount of swelling with water can be measured through use of a film thickness meter. The present invention enables the thickness of a swollen film to be measured while dampening water and a portion to be measured are maintained at a predetermined temperature. The amount of applied dampening water can be obtained from the difference between the weights of a light-sensitive material as measured before and after the light-sensitive material undergoes a dampening step.

When the processing material is subjected to heat development, a small amount of water is preferably used for such purposes as acceleration of development, acceleration of the transfer of the processing material, or acceleration of the diffusion of unnecessary substances as described in U.S. Pat. Nos. 4,704,245 and 4,470,445 and in Japanese Patent Application Laid-Open (JP-A) No. 61-238,056. Such compounds as an inorganic salt of an alkali metal, an organic base, a solvent having a low boiling point, a surfactant, an anti-fogging agent, a compound forming a complex with a sparingly water-soluble metal salt, an anti-mold agent and an antibacterial agent may be added to the water.

The water is not particularly specified, and examples of the water include distilled water, tap water, well water and mineral water. In the heat developing apparatus utilizing the light-sensitive material of the present invention and the processing material, the waste water may be discarded without being reused or may be recycled for repeated use. When using recycled water, the water used accumulates the components leached out of the materials over repeated use. Further, the apparatus and water described in JP-A Nos. 63-144,354, 63-144,355, 62-38,460 and 3-210,555 may be used in the present invention. Moreover, there may be used water that contains water-soluble, low-boiling-point solvents, surfactants, anti-fogging agents, the aforementioned complex-forming compounds, or mildewproofing/antibacterial agents.

Water can be supplied to the light-sensitive material or to the processing material or to both of them. In the second aspect of the present invention, it is preferred that water be applied onto the light-sensitive material.

The amount of the water to be added ranges from 1/10 to the equivalent of an amount which is required for the maximum swelling of the entire coating layers (not including the back layer) composed of the light-sensitive material and the processing material. The amount is preferably between 1/10 and 1/2, more preferably between 1/10 and 1/2.5, and particularly preferably between 1/10 and 1/3.

Preferred examples of methods for supplying water to these materials include the methods described in JP-A Nos. 62-253,159, pp. 5, and 63-85,544. Further, water in the form of microcapsules or hydrates may be incorporated in advance into the light-sensitive material or the processing material or into both of them.

The temperature of the water to be applied falls in the range of 30 to 60° C. as disclosed in JP-A No. 63-85,544. The temperature is preferably between 35 and 60° C., more preferably between 40 and 55° C. Temperatures higher than 45° C. are advantageous for the prevention of propagation of microorganisms in water.

When conducting a heat development of the light-sensitive material in the presence of a small amount of water, it is effective to adopt a method in which a combination of a sparingly water-soluble basic metal compound and a complex forming compound so that abase is generated, as described in and European Patent Application Laid-Open No. 210,660 and in U.S. Pat. No. 4,740,445. In this case, it is desirable to incorporate the sparingly water-soluble basic metal compound in the light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for placing the light-sensitive material and the processing material face to face so that the light-sensitive layer and the processing layer face each other, the methods, which are described in JP-A Nos. 62-253,159 and 61-147,244, pp. 27, can be employed, and a preferable heating time is 5 to 60 seconds.

For the purpose of processing the light- sensitive material and the processing material of the present invention, any known apparatus for heat development can be used. Preferred examples of the apparatus include the apparatus described in JP-A Nos. 59-75,247, 59-177,547, 59-181,353 and 60-18,951, Japanese Utility Model Application Laid-Open (JP-U) No. 62-25,944 and JP-A Nos. 6-130,509, 6-95,338, 6-95,267, 8-29,955, and 8-29,954.

In addition, commercially available apparatus such as "Pictrostat" 100, 200, 300, 330 and 50 and "Pictrography" 3000 and 2000, manufactured by Fuji Photo Film Co., Ltd. Can be used in the present invention.

The light-sensitive material and/or the processing material of the present invention may have an electroconductive heat generator layer as a heating means for the heat development. For example, a heat generator layer described in Japanese Patent Application Laid-Open (JP-A) No. 61-145,544 can be used.

In the present invention, although the image information can be read out without removing the silver produced by development, and undeveloped silver halide from the light-sensitive material, it can be read out after removing the silver or silver halide. In the latter case, the silver or silver halide can be removed concurrently with or after the development.

In order to remove the developed silver from the light-sensitive material concurrently with the development or in order to complex or solubilize the silver halide, the processing material may contain a silver oxidizing or re-halogenating agent, which serves as a bleaching agent, and a solvent for the silver halide, which serves as a fixing agent, so that these reactions occur at the time of the heat development.

Further, after the developing process, a second processing material which contains a silver oxidizing or re-halogenating agent or a solvent for the silver halide and the light-sensitive material may be placed face to face in order that the removal of the developed silver or the complexing or solubilizing of the silver halide be carried out.

In the present invention, in so far as the above-mentioned process does not provide adverse effects on the reading out of image information after development, it is preferable that the light-sensitive material be subjected to the above-mentioned process. Since the undeveloped silver halide causes significant haze in gelatin film to an extent that the background density increases, it is preferable to diminish the haze by use of the above-mentioned complexing agent or to solubilize the silver halide so that all or part of the silver halide is removed from the film. Further, it is desirable to use tabular grains having a high aspect ratio or containing a high content of silver chloride for the purpose of reducing the haze of the silver halide itself.

In the present invention, a processing material can comprise a commonly used silver bleaching agent. Examples of a silver bleaching agent are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid. The fixing agent can be a solvent for silver halide (i.e., solvent capable of dissolving silver halide) which can be used in the processing material for developing the light-sensitive material (the first processing material). The binder, substrate and other additives usable in the second processing material can also be the same substances as those usable in the first processing material.

The amount of bleaching agent to be added should be determined depending on the amount of silver contained in the light-sensitive material, and is in the range of 0.01 to 10 times, preferably 0.1 to 3 times, and more preferably 0.1 to 2 times the amount (mol) of silver present in the light-sensitive material per unit area.

The solvent for silver halide may be a known compound, examples of which include thiosulfates, such as sodium thiosulfate and ammonium thiosulfate, sulfites, such as sodium sulfite and sodium hydrogen sulfite, thiocyanates, such as potassium thiocyanate and ammonium thiocyanate, thioethers, such as 1,8-di-3,6-dithiaoctane, 2,2'-thiodiethanol, 6,9-dioxa-3,12-dithiatetradecane-1,14-diol as described in Japanese Patent Application Publication (JP-B) No. 47-11,386, a compound having a 5- or 6-membered imido ring, such as urasil and hydantoin as described in Japanese Patent Application Laid-Open (JP-A) No. 8-179,458, and a compound represented by the following general formula (V) as described in Japanese Patent Application Laid-Open (JP-A) No. 53-144,319. A mesoion thiolate compound of trimethyltriazolium thiolate described in "Analytica Chemica Acta", vol. 248, pp. 604 to 614 (1991), is also a preferred compound. A compound which is described in Japanese Patent Application Laid-Open (JP-A) No. 8-69,097 and which is capable of fixing a silver halide to stabilize it can also be used as a solvent for the silver halide. General formula (V)

$$N(R^9)(R^{10})—C(=S)—Y-R^{11}$$

where Y represents a sulfur atom or an oxygen atom. $R^9$ and $R^{10}$, which may be the same or different, each represent an aliphatic group, an aryl group, a heterocyclic group or an amino group. $R^{11}$ represents an aliphatic group or an aryl group. $R^9$ and $R^{10}$ or $R^{10}$ and $R^{11}$ may join together to form a 5-membered or a 6-membered heterocyclic ring. The above-described solvents for the silver halide may be used alone or in a combination of two or more of them.

Among the above-described compounds, a compound having a 5-membered or 6-membered imido ring, such as urasil or hydantoin, is particularly preferable. The addition of urasil or hydantoin in the form of potassium salt is preferable, because the salt can suppress gloss reduction during the storage of the processing material.

The content of the total amount of the solvent for silver halide in the processing layer is in the range of 0.01 to 100 mmol/m$^2$, preferably 0.1 to 50 mmol/m$^2$, and more preferably 10 to 50 mmol/m$^2$. The total amount of the solvent for the silver halide in the light-sensitive material is in the range of 1/20 to 10 times, preferably 1/10 to 10 times, and more preferably 1/3 to 3 times the amount (mol) of silver present in the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halide may be added to a coating solution.

Alternatively, the processing material may contain a physical development nucleus and the solvent for silver halide, so that the solvent for silver halide solubilizes the silver halide contained in the light-sensitive material concurrently with the development and so that the physical development nucleus reduces the soluble silver halide diffused from the light-sensitive material to convert it to physically developed silver which is to be fixed to a processing layer. Any physical development nucleus known as such can be used in the present invention. Examples of the physical development nucleus include colloidal grains of a heavy metal, such as zinc, mercury, lead, cadmium, iron, chromium, nickel, tin, cobalt, copper, and ruthenium, aprecious metal, such as palladium, platinum, silver, and gold, a chalcogen compound composed of the foregoing and a substance such as sulfuric acid, selenium or tellurium. These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/m$^2$, preferably from $10^{-2}$ to 10 mg/m$^2$, in the processing layer.

Although the physical development nucleus may be prepared separately from a coating solution and thereafter the physical development nuclei may be added to the coating solution, the physical development nucleus may be prepared, for example, by the reaction between silver nitrate and sodium sulfide or between silver chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have small Dmin and high Dmax values.

Both the first processing material and the second processing material can have at least one timing layer. The timing layer can temporarily retard the bleaching and fixing reaction until the desired reaction among the silver halide, a dye forming compound and a developing agent substantially ends. The timing layer may comprise gelatin, polyvinyl alcohol or a vinyl alcohol/vinyl acetate copolymer. This layer may be a barrier timing layer as described in U.S. Pat. Nos. 4,056,394, 4,061,496 and 4,229,516.

The film thickness of the timing layer is in the range of 5 to 50 $\mu$m, preferably 10 to 30 $\mu$m.

According to the present invention, the light-sensitive material after exposure thereof is bleached and fixed utilizing the second processing material. That is, the process comprises supplying water, in an amount ranging from 1/10 to the equivalent of an amount which is required for the maximum swelling of the total of the light-sensitive material layer and the second processing material layer excepting the back respective layers, to the light-sensitive material or to the second processing material, placing the light-sensitive material and the second processing material so that the light-sensitive layer and processing layer face each other and thereafter heating them to a temperature in the range of 40 to 100° C. for 5 to 60 seconds.

As for the amount of water, kind of water, method of supplying water and method of placing the light-sensitive material and the second processing material face to face, the same as those in the case of the first processing material can be employed.

More specifically, the bleaching and fixing sheets described in JP-A No. 59-136,733, U.S. Pat. No. 4,124,398 and JP-A No. 55-28,098 can be used in the present invention.

For such purposes as improvement of the coatability, improvement of the releasability, improvement of the slipperiness, prevention of electrostatic charge and acceleration of developing reaction, a surfactant may be added to the light-sensitive material. Examples of the surfactants include those described in "Known Technologies" No. 5 (issued on Mar. 22, 1991, AZTEC Co., Ltd.), pp. 136–138 and in JP-A Nos. 62-173,463 and 62-183,457.

For such purposes as prevention of slip, prevention of electrostatic charge and improvement of the releasability, an organic fluorine-containing compound may be added to the light-sensitive material. Typical examples of the organic fluorine-containing compounds include a fluorine-containing surfactant and a hydrophobic fluorine-containing compound, such as an oily fluorine-containing compound, e.g., fluorocarbonoil, and a solid fluorine-containing resin, e.g., tetrafluoroethylene, described in Japanese Patent Application Publication (JP-B) No. 57-9,053, columns 8–17, Japanese Patent Application Laid-Open (JP-A) Nos. 61-20, 944 and 62-135,826.

Preferably, the light-sensitive material has a certain level of slipperiness. For this purpose, it is preferable that a slicking agent is contained both in the light-sensitive layer and in the back layer. A preferred level of slipperiness is indicated by a coefficient of dynamic friction in the range of 0.01 to 0.25, which is determined in a test comprising sliding the light-sensitive material at a rate of 60 cm/minute against stainless steel balls having a diameter of 5 mm (25° C., 60% RH). In this test, a value of nearly the same level is obtained even if the stainless steel balls are replaced with a light-sensitive layer.

Examples of usable slicking agents include polyorganosiloxanes, higher aliphatic acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. The layer to which the slicking agent is added is preferably the outermost light-sensitive layer or the back layer. Polydimethylsiloxane and an ester having a long alkyl chain are particularly preferable.

It is preferable to use an anti-static agent in the present invention. Polymers, which contain carboxylic acid, carboxylic acid salt or a sulfonic acid salt, cationic polymers and ionic surfactants can be used as the anti-static agent.

The most preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ Ω·cm or less, preferably $10^5$ Ω·cm or less, or grains of a complex oxide thereof, for example, complex of an element such as Sb, P, B, In, S, Si, C and the like and the foregoing metal oxide. The amount of an anti-static agent present in the light-sensitive material is preferably in the range of 5 to 500 mg/m$^2$, more preferably in the range of 10 to 350 mg/m$^2$. The ratio of the electroconductive crystalline oxide or the complex oxide thereof to a binder is preferably in the range of 1/300 to 100/1, more preferably 1/100 to 100/5.

Constituent layers (including back layers) of the light-sensitive material or processing material can contain a polymer latex in order to improve film physical properties such as dimension stability, prevention of curling, prevention of adhering, prevention of film cracking and prevention of pressure-induced sensitization or desensitization. Any and all polymer latices, which are described in JP-A Nos. 62-245,258, 62-136,648 and 62-110,066, can be used in the present invention. Particularly, the utilization of a polymer latex having a low glass transition point (40° C. or less) in the mordant layer of the processing material can prevent cracking of the mordant layer, while the utilization of a polymer latex having a high glass transition point in the back layer of the processing material can prevent curling.

Preferably, the light-sensitive material of the present invention contains a matting agent. Although the matting agent may be added to either the light-sensitive layer or the back layer, it is particularly preferable that the matting agent be added to the outermost layer on the same side of the substrate as the light-sensitive layer is provided. Although the matting agent may be soluble or insoluble in a processing solution, it is preferable to use a combination of a soluble matting agent and an insoluble matting agent in the present invention. An example of such a combination of matting agents comprises grains of polymethyl methacrylate, poly (methyl methacrylate/methacrylic acid) (in a molar ratio of 9/1 or 5/5) and polystyrene. The matting agent has grain diameters preferably in the range of 0.8 to 10 $\mu$m and preferably has a narrow range of grain diameter distribution. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 μm or less, together with the matting agent having the above-mentioned grain diameter. Examples of fine grains include grains of polymethyl methacrylate (0.2 μm), grains of poly(methyl methacrylate/methacrylic acid) (in a molar ratio of 9/1, 0.3 μm ), grains of polystyrene (0.25 μm) and grains of colloidal silica (0.03 μm).

Concrete examples of the matting agent are described in JP-A No. 61-88,256, pp.29. Other examples of the matting agent are such materials as benzoguanamine resin beads, polycarbonate beads and AS resin beads, all of which are described in JP-A Nos. 63-274,944 and 63-274,952. Further, the compounds which are described in the aforesaid Research Disclosure can be employed as the matting agent.

In the present invention, a substrate for the light-sensitive material and the processing material needs to be able to withstand the processing temperature. Generally, examples of the substrate are paper, a synthetic polymer (film) and the like, as described in "Syashinkogaku no kiso—Ginen Syashin Hen (Fundamentals of Photographic Engineering—Silver Salt Photography Section)", pp. 223–240, edited by Photographic Society of Japan, Corona Co., Ltd., 1979. Concrete examples of the substrate include polyethylene terephthalate, polyethylene naphthalate, polycarbonate, polyvinyl chloride, polystyrene, polypropylene, polyimide and cellulose (e.g., triacetylcellulose).

These materials may be used alone. Further, a substrate in which a synthetic polymer such as polyethylene may be laminated to one side or both sides of paper can be used.

Other substrates, which can be used in the present invention, include those described in JP-A Nos. 62-253,159, pp. 29–31, 1-161,236, pp.14–17, 63-316,848, 2-22,651 and 3-56,955 and U.S. Pat. No. 5,001,033.

Where requirements of resistance to heat and curling are stringent, preferred examples of the substrates are those described in JP-A Nos. 6-41,281, 6-43,581, 6-51,426, 6-51,437 and 6-51,442 and in JP-A Nos. 6-82,961, 6-82,960, 6-123,937, 6-82,959, 6-67,346, 6-266,050, 6-202,277, 6-175,282, 6-118,561, 7-219,129 and 7-219,144 and U.S. Pat. No. 5,326,689.

Also preferable is a substrate mainly made from a styrene-based polymer having a syndiotactic structure.

In order to bond the photographic layer to the substrate, it is preferable that the substrate be surface-treated. Examples of the surface processes include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are particularly preferable.

A prime layer may comprise single layer or may comprise two or more layers. Examples of the binder for the prime layer include a copolymer, which is made up of a monomer selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the substrate, include resorcin and p-chlorophenol. The prime layer may contain a gelatin-hardening agent such as chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the prime layer may contain $SiO_2$, $TiO_2$, grains of an inorganic material or grains of a copolymer of polymethyl methacrylate (0.01 to 10 μm) as a matting agent.

In addition, it is preferable to record photographic information and the like by use of a substrate which is provided with a magnetic recording layer and is described in JP-A Nos. 4-124,645, 5-40,321, 6-35,092 and 6-317,875.

A magnetic recording layer is formed by coating onto a substrate an aqueous or organic solvent-based coating solution comprising a binder and magnetic grains dispersed therein.

Examples of usable magnetic grains include ferromagnetic iron oxide such as $\gamma$-$Fe_2O_3$, Co-covered $\gamma$-$Fe_2O_3$, Co-covered magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-covered ferromagnetic iron oxide such as Co-covered $\gamma$-$Fe_2O_3$ispreferable. The shape of the magnetic grains may be selected from the group consisting of needles, grains, spheres, cubes and plates. The specific surface area in $S_{BET}$ is preferably 20 $m^2/g$ or greater, more preferably 30 $m^2/g$ or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic grains may be surface-treated with silica and/or alumina or with an organic substance. Further, as described in JP-A No. 6-161,032, the ferromagnetic grains may be surface-treated with a silane coupling agent or with a titanium coupling agent. Magnetic grains, which are covered with an inorganic or organic substance and are described in JP-A Nos. 4-259,911 and 5-81,652, can also be used in the present invention.

As described in JP-A No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight-average molecular weight in the range of 2,000 to 1,000,000. Preferred examples of the binder include vinyl-based copolymers, cellulose derivatives, such as cellulose diacetate, cellulose triacetate, cellulose acetatepropionate, cellulose acetatebutylate and cellulose tripropionate, acrylic resins, polyvinyl acetal resins and gelatin. Cellulose di(tri)acetate is particularly preferable. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in JP-A No. 6-59,357.

As described in JP-A No. 6-35,092, the aforementioned magnetic grains are dispersed in a binder preferably by means of a kneader, a pin-type mill or an annular mill. A combination of these dispersing means is also preferable. A dispersant, such as the dispersant described in JP-A No. 5-88,283 and other known dispersants, may be used in order to disperse the magnetic grains in the binder. The thickness of the magnetic recording layer is in the range of 0.1 to 10

μm, preferably 0.2 to 5 μm, and more preferably 0.3 to 3 μm. The ratio of the weight of the magnetic grains to the weight of the binder is preferably in the range of 0.5:100 to60:100, more preferably 1:100 to30:100. The coated weight of the magnetic grains is in the range of 0.005 to 3 g/m$^2$, preferably 0.01 to 2 g/m$^2$ , and more preferably 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic substrate by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in JP-A No. 5-341,436, is preferably used.

The magnetic recording layer may also function in the enhancement of lubrication, control of curling, prevention of electrostatic charge, prevention of adhering and head polishing. Also, another functional layer having any of these functions may be formed. The abrasive grains, which impart a head polishing function to the magnetic recording layer or to another functional layer, preferably contain at least one type of grain having a Moh's hardness of 5 or greater and are non-spherically shaped inorganic grains. Examples of non-spherical inorganic grains include oxides, such as aluminum oxide, chromium oxide, silicon dioxide and titanium dioxide, carbides, such as silicon carbide and titanium carbide, and diamond. The surface of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and5,215,874 and in EP466,130.

A polyester substrate, which is preferably used in the light-sensitive material having the above-described magnetic recording layer, is described below. Details of the polyester substrate along with a light-sensitive material, a processing procedure, a cartridge and examples in use thereof are shown in JIII Journal of Technical Disclosure No. 94-6,023 (issued on Mar. 15, 1994 from The Japan Institution of Invention and Innovation).

The polyester is made up of a diol and an aromatic dicarboxylic acid. Examples of the aromatic dicarboxylic acid include 2,6-, 1,5-, 1,4- and2,7-naphthalenedicarboxylicacid, terephthalic acid, isophthalic acid and phthalic acid. Examples of the diol include diethylene glycol, triethylene glycol, cyclohexanedimethanol, bisphenol A and bisphenol. Examples of polymers, which are formed from theses monomers, include homopolymers such as polyethylene terephthalate, polyethylene naphthalate and polycyclohexanedimethanol terephthalate. A polyester, in which 2,6-naphthalenedicarboxylic acid comprises 50 to 100 mol % of the carboxylic acid monomer composition, is preferable, and polyethylene 2,6-naphthalate is particularly preferable. The average molecular weight of the polyester is in the range of about 5,000 to 200,000. Tg of the polyester is 50° C. or greater, preferably 90° C. or greater.

Next, in order to make the polyester substrate low-curling, the polyester substrate is subjected to a heat process at a temperature which is preferably above 40° C. but below Tg, more preferably above (Tg - 20) °C. but below Tg. The heat process may be carried out in a continuous manner at a temperature within the above-mentioned range, or it may be carried out discontinuously so that a cooling step is effected between heat-processing steps. The duration of the heat process is preferably in the range of 0.1 to 1,500 hours, more preferably 0.5 to 200 hours. The heat process may be effected while the substrate is held in the shape of a roll, or the heat process may be effected while the substrate is in the shape of a web while being carried. Electroconductive inorganic grains, such as $SnO_2$ and $Sb_2O_5$, may be provided onto the surface of the substrate to impart surface roughness so that the surface condition is improved. Further, it is preferable that the substrate be designed in such a way that the tips of the roll are slightly elevated relative to other parts so that transfer of the cut end mark in the roll core is prevented. Although the heat process may be carried out after film forming, after surface process, after application of back layer (e.g., antistatic agent, slicking agent or the like) and after application of primer, the heat process is carried out preferably after the application of an anti-static agent.

An ultraviolet absorber may be blended into the polyester. Further, in order to prevent light piping, a dye or pigment, commercialized for polyester use under the names of "Diaresin" (from Mitsubishi Chemical Industries, Co., Ltd.) or "Kayaset" (from Nihon Kayaku Co., Ltd.) may be blended into the polyester.

A film patrone (a film case), into which the light-sensitive material of the present invention may be encased, is explained below. The main material of the film patrone may be a metal or a synthetic plastic.

Preferred examples of the plastic material include polystyrene, polyethylene, polypropylene and polyphenyl ether. The film case may contain an anti-static agent, examples of which include carbon black, metal oxide grains, surfactants, such nonionic, anionic, cationic or betaine-based surfactants, and polymers. Examples of the film cases, which have been rendered antistatic, are described in JP-A Nos. 1-312,537 and 1-312,538. The resistivity of the film case is preferably $10^{12}$ Ω·cm or less in a condition of 25° C. and 25% RH. Normally, carbon black or a pigment is incorporated into the plastic film case in order to afford shading. The size of the film case may be the 135 size which is currently employed (the diameter of cartridge of the 135 size is 25 mm). For use in a small-sized camera, a film case having a diameter of the cartridge of 22 mm or less may be used. The case volume of the film case is 30 cm$^3$ or less, preferably 25 cm$^3$ or less. The weight of the plastics for a film case is preferably in the range of 5 to 15 g.

A film patrone which feeds out film by the rotation of a spool may be used for the light-sensitive material of the present invention. A film patrone wherein the end of the film is fed from the port of the film patrone to the outside by rotating the spool axis in the direction of the feed of the film can also be used. These film cases are described in U.S. Pat. Nos. 4,834,306 and 5,226,613.

As for the method to form an image on a sheet of color paper or on a light-sensitive material for heat development, the methods, which are described in JP-A Nos. 5-241,251, 5-19,364 and 5-19,363, can be used.

EXAMPLE 1

(1) Preparation of emulsions:

Tabular silver iodobromide emulsion I-1-A (Comparative emulsion)

$H_2SO_4$ was added to an aqueous solution (1,000 cc) containing oxidized gelatin (0.5 g) and KBr (0.37 g) so as to bring the pH of the solution to 2. The resultant solution was stirred with the temperature of the solution being maintained at 40° C. An aqueous 0.3M $AgNO_3$ solution (20 cc) and an aqueous 0.3 M KBr solution (20 cc) were simultaneously added in double jets for 40 seconds. Subsequently, KBr was added to adjust pAg to 9.9, and the pH was adjusted to 5.0 by the addition of NaOH. The temperature of the solution was elevated to 75° C. over 35 minutes. oxidized gelatin (35 g) was added, and an aqueous 1.2 M $AgNO_3$ solution (512 cc) and an aqueous 1.4 M KBr solution (440 cc) were added over 33 minutes with the pAg being maintained at 7.72 and the flow rate being increased (the flow rate at the point of completion of addition was 5.2 times that at the start point).

Subsequently, the temperature of the mixture was lowered to 55° C. An aqueous 0.4 M $AgNO_3$ solution (104 cc) and an aqueous 0.12 M KI solution (279 cc) were added to the mixture at a constant flow rate over a period of five minutes, followed by addition of an aqueous KBr solution to thereby adjust the pAg to 8.8. Thereafter, an aqueous 1.8 M $AgNO_3$ solution (110 cc) and an aqueous 1.8 M KBr solution (125 cc) were added.

Subsequently, the resultant emulsion was cooled to 35° C. and washed by a customary flocculation method. The emulsion was mixed with gelatin (75 g) and was adjusted to pH=5.5 and pAg=8.2.

The obtained emulsion contained tabular grains that accounted for more than 99% of the total projected area of the entirety of the grains. The average equivalent circle diameter of the grains was 0.65 $\mu$m.

Emulsions I-1-B through I-1-D were prepared in the same manner as emulsion I-1-A.

Tabular silver iodobromide emulsion I-1-B (Comparative emulsion)

This emulsion was prepared as was the case with the emulsion I-1-A with the exception of the following:

Addition of the solution at an increased flow rate was similarly performed at 75° C. with pAg being maintained at 8.01 instead of 7.72. The pAg value after the temperature was lowered to 55° C. was adjusted to the same pAg value as that of emulsion I-1-A, and then subsequent additions were performed.

Tabular silver iodobromide emulsion I-1-C (Emulsion of the present invention)

This emulsion was prepared as was the case with the emulsion I-1-A with the exception of the following:

Addition of the solution at an increased flow rate was similarly performed at 75° C. with pAg being maintained at 8.29 instead of 7.72. The pAg value after the temperature was lowered to 55° C. was adjusted to the same pAg value as that of emulsion I-1-A, and then subsequent additions were performed.

Tabular silver iodobromide emulsion I-1-D (Emulsion of the present invention)

This emulsion was prepared as was the case with the emulsion I-1-A with the exception of the following:

Addition of the solution at an increased flow rate was similarly performed at 75° C. with pAg being maintained at 8.58 instead of 7.72. The pAg value after the temperature was lowered to 55° C. was adjusted to the same pAg value as that of emulsion I-1-A, and then subsequent additions were performed.

(2) Chemical sensitization

The emulsions I-1-A through I-1-D were subjected to spectral and chemical sensitization by addition of spectral sensitizing dye, Compound I, potassium thiocyanate, chloroauric acid, and sodium thiosulfate at 60° C., pH=6.2, and pAg=8.4. At this time, the spectral sensitizing dye was changed in proportion to the surface area of grains of the respective emulsion, and the amount of chemical sensitizing agent was adjusted so as to maximize the sensitivity of the emulsion with respect to an exposure of 1/100 sec.

Sensitizing dye I-I for green-sensitive emulsion

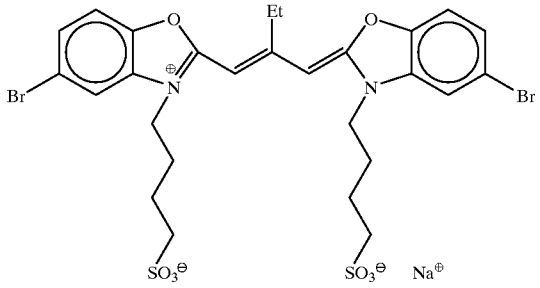

Sensitizing dye I-II for green-sensitive emulsion

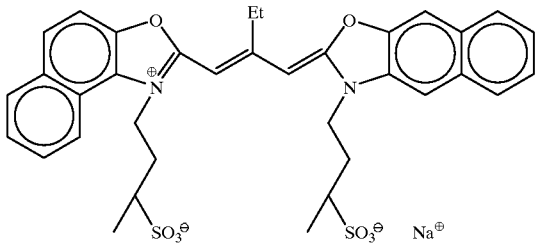

Sensitizing dye I-III for green-sensitive emulsion

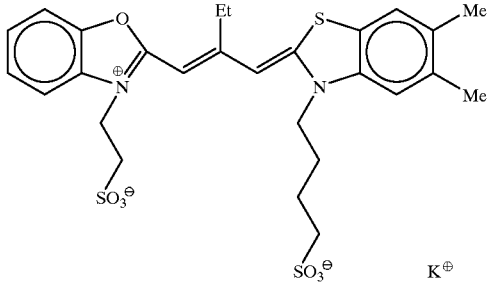

I-I: I-II: II=II 77:20:3 (mixed at the molor ratio)

Compound I

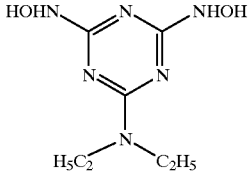

(3) Preparation and evaluation of dispersions and coated samples

A dispersion of zinc hydroxide for use as a base precursor was prepared.

31 g of a zinc hydroxide powder with a primary grain size of 0.2 micrometers was mixed with dispersion agents; namely, 1.6 g of carboxymethylcellulose, 0.4 g of sodium polyacrylate, 8.5 g of lime-treated ossein gelatin, and 158.5 ml of water. This mixture was dispersed over a period of one hour by a mill employing glass beads. After dispersion of the mixture, the glass beads were filtered, whereby 188 g of dispersion of zinc hydroxide was obtained.

Further, an emulsion dispersion of a magenta coupler was prepared.

7.80 gofamagenta coupler (a), 5.45 g of a developing agent (b), 2 mg of an anti-fogging agent (c), 8.21 g of a high-boiling-point organic solvent (d), and 24.0 ml of ethyl acetate were dissolved at 60° C. The thus-dissolved solution was mixed with 150 g of aqueous solution into which 12.0 g of lime-treated gelatin and 0.6 g of sodium dodecylbenzene sulfonate were dissolved. The mixture was then emulsified and dispersed over a period of 20 minutes at 10,000 r.p.m. through use of a dissolver. Distilled water was added to the mixture so that the total volume of the mixture became 300 g, and the mixture was further mixed over a period of ten minutes at 2,000 r.p.m.

Magenta coupler (a)

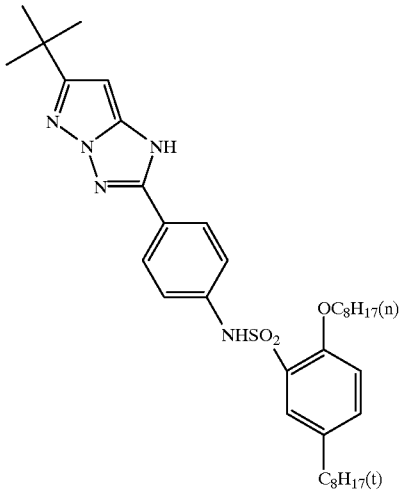

Developing agent (b)

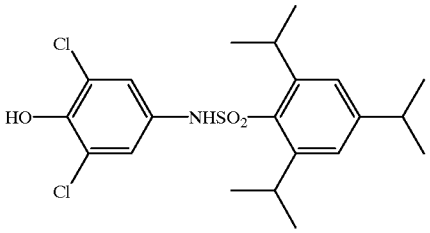

Anti-fogging agent (c)

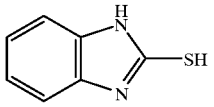

High-boiling-point organic solvent (d)

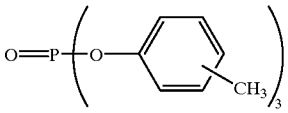

-continued

Surfactant (e)

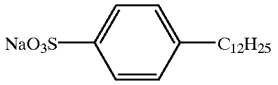

The thus-prepared dispersions and the emulsions I-1-A through I-1-F were applied in combination to a support so as to yield a composition provided in Table 1, so that single-layer heat-developable color light-sensitive materials of samples 101 through 104 were prepared.

Also, processing material I-P-land support I-A shown in Tables 2 and 3 were prepared.

TABLE 1

| | | Samples I-101 to I-104 |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | |
| Intermediate layer | Lime-treated gelatin | 375 |
| | Surfactant (g) | 15 |
| | Zinc hydroxide | 1100 |
| | Water-soluble polymer (h) | 15 |
| Magenta dye forming layer | Lime-treated gelatin | 2000 |
| | Emulsion (based on the amount of coated silver) | 1726 (One of Emulsions I-1-A to I-1-F) |
| | Magenta coupler (a) | 637 |
| | Developing agent (b) | 444 |
| | Anti-fogging agent (c) | 0.2 |
| | High-b.p.-organic solvent (d) | 670.00 |
| | Surfactant (e) | 33 |
| | Water-soluble polymer (h) | 14 |
| Transparent PET base (120 μm) | | |

* The figures represent the amounts of coating (mg/m$^2$).

TABLE 2

Structure of Processing Material I-P-1

| Structure of layers | Materials incorporated | Amounts (mg/m$^2$) |
|---|---|---|
| The 4th layer: Protective layer | Acid-treated gelatin | 220 |
| | Water-soluble polymer (j) | 60 |
| | Water-soluble polymer (k) | 200 |
| | Additive (l) | 80 |
| | Palladium sulfate | 3 |
| | Potassium nitride | 12 |
| | Matting agent (m) | 10 |
| | Surfactant (g) | 7 |
| | Surfactant (n) | 7 |
| | Surfactant (o) | 10 |
| The 3rd layer: Intermediate layer | Lime-treated gelatin | 240 |
| | Water-soluble polymer (k) | 24 |
| | Hardener (p) | 180 |
| | Surfactant (e) | 9 |
| The 2nd layer: Base-generating layer | Lime-treated gelatin | 2400 |
| | Water-soluble polymer (k) | 360 |
| | Water-soluble polymer (q) | 700 |
| | Water-soluble polymer (r) | 600 |
| | High b.p. solvent (s) | 2000 |
| | Additive (t) | 20 |
| | Potassium hydantoin | 260 |
| | Guanidine picolate | 2910 |
| | Potassium quinolate | 225 |
| | Sodium quinolate | 180 |
| | Surfactant (e) | 24 |

TABLE 2-continued

Structure of Processing Material I-P-1

| Structure of layers | Materials incorporated | Amounts ($mg/m^2$) |
|---|---|---|
| The 1st layer: Undercoat layer | Lime-treated gelatin | 280 |
| | Water-soluble polymer (j) | 12 |
| | Surfactant (g) | 14 |
| | Hardener (p) | 185 |
| Transparent support I-A (63 $\mu$m) | | |

TABLE 3

Structure of Support I-A

| Layers | Composition | Weight ($mg/m^2$) |
|---|---|---|
| Upper surface undercoat layer | Gelatin | 100 |
| Polymer layer | Polyethylene terephthalate | 62500 |
| Backface undercoat layer | Methyl methacrylate-styrene-2-ethylhexylacrylate-methacrylic acid copolymer | 1000 |
| | PMMA latex (av. particle size: 12 $\mu$m) | 120 |
| | | 63720 |

Surfactant (f)

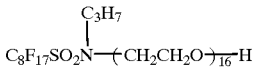

Surfactant (g)

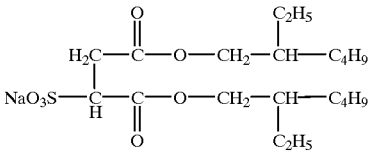

Water-soluble polymer (h)

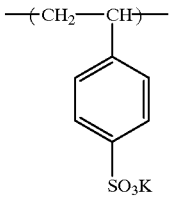

Hardener (i)

$CH_2{=}CH{-}SO_2{-}CH_2{-}SO_2{-}CH{=}CH_2$

Water-soluble polymer (j) κ-carrageenan

Water-soluble polymer (k) Sumikagel L-5H (by Sumitomo Chemical)

Additive (1)

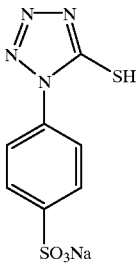

Matting agent (m) SYLOID 79 (by Fuji Davison)

Surfactant (n)

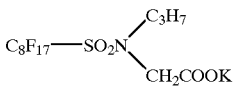

Surfactant (o)

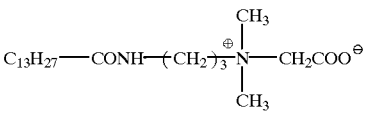

TABLE 3-continued

Structure of Support I-A

| Layers | Composition | Weight (mg/m$^2$) |
|---|---|---|
| Hardener (p) | Water-soluble polymer (q) Dextran (M.W. = 70,000) | |
| 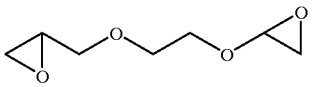 | | |
| Water-soluble polymer (r) MP polymer MP 102 (by Kuraray) | | |
| High-b.p. solvent (s) | Enpara 40 (by Ajinomoto) | |
| Additive (t) | | |
| 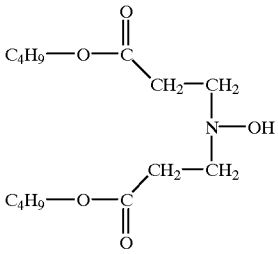 | | |

These light-sensitive materials were exposed to light at 1000 lux over a period of 1/100 second through an optical wedge and a green filter.

Water at a temperature of 40° C. was applied at 15 ml/m$^2$ to the surface of an exposed light-sensitive material. The light-sensitive material was brought into face-to-face contact with a processing material. The thus-superposed film was subjected to heat development for 30 seconds at 83° C. through use of a heating drum. The light-sensitive material was peeled from the processing material after the development, so that a magenta-colored wedge-shaped image was obtained. This sample was further subjected to treatment in the second step through use of a second processing sheet provided hereinbelow.

TABLE 4

Structure of Processing Material I-P-2

| Structure of layers | Materials incorporated | Amounts (mg/m$^2$) |
|---|---|---|
| The 4th layer: Protective layer | Acid-treated gelatin | 220 |
| | Water-soluble polymer (j) | 60 |
| | Water-soluble polymer (k) | 200 |
| | Additive (1) | 80 |
| | Palladium sulfate | 3 |
| | Potassium nitride | 12 |
| | Matting agent (m) | 10 |
| | Surfactant (g) | 7 |
| | Surfactant (n) | 7 |
| | Surfactant (o) | 10 |
| The 3rd layer: Intermediate layer | Lime-treated gelatin | 240 |
| | Water-soluble polymer (k) | 24 |
| | Hardener (p) | 180 |
| | Surfactant (e) | 9 |
| The 2nd layer: Fixing layer | Lime-treated gelatin | 2400 |
| | Water-soluble polymer (k) | 360 |
| | Water-soluble polymer (q) | 700 |
| | Water-soluble polymer (r) | 600 |

TABLE 4-continued

Structure of Processing Material I-P-2

| Structure of layers | Materials incorporated | Amounts (mg/m$^2$) |
|---|---|---|
| | Compound A | 4000 |
| | Surfactant (e) | 20 |
| The 1st layer: Undercoat layer | Lime-treated gelatin | 280 |
| | Water-soluble polymer (j) | 12 |
| | Surfactant (g) | 14 |
| | Hardener (p) | 185 |
| Transparent support I-A (63 μm) | | |

Compound A

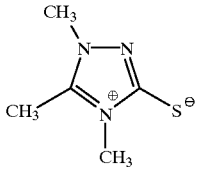

In the treatment of the second step, 10 cc/m$^2$ of water was applied to the second processing sheet, and this sheet was bonded to the light-sensitive material which had finished undergoing the first treatment. The sheet was heated at 60° C. for 30 seconds. Transmission density of color-developed samples of this sheet was measured, whereby so-called characteristic curves were obtained. The relative sensitivity was determined by the reciprocal of the amount of exposure corresponding to a density 0.15 higher than the fog density. Sensitivity was represented with reference to the value of sample I-101, which was taken as 100.

To examine the granularity of the sample, the sample was exposed such that the magenta color density became 1.0. Color-developed pieces were prepared by carrying out the same heat development. The RMS value of the color-developed pieces was measured at an aperture having a diameter of 48 micrometers through use of a diffused light source. The reciprocal numbers of the thus-measured RMS values were represented in the form of relative values with reference to the value of the sample I-101, which was taken as 100.

In order to compare the heat-developed light-sensitive materials with those developed in a conventional processing bath which contains a color developing agent, the light-sensitive materials were exposed to light in a manner similar to that described above and developed at 38° C. for 165 seconds through use of a color negative film processor CN-16. The densities of the color-developed samples were measured in the same way as described above, thereby obtaining characteristic curves and granularity values.

The results are shown in Table 5.

TABLE 5

| Sample | | Mean grain | Av. equivalent | Development with heat (self-contained developer) | | CN-16 Treatment | |
|---|---|---|---|---|---|---|---|
| No. | Emulsion | thickness | circle diameter | Sensitivity | Granularity | Sensitivity | Granularity |
| I-101 | I-1-A | 0.144 | 1.13 | 100 | 100 | 102 | 70 |
| I-102 | I-1-B | 0.082 | 1.50 | 107 | 110 | 107 | 75 |
| I-103 | I-1-C | 0.068 | 1.64 | 132 | 151 | 115 | 84 |
| I-104 | I-1-D | 0.060 | 1.75 | 162 | 169 | 123 | 95 |

The mean grain thickness and equivalent circle diameter values of the emulsion were obtained from electron micrographs taken through a transmitting electron microscope by the replica method.

Samples I-101' through I-104', which are the same as the samples I-101 through I-104 except that a developing agent is excluded, were subjected to the above-described processing through use of the CN-16 processor, leading to the same results as in the case where the samples I-101 through I-104 were processed through use of the CN-16 processor.

As is obvious from the results described above, the color light-sensitive material of the present invention, which comprises an emulsion containing tabular silver halide grains having a mean thickness smaller than 0.07 $\mu$m and undergoes heat development through use of a self-contained developing agent, exhibits significantly improved sensitivity-granularity ratio as compared with a light-sensitive material developed in a conventional developing bath containing a color developing agent.

EXAMPLE 2

The emulsions I -1-A through I -1-D prepared in Example 1 were used for an intermediate-sensitivity layer of a magenta-developing layer. Laminated coated samples were prepared by use of emulsions I-1-A through I-1-F layers other than the intermediate-sensitivity layer of the magenta-developing layer, which were prepared in the same way as that described in JP-A No. 1-329231 and adjusted in grain size, as well as by use of blue-sensitive and red-sensitive emulsions which were prepared by changing the spectral sensitizing coloring agents to agents provided below. Physical properties of emulsions I-1-A through I-1-F used in the preparation are shown in Table 6.

Sensitizing dye I-IV for blue-sensitive emulsion

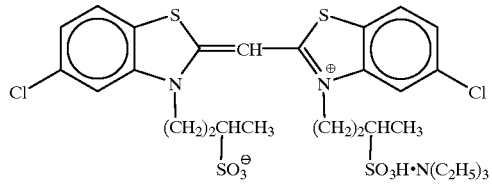

Sensitizing dye I-V for red-sensitive emulsion

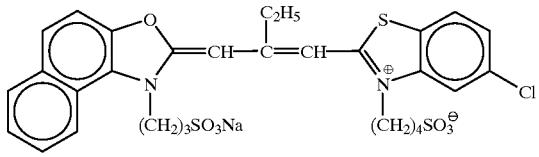

Sensitizing dye I-VI for red-sensitive emulsion

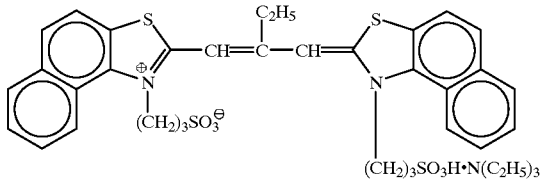

Sensitizing dye I-VII for red-sensitive emulsion

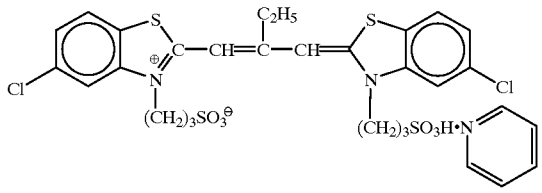

Mixed at the molar ratio, I-V:I-VI:I-VII=40:2:58

TABLE 6

| | Av. AgI contents (%) | Average grain dia. (μm) | Variation coefficient of grain dia. (%) | Ratio of diameter/ thickness | Silver amount ratio [core/int./shell] (AgI contents) | Structure and shape of grains |
|---|---|---|---|---|---|---|
| Emulsion I-A | 6.3 | 1.07 | 22 | 4.0 | [2/63/35] (1/7/6) | Tabular grains of triple structure |
| Emulsion I-B | 8.8 | 0.64 | 20 | 5.2 | [7/64/29] (0/10/8) | Tabular grains of triple structure |
| Emulsion I-C | 3.7 | 0.37 | 15 | 2.6 | [5/30/65] (0.5/0/5) | Tabular grains of triple structure |
| Emulsion I-D | 4.7 | 0.86 | 20 | 5.0 | [3/64/33] (1/3/9) | Tabular grains of triple structure |
| Emulsion I-E | 5.4 | 0.65 | 20 | 5.4 | [1/68/31] (0/2/13) | Tabular grains of triple structure |
| Emulsion I-F | 3.7 | 0.49 | 17 | 3.2 | [5/35/60] (0/0/6) | Tabular grains of triple structure |

Further, dispersions of cyan and yellow couplers were prepared according to the method of preparing dispersions of the coupler of Example 1.

For the purposes of forming coloring layers which can be decolored at the time of heat development, dispersions of coloring agents by combination of zinc complex and leuco dyes for yellow, magenta, and cyan were also prepared.

Compounds used in the preparation are provided hereunder.

Yellow coupler (u)

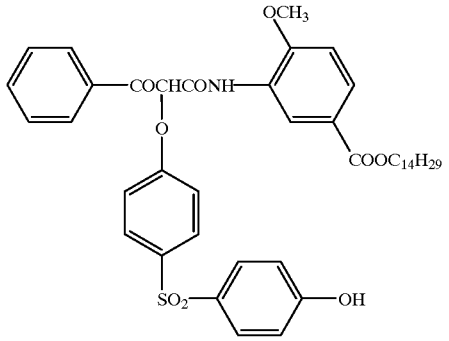

Developing agent (v)

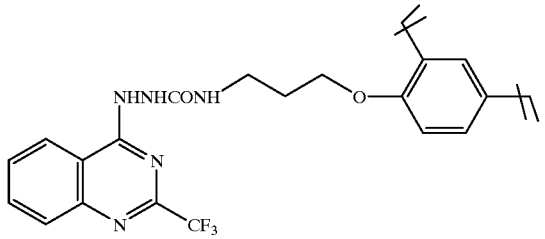

Anti-fogging agent (w)

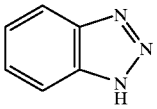

-continued
Cyan coupler (aa)
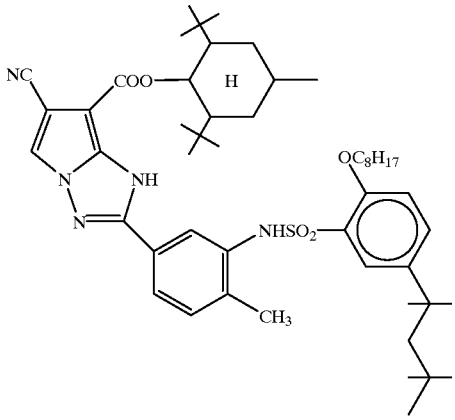
Leuco dye (ab)
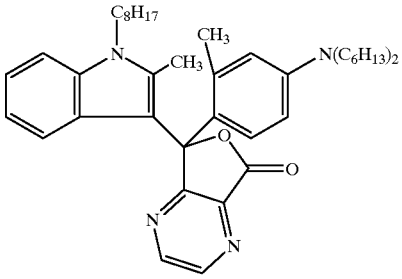
Yellow-developing leuco dye (x)
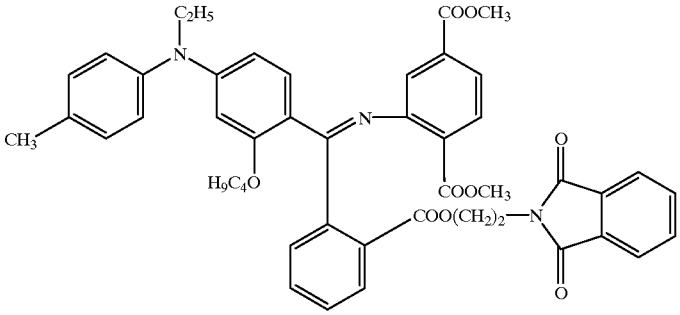
Developer (y)
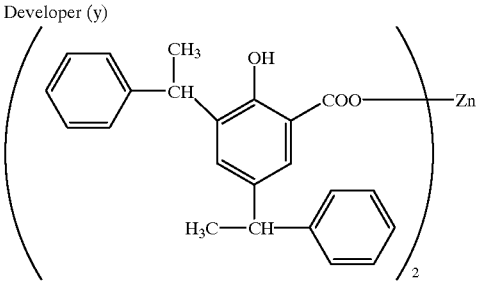

-continued

Magenta-developing leuco dye (z)

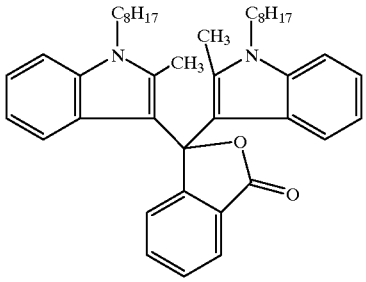

Samples 1-201 to I-204 of multilayer heat-developable color light-sensitive materials provided in Tables 7 through 9 were prepared through use of the thus-obtained silver halide emulsions, dispersions of the couplers, and dispersions of the coloring agents.

TABLE 7

| | | Samples I-201 to I-204 |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (l) | 98 |
| Intermediate layer | Lime-treated gelatin | 375 |
| | Surfactant (g) | 15 |
| | Zinc hydroxide | 1100 |
| | Water-soluble polymer (h) | 15 |
| Yellow dye forming layer (High sensitive layer) | Lime-treated gelatin | 150 |
| | Emulsion (based on the amount of coated silver) | 647 (Emulsion I-A) |
| | Yellow coupler (u) | 57 |
| | Developing agent (v) | 41 |
| | Anti-fogging agent (w) | 4 |
| | High-b.p.-organic solvent (d) | 50 |
| | Surfactant (e) | 3 |
| | Water-soluble polymer (h) | 1 |
| Yellow dye forming layer (Intermediate sensitive layer) | Lime-treated gelatin | 220 |
| | Emulsion (based on the amount of coated silver) | 475 (Emulsion I-B) |
| | Yellow coupler (u) | 84 |
| | Developing agent (v) | 60 |
| | Anti-fogging agent (w) | 6 |
| | High-b.p.-organic solvent (d) | 74 |
| | Surfactant (e) | 4 |
| | Water-soluble polymer (h) | 2 |
| Yellow dye forming layer (Low sensitive layer) | Lime-treated gelatin | 1400 |
| | Emulsion (based on the amount of coated silver) | 604 (Emulsion I-C) |
| | Yellow coupler (u) | 532 |
| | Developing agent (v) | 382 |
| | Anti-fogging agent (w) | 40 |
| | High-b.p.-organic solvent (d) | 469 |
| | Surfactant (e) | 23 |
| | Water-soluble polymer (h) | 10 |

TABLE 8

| | | |
|---|---|---|
| Intermediate layer | Lime-treated gelatin | 750 |
| | Surfactant (e) | 15 |

TABLE 8-continued

| | | |
|---|---|---|
| | Leuco dye (x) | 303 |
| | Developer (y) | 433 |
| | Water-soluble polymer (h) | 15 |
| Magenta dye forming layer (High sensitive layer) | Lime-treated gelatin | 150 |
| | Emulsion (based on the amount of coated silver) | 647 (Emulsion I-D) |
| | Magenta coupler (a) | 48 |
| | Developing agent (b) | 33 |
| | Anti-fogging agent (c) | 0.02 |
| | High-b.p.-organic solvent (d) | 50 |
| | Surfactant (e) | 3 |
| | Water-soluble polymer (h) | 1 |
| Magenta dye forming layer (Intermediate sensitive layer) | Lime-treated gelatin | 220 |
| | Emulsion | 475 (One of Emulsion I-1-A to I-1-D) |
| | Magenta coupler (a) | 70 |
| | Developing agent (b) | 49 |
| | Anti-fogging agent (c) | 0.02 |
| | High-b.p.-organic solvent (d) | 74 |
| | Surfactant (e) | 4 |
| | Water-soluble polymer (h) | 2 |
| Magenta dye forming layer (Low sensitive layer) | Lime-treated gelatin | 1400 |
| | Emulsion | 604 (Emulsion I-F) |
| | Magenta coupler (a) | 446 |
| | Developing agent (b) | 311 |
| | Anti-fogging agent (c) | 0.14 |
| | High-b.p.-organic solvent (d) | 469 |
| | Surfactant (e) | 23 |
| | Water-soluble polymer (h) | 10 |

TABLE 9

| | | |
|---|---|---|
| Intermediate layer | Lime-treated gelatin | 900 |
| | Surfactant (e) | 15 |
| | Leuco dye (z) | 345 |
| | Developer (y) | 636 |
| | Zinc hydroxide | 1100 |
| | Water-soluble polymer (h) | 15 |
| Cyan dye forming layer (High sensitive layer) | Lime-treated gelatin | 150 |
| | Emulsion | 647 (Emulsion I-D) |
| | Cyan coupler (aa) | 65 |
| | Developing agent (b) | 33 |
| | Anti-fogging agent (c) | 0.03 |
| | High-b.p.-organic solvent (d) | 50 |
| | Surfactant (e) | 3 |
| | Water-soluble polymer (h) | 1 |
| Cyan dye forming layer (Intermediate sensitive layer) | Lime-treated gelatin | 220 |
| | Emulsion | 475 (Emulsion I-E) |
| | Cyan coupler (aa) | 96 |
| | Developing agent (b) | 49 |
| | Anti-fogging agent (c) | 0.05 |

TABLE 9-continued

| | | |
|---|---|---|
| | High-b.p.-organic solvent (d) | 74 |
| | Surfactant (e) | 4 |
| | Water-soluble polymer (h) | 2 |
| Cyan dye forming layer (Low sensitive layer) | Lime-treated gelatin | 1400 |
| | Emulsion | 604 (Emulsion I-F) |
| | Cyan coupler (aa) | 610 |
| | Developing agent (b) | 311 |
| | Anti-fogging agent (c) | 0.32 |
| | High-b.p.-organic solvent(d) | 469 |
| | Surfactant (e) | 23 |
| | Water-soluble polymer (h) | 10 |
| Antihalation layer | Lime-treated gelatin | 750 |
| | Surfactant (e) | 15 |
| | Leuco dye (ab) | 243 |
| | Developer (y) | 425 |
| | Water-soluble polymer (h) | 15 |
| Transparent PET base (120 $\mu$m) | | |

* The figures represent the amounts of coating (mg/m$^2$)

The photographic characteristics of these light-sensitive materials were tested as in Example 1. First, the light-sensitive materials were exposed to light at 1000 lux over a period of 1/100 second through an optical wedge.

Water at a temperature of 40° C. was applied at 15 ml/m$^2$ to the surface of the exposed light-sensitive materials. The light-sensitive materials were brought into face-to-face contact with the processing material used in Example 1. The thus-superposed film was subjected to heat development for 30 seconds at 83° C. through use of the heating drum. The light-sensitive materials were peeled from the processing material after the development, and the transmission density of the magenta-colored wedge-shaped image was measured through use of a green filter, whereby characteristic curves were obtained. As in Example 1, the relative sensitivity was determined by the reciprocal of the amount of exposure corresponding to a density 0.15higher than the fog density. Sensitivity was represented with reference to the value of sample I-201, which was taken as 100.

To examine the granularity of the sample, the sample was exposed such that the magenta color density became 1.0. Color-developed pieces were prepared by carrying out the same heat development. The RMS value of the color-developed pieces was measured at an aperture having a diameter of 48 micrometers through use of a diffused light source. The reciprocal numbers of the thus-measured RMS values were represented in the form of relative values with reference to the value of the sample I-101, which was taken as 100.

As in Example 1, in order to compare the heat-developed light-sensitive materials with those developed in a conventional processing bath which contains a color developing agent, the light-sensitive materials were exposed to light in a manner similar to that described above and developed at 38° C. for 165 seconds through use of a color negative film processor CN-16. The densities of the color-developed samples were measured in the same way as described above, thereby obtaining characteristic curves and granularity values.

The results are shown in Table 10.

TABLE 10

| Sample No. | Emulsion | Development with heat (self-contained developer) Sensitivity | Granularity | CN-16 Treatment Sensitivity | Granularity |
|---|---|---|---|---|---|
| I-201 | I-1-A | 100 | 100 | 100 | 73 |
| I-202 | I-1-B | 107 | 108 | 105 | 78 |
| I-203 | I-1-C | 132 | 147 | 112 | 88 |
| I-204 | I-1-D | 162 | 168 | 120 | 99 |

From the above results, effects of the present invention as Example 1 were confirmed.

EXAMPLE 3

Samples of layered application were prepared in a manner similar to that described in Example 2, excepting that the supports were prepared as described below. Tests were similarly performed by use of the resultant samples. Excellent results were obtained, confirming the effects of the present invention.

1) Support

The support used in the present example was prepared as follows:

Polyethylene-2, 6-naphthalate polymer (100 parts by weight) was compounded with Tinuvin P.326 (Ciba-Geigy; a UV absorber, 2 parts by weight) and bought to dryness. The compound was melted at 300° C. and extruded through a T-shaped die. The extruded material was subjected to longitudinal stretching (×3.3) at 140° C. and subsequently to transversal stretching (×3.3) at 130° C. The resultant stretched film was thermally set at 250° C. for 6 seconds to thereby obtain a PEN film having a thickness of 90 $\mu$m. The PEN film contained suitable amounts of blue dyes, magenta dyes, and yellow dyes (I-1, I-4, I-6, I-24, I-26, I-27, II-5 described in Technical Disclosure Bulletin No. 94-6023). The film was wound on a stainless steel rod having a diameter of 20 cm, and a thermal hysteresis was applied at 110° C. for 48 hours so as to obtain a support which is resistant to curling.

2) Undercoating The thus-obtained support was subjected to corona discharge treatment, UV discharge treatment, and glow treatment, on both surfaces. To each surface of a PEN support was applied, by use of a bar coater, an undercoat liquid (10 cc/m$^2$) containing 0.1 g/m$^2$ of gelatin, 0.01 g/m$^2$ of sodium $\alpha$-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g° C. /m$^2$ of a polyamide-epichlorohydrin polycondensation product. The undercoat layer was provided on the high temperature side during stretching. The coated support was dried at 115° C. for 6 minutes. (The temperature of all the rolls and conveyors in the drying zone was set to 115° C.)

3) Coating of backing layers

On one surface of the thus-obtained undercoated support, backing layers consisting of an antistatic layer, a magnetic recording layer, and a lubricating layer were provided.

3-1) Coating of an antistatic layer An antistatic layer was formed by the application of a mixture containing 0.2 g/m$^2$ of a fine powder dispersion (diameter of secondary aggregates: about 0.08 $\mu$m) of stannic oxide-antimony oxide complex particles having an average diameter of 0.005 $\mu$m and a specific resistance of 5 Ω.cm, 0.005 g/m$^2$ of gelatin, 0.02 g/m$^2$ of $(CH_2{=}CHSO_2CH_2CH_2NHCO)_2CH_2$, 0.05 g/m$^2$ of polyoxyethylene-p-nonylphenol (polymerization degree: 10) and resorcin.

3-2) Coating of a magnetic recording layer A magnetic recording layer having a thickness of 1. 2 μm was formed by the application, through use of a bar coater, of a mixture containing 0.06 g/m$^2$ of colbalt-gamma-iron oxide coated with 3-polyoxyethylene-propyloxytrimethoxysilane (polymerization degree: 15) (specific surface area of the coated particles: 43 m$^2$/g, major axis: 0.14 μm, minor axis: 0.03 μm, saturation magnetization: 89 emu/g, $Fe^{+2}/Fe^{+3}$=6/94, the surfaces are treated with 2% by weight, with resect to the weight of the iron oxide, of aluminum oxide—silicone oxide) 1.2 g/m$^2$ of diacetylcellulose (the iron oxide was dispersed through use of an open kneader and a sand mill), 0.3 g/m$^2$ of $C_2H_5C(CH_2CONH—C_6H_3(CH_3)NCO)_3$ (as a setting agent), and solvents therefor (acetone, methylethylketone, and cyclohexanone, and dibutylphtalate). The magnetic recording layer also contained 50 mg/m$^2$ of lubricant $C_6H_{13}CH(OH)C_{10}H_{20}COOC_{40}H_{81}$ and the following two matting agents; 50 mg/m$^2$of silica particles (1.0 μm) and 10 mg/m$^2$ of aluminum oxide particles (0.20 μm and 1.0 μm) (which serve as grinder particles) coated with 15% by weight of 3-polyoxyethylene-propyloxytrimethoxysilane (polymerization degree: 15). Drying was performed at 115° C. for 6 minutes (the temperature of all the rollers and conveyors in the drying zone was set to 115° C.). The increment in color density of $D^B$ in the magnetic recording layer when irradiated with light of X light (a blue filter) was approximately 0.1. Saturation magnetization moment of the magnetic recording layer was 4.2 emu/g, coercive force was $7.3\times10^4$ A/m, and the square ratio was 65%.

3-3) Lubricating layer

A lubricating layer was formed by the application of a mixture containing hydroxyethylcellulose (25 mg/m$^2$) $C_6H_{13}CH(OH)C_{10}H_{20}COOC_{40}H_{81}$ (6 mg/m$^2$), and silicone oil BYK-310 (Bigchem-Japan Co. Ltd.) (1.5 mg/m$^2$) . The mixture was applied in the form of a dispersion, which was prepared by melting the mixture in xylene/propylene glycol monomethyl ether (1/1) at 105° C., pouring the resultant melt into propylene monomethyl ether (10 times in amount) having ambient temperature to form a dispersion, and further diluting the resultant dispersion in acetone (average particle size: 0.01 μm). Drying was performed at 115° C. for 6 minutes (the rollers and conveyors in the drying zone were all set to 115° C.). The resultant lubricant layer had a dynamic friction coefficient of 0.10 (stainless steel balls having a diameter of 5 mm, load: 100 g, and speed: 6 cm/min) , a static friction coefficient of 0.08 (clipping method), and a dynamic friction coefficient of 0.15 between the emulsion layer which will be described below and the lubricating layer, thus exhibiting excellent properties.

EXAMPLE 4

In contrast with Example 2 wherein the emulsions I-1-A through I-1-D were used for an intermediate-sensitivity layer of a magenta dye forming layer, the emulsions I-1-A through I-1-D whose sensitizing dyes were changed to the sensitizing dye I-IV for green-sensitive emulsions were used for an intermediate-sensitivity layer of a yellow dye forming layer. Samples were prepared and tested in a manner similar to that of Example 2. Excellent results were obtained, confirming the effects of the present invention.

Also, the emulsions I-1-A through I-1-D whose sensitizing dyes were changed to the sensitizing dyes I–V through I–VII for red-sensitive emulsions were used for an intermediate-sensitivity layer of a cyan dye forming layer. Samples were prepared and tested in a manner similar to that of Example 2. Excellent results were also obtained.

Further, the emulsions I-1-A through I-1-D were adjusted in grain size to an average equivalent spherical diameter of 0.86 P for a high-sensitivity layer and to an average equivalent circle diameter of 0.49μ for a low-sensitivity layer. In addition, sensitizing dyes of the emulsions I-1-A through I-1-D were changed to sensitizing dyes I—I through I–III for green-sensitive emulsions, sensitizing dye I-IV for blue-sensitive emulsions, and sensitizing dyes I–V through I–VII for red-sensitive emulsions, thereby preparing green-sensitive, blue-sensitive, and red-sensitive emulsions for high- and low-sensitivity layers, respectively. Samples were prepared and tested in a manner similar to that of Example 2 except that the thus-prepared emulsions replaced those used in Example 2. Excellent results were also obtained.

EXAMPLE 5

(1) Preparation of emulsions

Tabular silver iodobromide emulsion II-1-A (Comparative Emulsion)

$H_2SO_4$ was added to an aqueous solution (1,000 cc) containing oxidized gelatin (0.5 g) and KBr (0.37 g) so as to bring the pH of the solution to 2. The resultant solution was stirred with the temperature of the solution being maintained at 40 C. An aqueous 0.3M $AgNO_3$ solution (20 cc) and an aqueous 0.3 M KBr solution (20 cc) were simultaneously added in double jets for 40 seconds. Subsequently, the pH was adjusted to 5.0 by the addition of NaOH. The temperature of the solution was elevated to 75° C. over 35 minutes. Oxidized gelatin (35 g) was added, and an aqueous 1.2 M $AgNO_3$ solution (512 cc) and an aqueous 1.4 M KBr solution (440 cc) were added over 33 minutes with the pAg being maintained at 7.72 and the flow rate being increased (the flow rate at the point of completion of addition was 5.2 times that at the start point).

Subsequently, the temperature of the mixture was lowered to 55° C. An aqueous 0.4 M $AgNO_3$ solution (104 cc) and an aqueous 0.12 M KI solution (279 cc) were added to the mixture at a constant flow rate over a period of five minutes, followed by addition of an aqueous KBr solution to thereby adjust the pAg to 8.8. Thereafter, an aqueous 1.8 M $AgNO_3$ solution (110 cc) and an aqueous 1.8 M KBr solution (125 cc) were added.

Subsequently, the resultant emulsion was cooled to 35° C. and washed by a customary flocculation method. The emulsion was mixed with gelatin (75 g) and was adjusted to pH=5.5 and pAg=8.2.

The obtained emulsion contained tabular grains that accounted for more than 99% of the total projected area of the entirety of the grains. The average equivalent circle diameter of the grains was 0.65 μm.

Emulsions II-1-B through II-1-D were prepared in the same manner as emulsion II-1-A.

Tabular silver iodobromide emulsion II-1-B (Comparative emulsion)

This emulsion was prepared as was the case with the emulsion II-1-A with the exception of the following:

Addition of the solution at an increased flow rate was similarly performed at 75° C. with pAg being maintained at 8.01 instead of 7.72. The pAg value after the temperature was lowered to 55° C. was adjusted to the same pAg value as that of emulsion II-1-A, and then subsequent additions were performed.

Tabular silver iodobromide emulsion II-1-C (Emulsion of the present invention)

This emulsion was prepared as was the case with the emulsion II-1-A with the exception of the following:

Addition of the solution at an increased flow rate was similarly performed at 75° C. with pAg being maintained at 8.29 instead of 7.72. The pAg value after the temperature was lowered to 55° C. was adjusted to the same pAg value as that of emulsion II-1-A, and then subsequent additions were performed. This emulsion was an iodobromide emulsion which contains iodides in an amount of 3.5 mol % and has a latent image forming chemical site on a grain surface.

Tabular silver iodobromide emulsion II-1-D (Emulsion of the present invention)

This emulsion was prepared as was the case with the emulsion II-1-A with the exception of the following:

Addition of the solution at an increased flow rate was similarly performed at 75° C. with pAg being maintained at 8.58 instead of 7.72. The pAg value after the temperature was lowered to 55° C. was adjusted to the same pAg value as that of emulsion II-1-A, and then subsequent additions were performed. This emulsion was an iodobromide emulsion which contains iodides in an amount of 3.5 mol % and has a latent image forming chemical site on a grain surface.

Physical properties of these emulsions are shown below in Table 11.

TABLE 11

| Emulsion Species | II-1-A | II-1-B | II-1-C | II-1-D |
|---|---|---|---|---|
| Average equivalent circle diameter (μm) | 1.13 | 1.5 | 1.64 | 1.75 |
| Mean grain thickness (μm) | 0.144 | 0.082 | 0.068 | 0.060 |
| Average aspect ratio | 7.8 | 18.3 | 24.1 | 29.2 |

(2) Chemical sensitization

The emulsions II-1-A through II-1-D were subjected to spectral and chemical sensitization by addition of spectral sensitizing dye, Compound I, potassium thiocyanate, chloroauric acid, and sodium thiosulfate at 60° C., pH=6.2, and pAg=8.4. At this time, the spectral sensitizing dye was changed in proportion to the surface area of grains of the respective emulsion, and the amount of chemical sensitizing agent was adjusted so as to maximize the sensitivity of the emulsion with respect to an exposure of 1/100 sec. The thus-adjusted green-sensitive emulsions were represented with the affix "g" like II-1-Ag.

Sensitizing dye II-I for green-sensitive emulsion

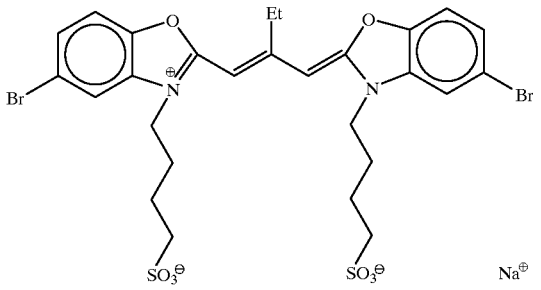

$8.4\times10^{-4}$ mol per mole of silver for emulsion II-1-A

Sensitizing dye II-II for green-sensitive emulsion

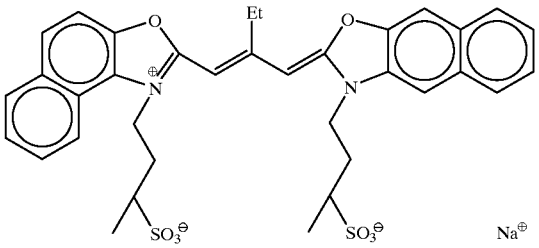

$2.2\times10^{-4}$ mol per mole of silver for emulsion II-1-A

Sensitizing dye II-III for green-sensitive emulsion

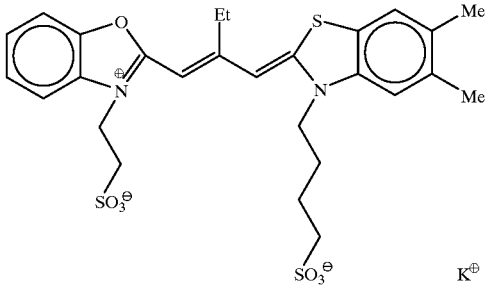

$3.2\times10^{-5}$ mol per mole of silver for emulsion II-1-A

Compound I

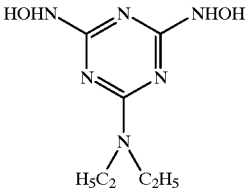

Next, a dispersion of zinc hydroxide for use as a base precursor was prepared.

31 g of a zinc hydroxide powder with a primary grain size of 0.2 micrometers was mixed with dispersion agents; namely, 1.6 g of carboxymethylcellulose, 0.4 g of sodium polyacrylate, 8.5 g of lime-treated ossein gelatin, and 158.5 ml of water. This mixture was dispersed over a period of one hour by a mill employing glass beads. After the dispersion of the mixture, the glass beads were filtered, whereby 188 g of dispersion of zinc hydroxide was obtained.

Further, an emulsion dispersion of a magenta coupler was prepared.

7.80 g of a magenta coupler (a), 5.45 g of a developing agent (b), 2 mg of an anti-fogging agent (c), 8.21 g of a high-boiling-point organic solvent (d), and 24.0 ml of ethyl acetate were dissolved at 60° C. The thus-dissolved solution was mixed with 150 g of aqueous solution into which 12.0 g of lime-treated gelatin and 0.6 g of sodium dodecylbenzene sulfonate were dissolved. The mixture was then emulsified and dispersed over a period of 20 minutes at 10,000 r.p.m. through use of a dissolver. Distilled water was added to the mixture so that the total volume of the mixture became 300 g, and the mixture was further mixed over a period of ten minutes at 2,000 r.p.m.

The thus-prepared dispersions and the previously-prepared silver halide emulsions were applied in combination to a support so as to yield a composition provided in Table 12, so that four kinds of heat-developable color light-sensitive materials of samples II-1 through II-4 were prepared. Also, processing materials II-P-1 and II-P-2 as shown in Tables 13, 14, and 15 were prepared.

TABLE 12

(Unit: mg/m$^2$)

| | | Samples | | | |
|---|---|---|---|---|---|
| | | II-1 | II-2 | II-3 | II-4 |
| Protective layer | Lime-treated gelatin | 1000 | 1000 | 1000 | 1000 |
| | Matting agent (silica) | 50 | 50 | 50 | 50 |
| | Surfactant (f) | 100 | 100 | 100 | 100 |
| | Surfactant (g) | 300 | 300 | 300 | 300 |
| | Water-soluble polymer (h) | 15 | 15 | 15 | 15 |
| | Hardener (i) | 35 | 35 | 35 | 35 |
| Intermediate layer | Lime-treated | 375 | 375 | 375 | 375 |
| | Surfactant (g) | 15 | 15 | 15 | 15 |
| | Zinc hydroxide | 1100 | 1100 | 1100 | 1100 |
| | Water-soluble polymer (h) | 15 | 15 | 15 | 15 |
| Magenta dye forming layer | Lime-treated gelatin | 2000 | 2000 | 2000 | 2000 |
| | Emulsion (based on the amount of coated silver) | II-1-Ag | II-1-Bg | II-1-Cg | II-1-Dg |
| | | 1726 | 1726 | 1726 | 1726 |
| | Magenta coupler (a) | 637 | 637 | 637 | 637 |
| | Developing agent (b) | 444 | 444 | 444 | 444 |
| | Anti-fogging agent (c) | 0.20 | 0.20 | 0.20 | 0.20 |
| | High-b.p.-organic solvent (d) | 670 | 670 | 670 | 670 |
| | Surfactant (e) | 33 | 33 | 33 | 33 |
| | Water-soluble polymer (h) | 14 | 14 | 14 | 14 |
| Transparent PET base (120 μm) | | | | | |

Magenta coupler (a)

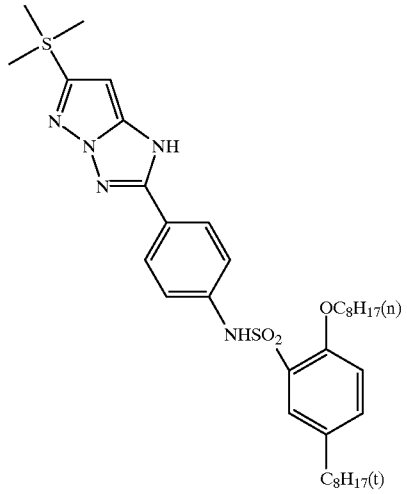

Developing agent (b)

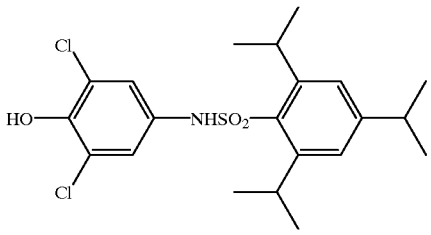

High-b.p.-organic solvent (d)

Anti-fogging agent (c)

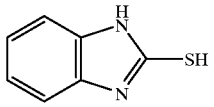

Surfactant (e)

TABLE 12-continued (Unit: mg/m$^2$)

| | Samples | | | |
|---|---|---|---|---|
| | II-1 | II-2 | II-3 | II-4 |

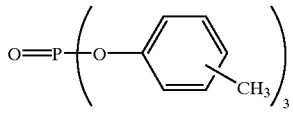

Surfactant (f)

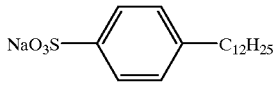

Surfactant (g)

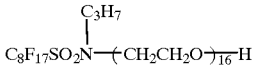

Water-soluble polymer (h)

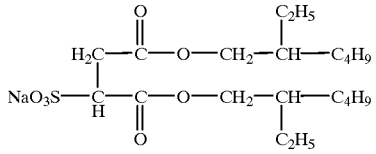

Hardener (i)

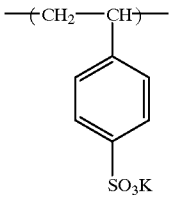

TABLE 13

Structure of Processing Material II-P-1

| Structure of layers | Materials incorporated | Amounts (mg/m$^2$) |
|---|---|---|
| The 4th layer: Protective layer | Acid-treated gelatin | 220 |
| | Water-soluble polymer (j) | 60 |
| | Water-soluble polymer (k) | 200 |
| | Additive (l) | 80 |
| | Palladium sulfate | 3 |
| | Potassium nitride | 12 |
| | Matting agent (m) | 10 |
| | Surfactant (g) | 7 |
| | Surfactant (n) | 7 |
| | Surfactant (o) | 10 |
| The 3rd layer: Intermediate layer | Lime-treated gelatin | 240 |
| | Water-soluble polymer (k) | 24 |
| | Hardener (p) | 180 |
| | Surfactant (e) | 9 |
| The 2nd layer: Base-generating layer | Lime-treated gelatin | 2400 |
| | Water-soluble polymer (k) | 360 |
| | Water-soluble polymer (q) | 700 |
| | Water-soluble polymer (r) | 600 |
| | High b.p. solvent (s) | 2000 |
| | Additive (t) | 20 |
| | Potassium hydantoin | 260 |
| | Guanidine picolate | 2910 |
| | Potassium quinolate | 225 |
| | Sodium quinolate | 180 |
| | Surfactant (e) | 24 |
| The 1st layer: Undercoat layer | Lime-treated gelatin | 280 |
| | Water-soluble polymer (j) | 12 |
| | Surfactant (g) | 14 |
| | Hardener (p) | 185 |
| Transparent support A (63 μm) | | |

TABLE 14

Structure of Processing Material II-P-2

| Structure of layers | Materials incorporated | Amounts (mg/m$^2$) |
|---|---|---|
| The 4th layer: Protective layer | Acid-treated gelatin | 220 |
| | Water-soluble polymer (j) | 60 |
| | Water-soluble polymer (k) | 200 |
| | Potassium nitride | 12 |
| | Matting agent (m) | 10 |
| | Surfactant (g) | 7 |
| | Surfactant (n) | 7 |
| | Surfactant (o) | 10 |
| The 3rd layer: Intermediate layer | Lime-treated gelatin | 240 |
| | Water-soluble polymer (k) | 24 |
| | Hardener (p) | 180 |
| | Surfactant (e) | 9 |
| The 2nd layer: Fixing layer | Lime-treated gelatin | 2400 |
| | Water-soluble polymer (k) | 120 |
| | Water-soluble polymer (q) | 700 |
| | Water-soluble polymer (r) | 600 |
| | High b.p. solvent (s) | 2000 |
| | Additive A | 1270 |
| | Additive B | 683 |
| | Surfactant (e) | 20 |
| The 1st layer: Undercoat layer | Gelatin | 280 |
| | Water-soluble polymer (j) | 12 |
| | Surfactant (g) | 14 |
| | Hardener (p) | 185 |
| Transparent support A (63 μm) | | |

TABLE 15

| Layers | Structure of Support II-A<br>Composition | Weight (mg/m$^2$) |
|---|---|---|
| Upper surface undercoat layer | Gelatin | 100 |
| Polymer layer | Polyethylene terephthalate | 62500 |
| Backface undercoat layer | Methyl methacrylate-styrene-2-ethylhexylacrylate-methacrylic acid copolymer | 1000 |
| | PMMA latex (av particle size: 12 $\mu$m) | 120 |
| | | 63720 |

Water-soluble polymer (j) κ-carrageenan
Water-soluble polymer (k) Sumikagel L-5H (by Sumitomo Chemical)
Additive (1) Matting agent (m) SYLOID 79 (by Fuji Davison)

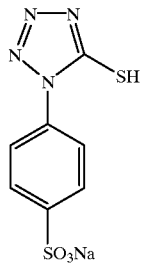

Surfactant (n)

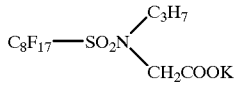

Surfactant (o)

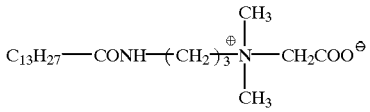

Hardener (p)

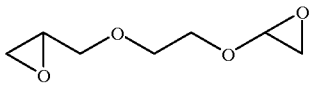

Water-soluble polymer (q)
Dextran (M.W. = 70,000)

Water-soluble polymer (r)
MP polymer MP 102 (by Kuraray)
High-b.p. solvent (s) Enpara 40 (by Ajinomoto)

Additive (t)

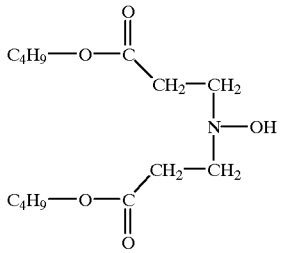

Additive A

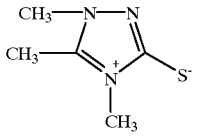

Additive B

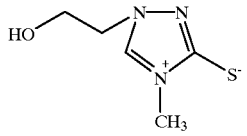

These light-sensitive materials were exposed to light at 1000 lux over a period of 1/100 second through an optical wedge and a green filter.

Water at a temperature of 40° C. was applied at 15 ml/m$^2$ to the surface of an exposed light-sensitive material. The light-sensitive material was brought into face-to-face contact with the processing material II-P-1. The thus-superposed film was subjected to heat development for 15 seconds at 83° C. through use of a heating drum. The amount of dampening water fell within a range employed by the present invention, which is equivalent to approximately 30% of a total amount of water consumed for swelling the film with water in a saturated fashion. The light-sensitive material was peeled from the processing material after the development, so that a magenta-colored wedge-shaped image was obtained.

This sample was further subjected to treatment in the second step through use of the processing material II-P-2. In this second process, 10 cc/m$^2$ of water was applied to the processing material II-P-2, and this material was bonded to the light-sensitive material which had finished undergoing the first treatment. The sheet was heated at 60° C. for 30 seconds.

Transmission density of color-developed samples of this sheet was measured, whereby so-called characteristic curves were obtained. The relative sensitivity was determined by the reciprocal of the amount of exposure corresponding to a density 0.15 higher than the fog density. Sensitivity was represented with reference to the value of sample II-1, which was taken as 100.

To examine the granularity of the samples, the samples were exposed such that the magenta color density became 1.0. Color-developed pieces were prepared by carrying out the same heat development. The RMS granularity of the color-developed pieces was measured at an aperture having a diameter of 48 micrometers through use of a diffused light source.

The samples were tested with regard to mar resistance according to the following test method.

Before exposure, the samples were placed in an atmosphere of a 55% RH over a period of more than three hours, and then a load of 4 g was exerted on the samples in the same atmosphere through use of a wire having a size (diameter) of 0.1 mm. The surface of the emulsion layer of each of the samples was scratched by the wire at a speed of 1 cm/sec. Subsequently, the samples were subjected to the above-described exposure, followed by development.

The densities of loaded and unloaded areas of the developed samples were measured through a measurement slit measuring 5 microns×10 mm.

An increment in a fog due to a pressure is taken as ΔFog. Within the area of exposure which is 100 times as large as exposure EO producing the fog density plus 0.15, a pressure-reduction-sensitive region is represented for evaluation by ((logE2−logE1)/2)×100 (%) when there is a pressure-induced reduction in density more than 0.01 in the range of exposure E1 to exposure E2.

In order to compare the heat-developed samples with those developed by conventional solution development, samples were exposed to light in a manner similar to that described above and developed at 38° C. for 185 seconds through use of a color negative film processor CN-16 manufactured by Fuji Photo Film Co., Ltd. The RMS granularity and mar resistance of the color-developed samples were measured in the same way as described above.

The results are shown in Table 16.

TABLE 16

| | | | | Dampening water + heat development | | | | CN-16 Treatment | | | |
|---|---|---|---|---|---|---|---|---|---|---|---|
| Sample No. | Emulsion | Mean grain thickness (μm) | Av. equiv. circle diameter (μm) | Sensitivity | RMS | Mar Δfog | resistance Press. reduction sensitive area | Sensitivity | RMS | Mar Δfog | resistance Press. reduction sensitive area |
| II-1 | II-1-A | 0.144 | 1.13 | 100 | 0.011 | 0.13 | 8% | 102 | 0.20 | 0.15 | 15% |
| II-2 | II-1-B | 0.082 | 1.50 | 107 | 0.014 | 0.14 | 10% | 107 | 0.018 | 0.17 | 20% |
| II-3 | II-1-C | 0.068 | 1.64 | 132 | 0.011 | 0.15 | 12% | 115 | 0.016 | 0.25 | 31% |
| II-4 | II-1-D | 0.060 | 1.75 | 162 | 0.010 | 0.15 | 12% | 123 | 0.016 | 0.25 | 40% |

Bold: Present invention

As will be known from the test results, the use of emulsions of the present invention provides high sensitivity. Also, the image forming method of the present invention significantly improves mar resistance, which tends to impair as the average grain thickness decreases in a conventional process which employs CN-16.

EXAMPLE 6

The following emulsions were prepared which were made different in average equivalent circle diameter and aspect ratio from the emulsion II-1-A of Example 5 by changing reaction temperature, an adding rate of a reaction solution, and the amount of potassium bromide added.

| | | Average equivalent circle dia. | Average aspect ratio |
|---|---|---|---|
| Emulsion | II-2-A | 0.66 μ | 5.4 |
| | II-3-A | 0.37 μ | 3.8 |

Blue-sensitive emulsions (represented by the affix "b") and red-sensitive emulsions (represented by the affix "r") were prepared by changing spectral sensitizing dyes used for spectral sensitization of sliver halide emulsions prepared in Example 5 as well as above to those shown below.

Sensitizing dye II-IV for blue-sensitive emulsion

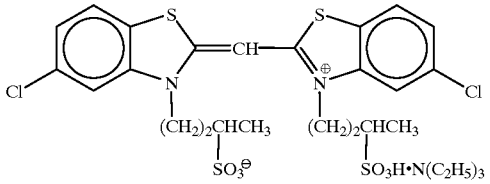

$6.0\times10^{-4}$ mol per mole of silver for emulsion II-1-A

Sensitizing dye II-V for red-sensitive emulsion

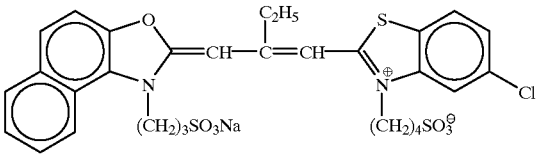

$3.5\times10^{-4}$ mol per mole of silver for emulsion II-1-A

Sensitizing dye II-VI for red-sensitive emulsion

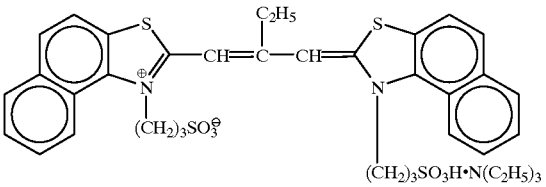

$1.6\times10^{-5}$ mol per mole of silver for emulsion II-1-A

Sensitizing dye II-VII for red-sensitive emulsion

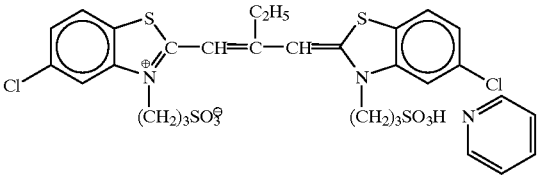

$5.1\times10^{-4}$ mol per mole of silver for emulsion II-1-A

Further, dispersions of cyan and yellow couplers were prepared according to the method of preparing dispersions of the coupler of Example 5. Compounds used in the preparation are shown hereunder.

For the purposes of forming coloring layers which can be decolored at the time of heat development, dispersions of coloring agents by combination of leuco dyes and zinc complex regarding yellow, magenta, and cyan were also prepared.

Multilayer heat-developable color light-sensitive materials provided in Table 17 were prepared through use of the thus-obtained silver halide emulsions, dispersions of the couplers, and dispersions of the coloring agents.

TABLE 17

(Unit: mg/m$^2$)

| | | Samples | | | |
|---|---|---|---|---|---|
| | | II-201 | II-202 | II-203 | II-204 |
| Protective layer | Lime-treated gelatin | 1000 | 1000 | 1000 | 1000 |
| | Matting agent (silica) | 50 | 50 | 50 | 50 |
| | Surfactant (f) | 100 | 100 | 100 | 100 |
| | Surfactant (g) | 300 | 300 | 300 | 300 |
| | Water-soluble polymer (h) | 15 | 15 | 15 | 15 |
| | Hardener (1) | 91 | 91 | 91 | 91 |
| Intermediate layer | Lime-treated gelatin | 375 | 375 | 375 | 375 |
| | Surfactant (g) | 15 | 15 | 15 | 15 |
| | Zinc hydroxide | 1100 | 1100 | 1100 | 1100 |
| | Water-soluble polymer (h) | 15 | 15 | 15 | 15 |
| Yellow dye forming layer | Lime-treated gelatin | 150 | 150 | 150 | 150 |
| | Emulsion (based on the amount of coated silver) | 647 (Emulsion II-1-Ab) | 647 (Emulsion II-1-Bb) | 647 (Emulsion II-1-Cb) | 647 (Emulsion II-1-Db) |
| | Yellow coupler (u) | 57 | 57 | 57 | 57 |
| | Developing agent (v) | 41 | 41 | 41 | 41 |
| | Anti-fogging agent (w) | 4 | 4 | 4 | 4 |
| | High-b.p.-organic solvent (d) | 50 | 50 | 50 | 50 |
| | Surfactant (e) | 3 | 3 | 3 | 3 |
| | Water-soluble polymer (h) | 1 | 1 | 1 | 1 |
| Yellow dye forming layer | Lime-treated gelatin | 220 | 220 | 220 | 220 |
| | Emulsion (based on the amount of coated silver) | 475 (Emulsion II-2-Ab) | 475 (Emulsion II-2-Ab) | 475 (Emulsion II-2-Ab) | 475 (Emulsion II-2-Ab) |
| | Yellow coupler (u) | 84 | 84 | 84 | 84 |
| | Developing agent (v) | 60 | 60 | 60 | 60 |
| | Anti-fogging agent (w) | 6 | 6 | 6 | 6 |
| | High-b.p.-organic solvent (d) | 74 | 74 | 74 | 74 |
| | Surfactant (e) | 4 | 4 | 4 | 4 |

TABLE 17-continued (Unit: mg/m²)

| | | Samples | | | |
|---|---|---|---|---|---|
| | | II-201 | II-202 | II-203 | II-204 |
| | Water-soluble polymer (h) | 2 | 2 | 2 | 2 |
| Yellow dye forming layer | Lime-treated gelatin | 1400 | 1400 | 1400 | 1400 |
| | Emulsion (based on the the amount of coated silver) | 604 (Emulsion II-3-Ab) | 604 (Emulsion II-3-Ab) | 604 (Emulsion II-3-Ab) | 604 (Emulsion II-3-Ab) |
| | Yellow coupler (u) | 532 | 532 | 532 | 532 |
| | Developing agent (v) | 382 | 382 | 382 | 382 |
| | Anti-fogging agent (w) | 40 | 40 | 40 | 40 |
| | High-b.p.-organic solvent (d) | 469 | 469 | 469 | 469 |
| | Surfactant (e) | 23 | 23 | 23 | 23 |
| | Water-soluble polymer (h) | 10 | 10 | 10 | 10 |
| Intermediate layer | Lime-treated gelatin | 750 | 750 | 750 | 750 |
| | Surfactant (e) | 15 | 15 | 15 | 15 |
| | Leuco dye (x) | 303 | 303 | 303 | 303 |
| | Developer (y) | 433 | 433 | 433 | 433 |
| | Water-soluble polymer (h) | 15 | 15 | 15 | 15 |
| Magenta dye forming layer | Lime-treated gelatin | 150 | 150 | 150 | 150 |
| | Emulsion (based on the amount of coated silver) | 647 (Emulsion II-1-Ag) | 647 (Emulsion II-1-Bg) | 647 (Emulsion II-1-Cg) | 647 (Emulsion II-1-Dg) |
| | Magenta coupler (a) | 48 | 48 | 48 | 48 |
| | Developing agent (b) | 33 | 33 | 33 | 33 |
| | Anti-fogging agent (c) | 0.02 | 0.02 | 0.02 | 0.02 |
| | High-b.p.-organic solvent (d) | 50 | 50 | 50 | 50 |
| | Surfactant (e) | 3 | 3 | 3 | 3 |
| | Water-soluble polymer (h) | 1 | 1 | 1 | 1 |
| Magenta dye forming layer | Lime-treated gelatin | 220 | 220 | 220 | 220 |
| | Emulsion | 475 (II-2-Ag) | 475 (II-2-Ag) | 475 (II-2-Ag) | 475 (II-2-Ag) |
| | Magenta coupler (a) | 70 | 70 | 70 | 70 |
| | Developing agent (b) | 49 | 49 | 49 | 49 |
| | Anti-fogging agent (c) | 0.02 | 0.02 | 0.02 | 0.02 |
| | High-b.p.-organic solvent (d) | 74 | 74 | 74 | 74 |
| | Surfactant (e) | 4 | 4 | 4 | 4 |
| | Water-soluble polymer (h) | 2 | 2 | 2 | 2 |
| Magenta dye forming layer | Lime-treated gelatin | 1400 | 1400 | 1400 | 1400 |
| | Emulsion | 604 (Emulsion II-3-Ag) | 604 (Emulsion II-3-Ag) | 604 (Emulsion II-3-Ag) | 604 (Emulsion II-3-Ag) |
| | Magenta coupler (a) | 446 | 446 | 446 | 446 |
| | Developing agent (b) | 311 | 311 | 311 | 311 |
| | Anti-fogging agent (c) | 0.14 | 0.14 | 0.14 | 0.14 |
| | High-b.p.-organic solvent (d) | 469 | 469 | 469 | 469 |
| | Surfactant (e) | 23 | 23 | 23 | 23 |
| | Water-soluble polymer (h) | 10 | 10 | 10 | 10 |
| Intermediate layer | Lime-treated gelatin | 900 | 900 | 900 | 900 |
| | Surfactant (e) | 15 | 15 | 15 | 15 |
| | Leuco dye (z) | 345 | 345 | 345 | 345 |
| | Developer (y) | 636 | 636 | 636 | 636 |
| | Zinc hydroxide | 1100 | 1100 | 1100 | 1100 |
| | Water-soluble polymer (h) | 15 | 15 | 15 | 15 |
| Cyan dye forming layer | Lime-treated gelatin | 150 | 150 | 150 | 150 |
| | Emulsion | 647 (Emulsion II-1-Ar) | 647 (Emulsion II-1-Br) | 647 (Emulsion II-1-Cr) | 647 (Emulsion II-1-Dr) |
| | Cyan coupler (aa) | 65 | 65 | 65 | 65 |
| | Developing agent (b) | 33 | 33 | 33 | 33 |
| | Anti-fogging agent (c) | 0.03 | 0.03 | 0.03 | 0.03 |
| | High-b.p.-organic solvent (d) | 50 | 50 | 50 | 50 |
| | Surfactant (e) | 3 | 3 | 3 | 3 |
| | Water-soluble polymer (h) | 1 | 1 | 1 | 1 |
| Cyan dye forming layer | Lime-treated gelatin | 220 | 220 | 220 | 220 |
| | Emulsion | 475 (Emulsion II-2-Ar) | 475 (Emulsion II-2-Ar) | 475 (Emulsion II-2-Ar) | 475 (Emulsion II-2-Ar) |
| | Cyan coupler (aa) | 96 | 96 | 96 | 96 |
| | Developing agent (b) | 49 | 49 | 49 | 49 |
| | Anti-fogging agent (c) | 0.05 | 0.05 | 0.05 | 0.05 |
| | High-b.p.-organic solvent (d) | 74 | 74 | 74 | 74 |
| | Surfactant (e) | 4 | 4 | 4 | 4 |
| | Water-soluble polymer (h) | 2 | 2 | 2 | 2 |
| Cyan dye forming layer | Lime-treated gelatin | 1400 | 1400 | 1400 | 1400 |
| | Emulsion | 604 (Emulsion | 604 (Emulsion | 604 (Emulsion | 604 (Emulsion |

TABLE 17-continued (Unit: mg/m$^2$)

| | | Samples | | | |
|---|---|---|---|---|---|
| | | II-201 | II-202 | II-203 | II-204 |
| | | II-3-Ar) | II-3-Ar) | II-3-Ar) | II-3-Ar) |
| | Cyan coupler (aa) | 610 | 610 | 610 | 610 |
| | Developing agent (b) | 311 | 311 | 311 | 311 |
| | Anti-fogging agent (c) | 0.32 | 0.32 | 0.32 | 0.32 |
| | High-b.p.-organic solvent (d) | 469 | 469 | 469 | 469 |
| | Surfactant (e) | 23 | 23 | 23 | 23 |
| | Water-soluble polymer (h) | 10 | 10 | 10 | 10 |
| Antihalation layer | Lime-treated gelatin | 750 | 750 | 750 | 750 |
| | Surfactant (e) | 15 | 15 | 15 | 15 |
| | Leuco dye (ab) | 243 | 243 | 243 | 243 |
| | Developer (y) | 425 | 425 | 425 | 425 |
| | Water-soluble polymer (h) | 15 | 15 | 15 | 15 |
| Transparent PET base (120 $\mu$m) | | | | | |

Yellow coupler (u)

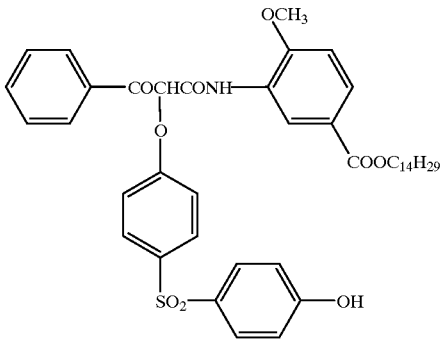

Developing agent (v)

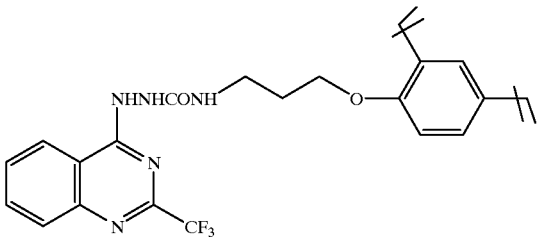

Anti-fogging agent (w)

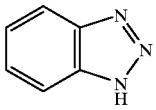

Cyan coupler (aa)

TABLE 17-continued
(Unit: mg/m$^2$)
| | Samples | | | |
|---|---|---|---|---|
| | II-201 | II-202 | II-203 | II-204 |
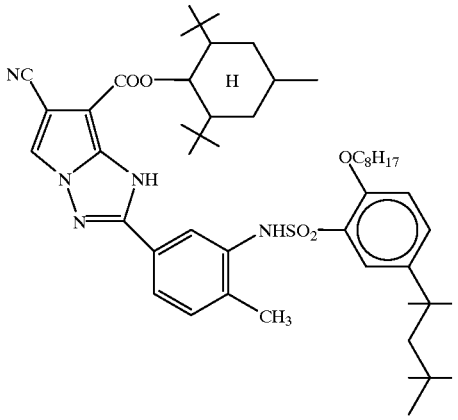
Leuco dye (ab)
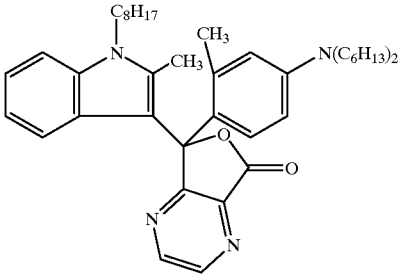
Yellow-developing leuco dye (x)
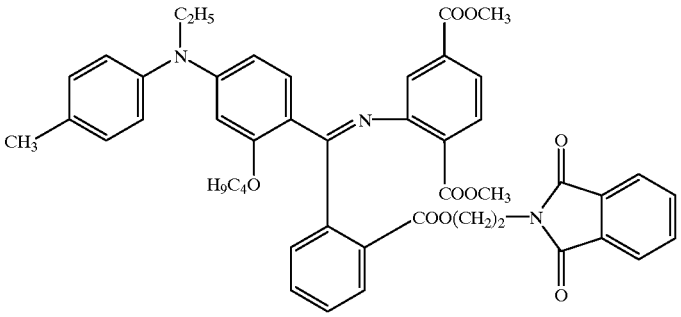
Developer (y)
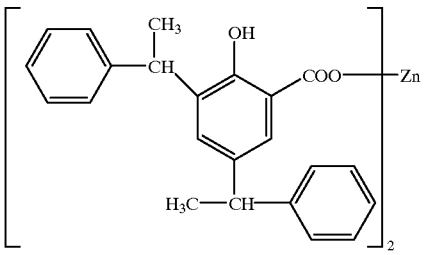
Magenta-developing leuco dye (z)

TABLE 17-continued

| | Samples | | | |
|---|---|---|---|---|
| | II-201 | II-202 | II-203 | II-204 |

(Unit: mg/m$^2$)

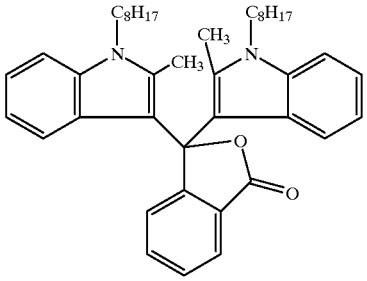

The photographic characteristics of these light-sensitive materials were tested as in Example 5. First, the light-sensitive materials were exposed to light at 1000 lux over a period of 1/100 second through an optical wedge and each of blue, green, and red filters.

Water at a temperature of 40° C. was applied at 15 ml/m$^2$ to the surface of the exposed light-sensitive materials. The light-sensitive materials were brought into face-to-face contact with the processing material used in Example 5. The thus-superposed film was subjected to heat development for 15 seconds at 83° C. through use of the heating drum. The light-sensitive materials were peeled from the processing material after the development. An yellow-colored wedge-shaped image was obtained for the sample exposed through the blue filter, a magenta-colored wedge-shaped image was obtained for the sample exposed through the green filter, and a cyan-colored wedge-shaped image was obtained for the sample exposed through the red filter. The transmission densities of these color-developed samples were measured, whereby characteristic curves were obtained. Sensitivity was represented with reference to the blue sensitivity, green sensitivity, and red sensitivity of sample II-201, which was taken as 100.

To examine the granularity of the samples, the samples were exposed such that the yellow, magenta, and cyan color densities became 1.0. Color-developed pieces were prepared by carrying out the same heat development. The RMS granularity of the color-developed pieces was measured at an aperture having a diameter of 48 micrometers through use of the diffused light source.

The samples were tested with regard to mar resistance according to the following test method.

Before exposure, the samples were placed in an atmosphere of a 55% RH over a period of more than three hours, and then a load of 4 g was exerted on the samples in the same atmosphere through use of a wire having a size (diameter) of 0.1 mm. The surface of the emulsion layer of each of the samples was scratched by the wire at a speed of 1 cm/sec. Subsequently, the samples were subjected to the above-described exposure, followed by development.

The densities of loaded and unloaded areas of the developed samples were measured through a measurement slit measuring 5 microns×10 mm.

An increment in a fog due to a pressure is taken as ΔFog. Within the area of exposure which is 100 times as large as exposure EO producing the fog density plus 0.15, a pressure-reduction-sensitive region is represented for evaluation by (logE2−logE1)/2)×100 (%) when there is a pressure-induced reduction in density more than 0.01 in the range of exposure E1 to exposure E2.

In order to compare the heat-developed samples with those developed by conventional solution development, samples were exposed to light in a manner similar to that described above and developed at 38° C. for 185 seconds through use of a color negative film processor CN-16. The RMS granularity and mar resistance of the color-developed samples were measured in the same way as described above.

The results are shown in Table 18.

TABLE 18-1

| | | II-201 II-1-A | | | II-202 II-1-B | | |
|---|---|---|---|---|---|---|---|
| Emulsion | | B | G | R | B | G | R |
| Sensitivity | Dampening | 100 | 100 | 100 | 107 | 108 | 108 |
| RMS | water + | 0.013 | 0.014 | 0.016 | 0.014 | 0.014 | 0.015 |
| Δfog | heat | 0.15 | 0.14 | 0.13 | 0.15 | 0.15 | 0.15 |
| Press reduction sensitive area (%) | development | 10 | 9 | 9 | 11 | 11 | 10 |
| Sensitivity | CN-16 | 102 | 103 | 103 | 107 | 107 | 105 |
| RMS | Treatment | 0.030 | 0.033 | 0.034 | 0.027 | 0.028 | 0.030 |
| Δfog | | 0.16 | 0.16 | 0.15 | 0.20 | 0.18 | 0.17 |
| Press reduction sensitive area (%) | | 18 | 17 | 15 | 25 | 23 | 22 |

TABLE 18-2

| Emulsion | | II-203 II-1-C B | G | R | II-204 II-1-D B | G | R |
|---|---|---|---|---|---|---|---|
| Sensitivity | Dampening | 135 | 135 | 136 | 165 | 163 | 164 |
| RMS | water + | 0.010 | 0.011 | 0.012 | 0.010 | 0.010 | 0.010 |
| Δfog | heat | 0.15 | 0.13 | 0.13 | 0.17 | 0.16 | 0.15 |
| Press reduction sensitive area (%) | development | 12 | 11 | 10 | 13 | 12 | 11 |
| Sensitivity | CN-16 | 115 | 113 | 114 | 123 | 125 | 124 |
| RMS | Treatment | 0.025 | 0.024 | 0.027 | 0.022 | 0.023 | 0.025 |
| Δfog | | 0.28 | 0.27 | 0.25 | 0.30 | 0.29 | 0.26 |
| Press reduction sensitive area (%) | | 34 | 33 | 31 | 45 | 43 | 40 |

The test results show that the use of emulsions of the present invention provides high sensitivity even for a multilayer system. Also, the image forming method of the present invention significantly improves mar resistance, which tends to impair as the average grain thickness decreases in a conventional process which employs CN-16.

EXAMPLE 7

Benzotriazole silver emulsion (organic silver salt) Gelatin (28 g) and benzotriazole (13.2 g) were dissolved in water (300 ml). The resulting solution was stirred with the temperature of the solution being maintained at 40° C. To the solution, silver nitrate (17 g) in water (100 mol) was added over a period of 2 minutes. The resulting benzotriazole silver emulsion was adjusted in pH and subjected to sedimentation to thereby remove excess salt. Subsequently, the pH of the benzotriazole silver emulsion was adjusted to 6.30, yielding 400 g of benzotriazole silver emulsion.

<Preparation of emulsion dispersions of couplers>

An oil-phase component and a water-phase component having compositions as shown in Table 19 were dissolved to respective homogeneous solutions having a temperature of 60° C. The resulting solutions of the oil-phase and water-phase components were subjected in combination to dispersion within a 1-liter stainless steel container at 10,000 rpm for 20 minutes through use of a dissolver equipped with a disperser having a 5 cm diameter. Subsequently, warm water was added thereto in an amount shown in Table 19, followed by mixing at 2,000 rpm for 10 minutes. Thus, emulsion dispersions of couplers with respect to cyan, magenta, and yellow were prepared.

TABLE 19

| | | Cyan | Magenta | Yellow |
|---|---|---|---|---|
| Oil phase | Cyan coupler (1) | 2.30 g | — | — |
| | Magenta coupler (2) | — | 3.07 g | — |
| | Yellow coupler (3) | — | — | 2.05 g |
| | Developing agent (4) | 1.78 g | 1.78 g | 1.78 g |
| | Anti-fogging agent (5) | 0.08 g | 0.08 g | 0.08 g |
| | High b.p. solvent (6) | 4.08 g | 4.85 g | 3.83 g |
| | Ethyl acetate | 24 ml | 24 ml | 24 ml |
| Aqueous phase | Lime-treated gelatin | 5.0 g | 5.0 g | 5.0 g |
| | Surfactant (7) | 0.40 g | 0.40 g | 0.40 g |
| | Water | 75.0 ml | 75.0 ml | 75.0 ml |
| | Subsequent addition of water | 60.0 ml | 60.0 ml | 60.0 ml |

Cyan coupler (1)

TABLE 19-continued

| | Cyan | Magenta | Yellow |
|---|---|---|---|

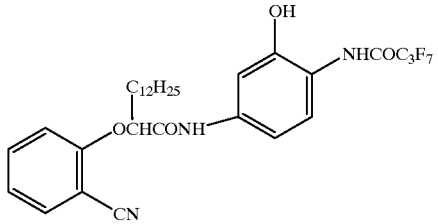

Magenta coupler (2)

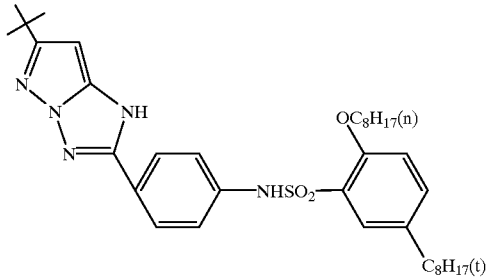

Yellow coupler (3)

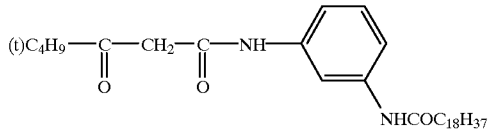

Developing agent (4)

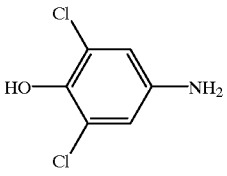

Anti-fogging agent (5)

TABLE 19-continued

| | Cyan | Magenta | Yellow |
|---|---|---|---|
| 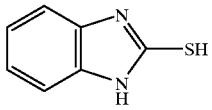 | | | |
| High-b.p. solvent (6) | | | |
| 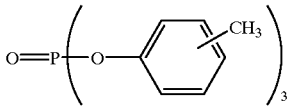 | | | |
| Surfactant (7) | | | |

TABLE 19-continued

| | Cyan | Magenta | Yellow |
|---|---|---|---|
| 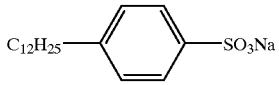 | | | |

Multilayer heat-developable color light-sensitive materials II-301 through II-304 shown in Table 20 were prepared through use of the thus-obtained materials and silver halides prepared in Examples 5 and 6.

TABLE 20

| Structure of layers | Materials incorporated | Samples II-301 | II-302 | II-303 | II-304 |
|---|---|---|---|---|---|
| The 6th layer: Protective layer | Lime-treated gelatin | 1940 | 1940 | 1940 | 1940 |
| | Matting agent (silica) | 200 | 200 | 200 | 200 |
| | Surfactant (8) | 50 | 50 | 50 | 50 |
| | Surfactant (9) | 300 | 300 | 300 | 300 |
| | Basic precursor (10) | 1400 | 1400 | 1400 | 1400 |
| | Water-soluble polymer (11) | 120 | 120 | 120 | 120 |
| The 5th layer: Yellow dye forming layer | Lime-treated gelatin | 2000 | 2000 | 2000 | 2000 |
| | Blue-sensitive silver halide emulsion (based on silver) | 1250 (II-1-Ab) | 1250 (II-1-Bb) | 1250 (II-1-Cb) | 1250 (II-1-Db) |
| | Benztriazole silver emulsion (based on silver) | 300 | 300 | 300 | 300 |
| | Yellow coupler (3) | 414 | 414 | 414 | 414 |
| | Developing agent (4) | 360 | 360 | 360 | 360 |
| | Anti-fogging agent (5) | 16 | 16 | 16 | 16 |
| | High b.p. solvent (6) | 774 | 774 | 774 | 774 |
| | Surfactant (7) | 80 | 80 | 80 | 80 |
| | Heat solvent (12) | 1400 | 1400 | 1400 | 1400 |
| | Surfactant (9) | 70 | 70 | 70 | 70 |
| | Water-soluble polymer (11) | 40 | 40 | 40 | 40 |
| The 4th layer: Intermediate layer | Lime-treated gelatin | 970 | 970 | 970 | 970 |
| | Surfactant (8) | 50 | 50 | 50 | 50 |
| | Surfactant (9) | 300 | 300 | 300 | 300 |
| | Basic precursor (10) | 1400 | 1400 | 1400 | 1400 |
| | Water-soluble polymer (11) | 60 | 60 | 60 | 60 |
| The 3rd layer: Magenta dye forming layer | Lime-treated gelatin | 1000 | 1000 | 1000 | 1000 |
| | Green-sensitive silver halide emulsion (based on silver) | 625 (II-1-Ag) | 625 (II-1-Bg) | 625 (II-1-Cg) | 625 (II-1-Dg) |
| | Benztriazole silver emulsion (based on silver) | 150 | 150 | 150 | 150 |
| | Magenta coupler (2) | 310 | 310 | 310 | 310 |
| | Developing agent (13) | 180 | 180 | 180 | 180 |
| | anti-fogging agent (5) | 8 | 8 | 8 | 8 |
| | High b.p. solvent (6) | 490 | 490 | 490 | 490 |
| | Surfactant (7) | 40 | 40 | 40 | 40 |
| | Heat solvent (12) | 700 | 700 | 700 | 700 |
| | Surfactant (9) | 35 | 35 | 35 | 35 |
| | Water-soluble polymer (11) | 20 | 20 | 20 | 20 |
| The 2nd layer: Intermediate layer | Lime-treated gelatin | 970 | 970 | 970 | 970 |
| | Surfactant (8) | 50 | 50 | 50 | 50 |
| | Surfactant (9) | 300 | 300 | 300 | 300 |
| | Basic precursor (10) | 1400 | 1400 | 1400 | 1400 |
| | Water-soluble polymer (11) | 60 | 60 | 60 | 60 |
| The 1st layer: Cyan dye forming layer | Lime-treated gelatin | 1000 | 1000 | 1000 | 1000 |
| | Red-sensitive silver halide emulsion (based on silver) | 625 (II-1-Ar) | 625 (II-1-Br) | 625 (II-1-Cr) | 625 (II-1-Dr) |
| | Benztriazole silver emulsion based on silver) | 150 | 150 | 150 | 150 |

TABLE 20-continued

| | | | | |
|---|---|---|---|---|
| Cyan coupler (3) | 230 | 230 | 230 | 230 |
| Developing agent (4) | 180 | 180 | 180 | 180 |
| Anti-fogging agent (5) | 8 | 8 | 8 | 8 |
| High b.p. solvent (6) | 410 | 410 | 410 | 410 |
| Surfactant (7) | 40 | 40 | 40 | 40 |
| Heat solvent (12) | 700 | 700 | 700 | 700 |
| Surfactant (9) | 35 | 35 | 35 | 35 |
| Water-soluble polymer (11) | 20 | 20 | 20 | 20 |
| Transparent PET base (102 μm) | | | | |

Surfactant (8)

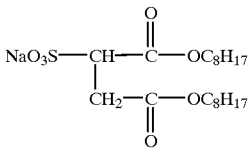

Surfactant (9)

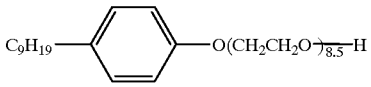

Base Precursor (10)

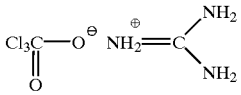

Water-soluble polymer (11)

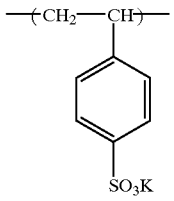

Heat solvent (12)
D-sorbitol

Developing agent (13)

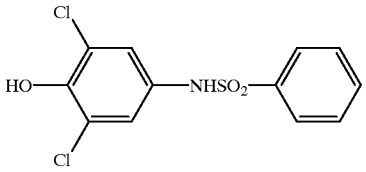

The samples were tested with regard to mar resistance according to the following test method.

Before exposure, the samples were placed in an atmosphere of a 55% RH over a period of more than three hours, and then a load of 4 g was exerted on the samples in the same atmosphere through use of a wire having a size (diameter) of 0.1 mm. The surface of the emulsion layer of each of the samples was scratched by the wire at a speed of 1 cm/sec. Subsequently, the samples were exposed to light at 1000 lux over a period of 1/100 second through an optical wedge and each of blue, green, and red filters. The exposed samples were heat developed for 10 seconds on a heating drum heated to 150° C. with the base side of the samples in contact with the drum.

The densities of loaded and unloaded areas of the developed samples were measured through a measurement slit measuring 5 microns×10 mm.

An increment in a fog due to a pressure is taken as ΔFog. Within the area of exposure which is 100 times as large as exposure EO producing the fog density plus 0.15, a pressure-reduction-sensitive region is represented for evaluation by ((logE2−logE1)/2)×100 (%) when there is a pressure-induced reduction in density more than 0.01 in the range of exposure E1 to exposure E2.

In order to compare the heat-developed samples with those developed by conventional solution development, samples were exposed to light in a manner similar to that described above and developed at 38° C. for 185 seconds through use of a color negative film processor CN-16. The RMS granularity and mar resistance of the color-developed samples were measured in the same way as described above.

The results, together with the mar resistance test results of Example 6, are shown in Table 21.

TABLE 21

| Emulsion Sample No. | | II-1-A II-201 | | | II-1-B II-202 | | |
|---|---|---|---|---|---|---|---|
| | Heat | B | G | R | B | G | R |
| Δfog | development | 0.15 | 0.14 | 0.13 | 0.15 | 0.15 | 0.15 |
| Press reduction | with | 10 | 9 | 9 | 11 | 11 | 10 |

TABLE 21-continued

| | | | | | | | |
|---|---|---|---|---|---|---|---|
| sensitive area (%) | dampening water | | | | | | |
| | | II-301 | | | II-302 | | |
| | Heat | B | G | R | B | G | R |
| Δfog | development | 0.18 | 0.17 | 0.15 | 0.20 | 0.19 | 0.08 |
| Press reduction sensitive area (%) | without dampening water | 20 | 19 | 18 | 30 | 25 | 23 |
| Emulsion Sample No. | | II-1-C II-203 | | | II-1-D II-204 | | |
| | Heat | B | G | R | B | G | R |
| Δfog | development | 0.15 | 0.13 | 0.13 | 0.17 | 0.16 | 0.15 |
| Press reduction sensitive area (%) | with dampening water | 12 | 11 | 10 | 13 | 12 | 11 |
| | | II-303 | | | II-304 | | |
| | Heat | B | G | R | B | G | R |
| Δfog | development | 0.30 | 0.28 | 0.25 | 0.45 | 0.35 | 0.30 |
| Press reduction sensitive area (%) | without dampening water | 40 | 35 | 33 | 50 | 46 | 43 |

Bold: the present invention

The results shown above and the mar resistance test results of Examples 5 and 6 show that the heat development process of the present invention which employs dampening water significantly improves mar resistance of a light-sensitive material.

EXAMPLE 8

An exposed light-sensitive material was heat developed in a manner similar to that of Example 5 except that water having a temperature of 40° C. was applied to the surface of the light-sensitive material in an amount equivalent to approximately 20% of a total amount of water consumed for swelling the material with water in a saturated fashion as well as in an amount equivalent to approximately 70%. In the case where water was applied in an amount equivalent to approximately 20% of the total water amount consumed for full swelling, an excellent image was formed as in the case where water was applied in an amount equivalent to approximately 30% of the total water amount consumed for full swelling. In the case where water was applied in an amount equivalent to approximately 70% of the total water amount consumed for full swelling, a minimum image density increased as compared with the case where water was applied in an amount equivalent to approximately 30% of the total water amount consumed for full swelling. Next, with the amount of water applied being changed to 5%, an exposed light-sensitive material was heat developed, but failed to be developed.

EXAMPLE 9

Distilled water (950 ml) which contained gelatin (average molecular weight 15000; 12.5 g), potassium bromide (4.35 g), and potassium iodide (0.32 g) was placed in a reaction container. The temperature of the container was then elevated to 45° C. To the resulting solution, an aqueous solution (50 ml) containing silver nitrate (8.3 g) and an aqueous solution (50 ml) containing potassium bromide (2.67 g) were added for 45 seconds while stirring intensively. To the resulting mixture, potassium iridate hexachloride (0.38 mg) was added. Then, the mixture was maintained at 45° C. for 4 minutes, and subsequently the temperature of the reaction solution was increased to 63° C. Gelatin (17.0 g), together with distilled water (130 ml), was added. Subsequently, an aqueous solution (150 ml) containing silver nitrate (51.2 g) and a 24.8% aqueous solution of potassium bromide were added over a period of 13 minutes with the flow rate being increased, so that the silver potential of the reaction solution became 0 mV with respect to a saturated calomel electrode. The resulting reaction solution was maintained at 63° C. for 2 minutes. Subsequently, the temperature of the reaction solution was lowered to 45° C. Next, an aqueous solution (50 ml) containing silver nitrate (5.9 g) and an aqueous solution (320 ml) containing potassium iodide (5.82 g) were added over a period of 5 minutes. Further, an aqueous solution (350 ml) containing silver nitrate (104.3 g) and a 25% aqueous solution of potassium bromide were added over a period of 45 minutes, so that the silver potential of the reaction solution became 90 mV with respect to a saturated calomel electrode. Subsequently, potassium bromide (1.4 g) and sodium ethylthiosulfonate (4 mg) were added. The resulting mixture was maintained at 45° C. for 5 minutes. Then, the temperature of the mixture was lowered and then demineralized in accordance with an established method.

The thus-obtained emulsion comprised hexagonal tabular grains having an average equivalent circle diameter of 0.42 μm and an average thickness of 0.19 μm. This emulsion was taken as emulsion III-A-1.

Next, distilled water (930 ml) which contains gelatin (average molecular weight 15000; 0.74 g) and potassium bromide (0.7 g) was placed in a reaction container. The temperature of the container was then increased to 40° C. To the resulting solution, an aqueous solution (30 ml) containing silver nitrate (1.2 g) and an aqueous solution (30 ml) containing potassium bromide (0.82 g) were added for 30 seconds while stirring intensively. Then, the mixture was maintained at40° C., for 1 minutes, and subsequently the temperature of the reaction solution was increased to 75° C. Gelatin (27.0 g), together with distilled water (200 ml), was added. Subsequently, an aqueous solution (100 ml) containing silver nitrate (22.5 g) and an aqueous solution (80 ml) containing potassium bromide (15.43 g) were added over a period of 11 minutes with the flow rate being increased. Then, an aqueous solution (250 ml) containing silver nitrate (75.1 g) and an aqueous solution (250 ml) containing potassium iodide and potassium nitrate at the mol ratio 3:97 (concentration of potassium bromide 26%) over a period of 20 minutes with the flow rate being increased, so that the silver potential of the reaction solution became 2 mV with respect to a saturated calomel electrode. Further, an aqueous solution (75 ml) containing silver nitrate (18.7 g) and a 21.9% aqueous solution of potassium bromide were added over a period of 3 minutes, so that the silver potential of the reaction solution became 0 mV with respect to a saturated calomel electrode. The resulting reaction solution was maintained at 75° C. for 1 minute. Subsequently, the temperature of the reaction solution was lowered to 55° C. Next, an aqueous solution (120 ml) containing silver nitrate (8.1 g) and an aqueous solution (320 ml) containing potassium iodide (7.26 g) were added over a period of 5 minutes. Subsequently, potassium bromide (5.5 g) and potassium iridate hexachloride (0.04 mg) were added. The resulting mixture was maintained at 55° C. for 1 minute. Further, an aqueous solution (180 ml) containing silver nitrate (44.3 g) and an aqueous solution (160 ml) containing potassium bromide (34.0 g) were added over a period of 8 minutes. Then, the temperature of the mixture was lowered and then demineralized in accordance with an established method.

The thus-obtained emulsion comprised hexagonal tabular grains having an average equivalent circle diameter of 0.90 μm and an average thickness of 0.24 μm. This emulsion was taken as emulsion III-B-1.

Preparation of tabular silver bromide emulsions III-C-1 through III-F-1

$H_2SO_4$ was added to an aqueous solution (1,000 cc) containing oxidized gelatin (0.5 g) and KBr (0.37 g) so as to bring the pH of the solution to 2. The resultant solution was stirred with the temperature of the solution being maintained at 40° C. An aqueous 0.3M $AgNO_3$ solution (55 cc) and an aqueous 0.3 M KBr solution (55 cc) were simultaneously added in double jets for 110 seconds. Subsequently, the pH was adjusted to 5.0 by the addition of NaOH. The temperature of the solution was elevated to 75° C. over 35 minutes. Oxidized gelatin (35 g) was added, and an aqueous 1.2 M $AgNO_3$ solution (512 cc) and an aqueous 1.4 M KBr solution (440 cc) were added over 33 minutes with the pAg being maintained at 7.72 and the flow rate being increased (the flow rate at the point of completion of addition was 5.2 times that at the start point).

Subsequently, the temperature of the mixture was lowered to 55° C. An aqueous 0.4 M $AgNO_3$ solution (104 cc) and an aqueous 0.12 M KI solution (279 cc) were added to the mixture at a constant flow rate over a period of five minutes, followed by addition of an aqueous KBr solution to thereby adjust the pAg to 8.8. Thereafter, an aqueous 1.8 M $AgNO_3$ solution (110 cc) and an aqueous 1.8 M KBr solution (125 cc) were added.

Subsequently, the resultant emulsion was cooled to 35° C. and washed by a customary flocculation method. The emulsion was mixed with gelatin (75 g) and was adjusted to pH=5.5 and pAg=8.2.

The obtained emulsion contained tabular grains that accounted for more than 99% of the total projected area of the entirety of the grains and that had an average equivalent circle diameter of 0.90 μm and an average thickness of 0.06 μm. This emulsion was taken as emulsion III-C-1.

Emulsions III-D-1 and III-E-1 as shown in Table 22 were prepared through the adjustment of the pAg. Further, emulsion III-F-1 was prepared as was the case with the emulsion III-C-1 with the exception of the following: (Modifications with emulsion III-F-1)

$H_2SO_4$ was added to an aqueous solution (1,000 cc) containing gelatin (0.5 g) and KBr (0.37 g) so as to bring the pH of the solution to 2. The resultant solution was stirred with the temperature of the solution being maintained at 40° C. An aqueous 0.3M $AgNO_3$ solution (110 cc) and an aqueous 0.3 M KBr solution (110 cc) were simultaneously added in double jets for 220 seconds.

TABLE 22

| Emulsion No. | III-A-1 | III-B-1 | III-C-1 | III-D-1 | III-E-1 | III-F-1 |
|---|---|---|---|---|---|---|
| Average equivalent circle diameter (μm) | 0.42 | 0.90 | 0.90 | 1.10 | 0.90 | 0.50 |
| Mean thickness (μm) | 0.19 | 0.24 | 0.06 | 0.05 | 0.15 | 0.06 |

Chemical Sensitization

The emulsions III-A-1 through III-F-1 were subjected to spectral and chemical sensitization by addition of spectral sensitizing dye, Compound I, potassium thiocyanate, chloroauric acid, and sodium thiosulfate at 60° C., pH=6.2, and pAg=8.4. At this time, the spectral sensitizing dye was changed in proportion to the surface area of grains of the respective emulsion, and the amount of chemical sensitizing agent was adjusted so as to maximize the sensitivity of the emulsion with respect to an exposure of 1/100 sec.

The thus-prepared green-sensitive emulsions were represented with the affix "g" like III-A-1g.

A dispersion of zinc hydroxide for use as a base precursor was prepared.

31 g of a zinc hydroxide powder with a primary grain size of 0.2 micrometers was mixed with dispersion agents; namely, 1.6 g of carboxymethylcellulose, 0.4 g of sodium polyacrylate, 8.5 g of lime-treated ossein gelatin, and 158.5 ml of water. This mixture was dispersed over a period of one hour by a mill employing glass beads. After the dispersion of the mixture, the glass beads were filtered, whereby 188 g of dispersion of zinc hydroxide was obtained.

Further, an emulsion dispersion of a magenta coupler was prepared.

7.80 g of a magenta coupler (a), 5.45 g of a developing agent (b) , 2 mg of an anti-fogging agent (c) 8.2 g of a high-boiling-point organic solvent (d), and 24.0 ml of ethyl acetate were dissolved at 60 ° C. The thus-dissolved solution was mixed with 150 g of aqueous solution into which 12. 0 g of lime-treated gelatin and 0. 6 g of sodium dodecylbenzene sulfonate were dissolved. The mixture was then emulsified and dispersed over a period of 20 minutes at 10, 000 r.p.m. through use of a dissolver. Distilled water was added to the mixture so that the total volume of the mixture became 300 g, and the mixture was further mixed over a period of ten minutes at 2, 000 r.p.m.

The thus-prepared dispersions and the previously-prepared silver halide emulsions were applied in combination to a support so as to yield a composition provided in Table 23, so that five kinds of heat-developable color light-sensitive materials of samples III-101 through III-105 were prepared.

Further, processing materials III-P-1 as shown in Tables 24 and 25 were prepared.

TABLE 23

(Unit: mg/m$^2$)

| | | Samples | | | | |
|---|---|---|---|---|---|---|
| | | III-101 | III-102 | III-103 | III-104 | III-105 |
| Protective layer | Lime-treated gelatin | 1000 | 1000 | 1000 | 1000 | 1000 |
| | Matting agent (silica) | 50 | 50 | 50 | 50 | 50 |
| | Surfactant (f) | 100 | 100 | 100 | 100 | 100 |
| | Surfactant (g) | 300 | 300 | 300 | 300 | 300 |
| | Water-soluble polymer (h) | 15 | 15 | 15 | 15 | 15 |
| | Hardener (i) | 35 | 35 | 35 | 35 | 35 |
| Intermediate layer | Lime-treated gelatin | 35 | 375 | 375 | 375 | 375 |
| | Surfactant (g) | 15 | 15 | 15 | 15 | 15 |
| | Zinc hydroxide | 1100 | 1100 | 1100 | 1100 | 1100 |
| | Water-soluble polymer (h) | 15 | 15 | 15 | 15 | 15 |
| Magenta dye forming layer | Lime-treated gelatin | 2000 | 2000 | 2000 | 2000 | 2000 |
| | Emulsion (based on the amount of coated silver) | III-B-1g 1079 III-A-1g 647 | III-C-1g 1079 III-A-1g 647 | III-D-1g 1079 III-A-1g 647 | III-E-1g 1079 III-A-1g 647 | III-F-1g 1079 III-A-1g 647 |
| | Magenta coupler (a) | 637 | 637 | 637 | 637 | 637 |
| | Developing agent (b) | 444 | 444 | 444 | 444 | 444 |
| | Anti-fogging agent (c) | 0.20 | 0.20 | 0.20 | 0.20 | 0.20 |
| | High-b.p.-organic solvent (d) | 670 | 670 | 670 | 670 | 670 |
| | Surfactant (e) | 33 | 33 | 33 | 33 | 33 |
| | Water-soluble polymer (h) | 14 | 14 | 14 | 14 | 14 |

Sensitizing dye III-I for green-sensitive emulsions

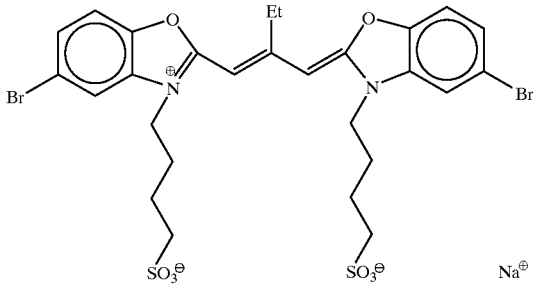

$8.4\times10^{-4}$ mol per mole of silver for respective emulsions

Sensitizing dye III-II for green-sensitive emulsions

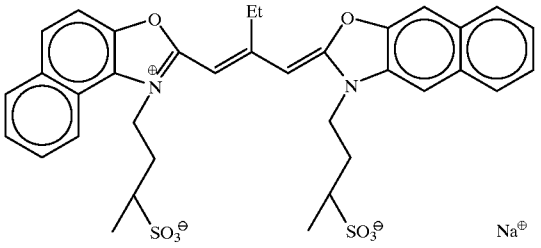

$2.2\times10^{-4}$ mol per mole of silver for respective emulsions

Sensitizing dye III-III for green-sensitive emulsions

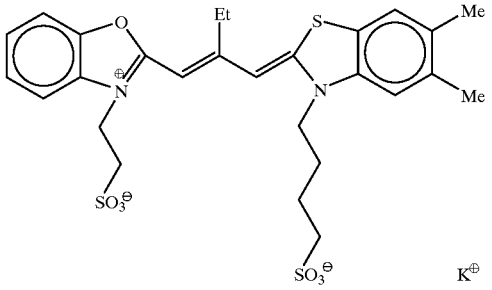

$3.2\times10^{-5}$ mol per mole of silver for respective emulsions

Compound I

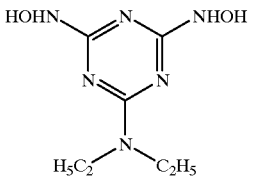

-continued

Magenta coupler (a)

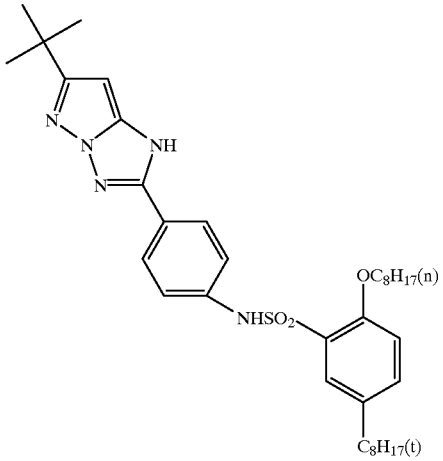

Developing agent (b)

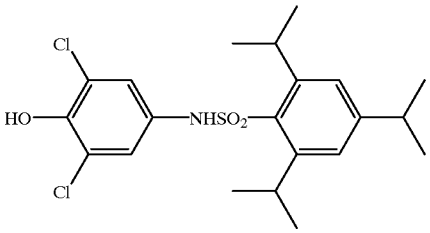

Anti-fogging agent (c)

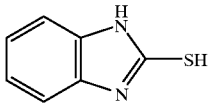

High-b.p.-organic solvent (d)

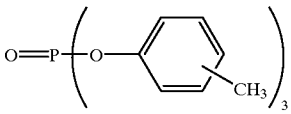

Surfactant (e)

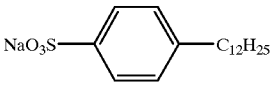

Surfactant (f)

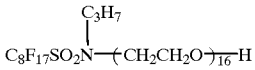

Surfactant (g)

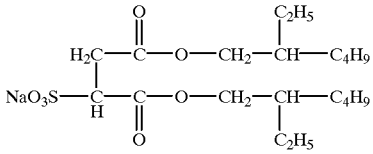

Water-soluble polymer (h)

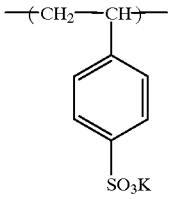

-continued

Hardener (i)

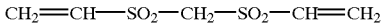

TABLE 24

Structure of Processing Material III-P-1

| Structure of layers | Materials incorporated | Amounts ($mg/m^2$) |
|---|---|---|
| The 4th layer: Protective layer | Acid-treated gelatin | 220 |
| | Water-soluble polymer (j) | 60 |
| | Water-soluble polymer (k) | 200 |
| | Additive (l) | 80 |
| | Palladium sulfate | 3 |
| | Potassium nitride | 12 |
| | Matting agent (m) | 10 |
| | Surfactant (g) | 7 |
| | Surfactant (n) | 7 |
| | Surfactant (o) | 10 |
| The 3rd layer: Intermediate layer | Lime-treated gelatin | 240 |
| | Water-soluble polymer (k) | 24 |
| | Hardener (p) | 180 |
| | Surfactant (e) | 9 |
| The 2nd layer: Base-generating layer | Lime-treated gelatin | 2400 |
| | Water-soluble polymer (k) | 360 |
| | Water-soluble polymer (q) | 700 |
| | Water-soluble polymer (r) | 600 |
| | High b.p. solvent (s) | 2000 |
| | Additive (t) | 20 |
| | Hydantoin potassium | 260 |
| | Guanidine picolate | 2910 |
| | Potassium quinolate | 225 |
| | Sodium quinolate | 180 |
| | Surfactant (e) | 24 |
| The 1st layer: Undercoat layer | Lime-treated gelatin | 280 |
| | Water-soluble polymer (j) | 12 |
| | Surfactant (g) | 14 |
| | Hardener (p) | 185 |
| Transparent support III-A (63 $\mu$m) | | |

TABLE 25

Structure of Support III-A

| Layers | Composition | Weight ($mg/m^2$) |
|---|---|---|
| Surface undercoat layer | Gelatin | 100 |
| Polymer layer | Polyethylene terephthalate | 62500 |
| Backface undercoat layer | Methyl methacrylate-styrene-2-ethylhexylacrylate-methacrylic acid copolymer | 1000 |
| | PMMA latex (av. particle size: 12 $\mu$m) | 120 |
| | | 63720 |

| | |
|---|---|
| Water-soluble polymer (j) | κ-carrageenan |
| Water-soluble polymer (k) | Sumikagel-5H (by Sumitomo Chemical) |
| Additive (1) | Matting agent (m) SYLOID 79 (by Fuji Davison) |

TABLE 25-continued

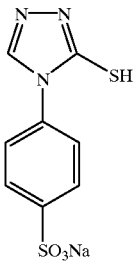

Surfactant (n)

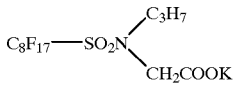

Surfactant (o)

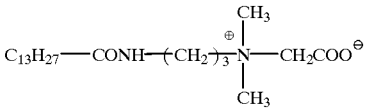

Hardener (p)

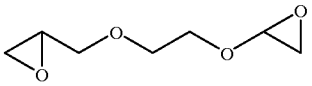

Water-soluble polymer (q)
Dextran (M.W. = 70,000)

Water-soluble polymer ®
MP polymer MP 102
(by Kuraray)

High-b.p.-solvent

Enpara 40
(by Ajinomoto)

Additive (t)

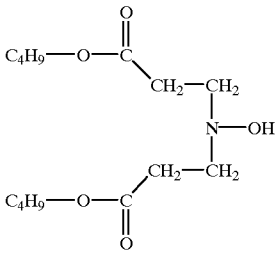

As described above, zinc hydroxide (slightly-soluble metal compound) was incorporated into the light-sensitive materials and guanidine picolate (complex-forming compound) into the processing materials.

These light-sensitive materials were exposed to light at 1000 lux over a period of 1/100 second through an optical wedge and a green filter.

Water at a temperature of 40° C. was applied at 15 ml/m$^2$ to the surface of each exposed light-sensitive material. The light-sensitive material was brought into face-to-face contact with a processing material. The thus-superposed film was subjected to heat development for 30 seconds at 83° C. through use of a heating drum. The light-sensitive material was peeled from the processing material after development, so that a magenta-colored wedge-shaped image was obtained. This sample was further subjected to treatment in the second step through use of a second processing sheet shown hereinbelow.

TABLE 26

Structure of the Second Processing Sheet

| Layer No. | Materials incorporated | Amounts (mg/m$^2$) |
|---|---|---|
| The 4th layer: | Acid-treated gelatin | 220 |
| | Water-soluble polymer (j) | 60 |
| | Water-soluble polymer (k) | 200 |
| | Potassium nitride | 12 |
| | Matting agent (m) | 10 |
| | Surfactant (g) | 7 |
| | Surfactant (h) | 7 |
| | Surfactant (o) | 10 |
| The 3rd layer: | Lime-treated gelatin | 240 |
| | Water-soluble polymer (k) | 24 |
| | Hardener (p) | 180 |
| | Surfactant (e) | 9 |
| The 2nd layer: | Lime-treated gelatin | 2400 |
| | Water-soluble polymer (k) | 120 |
| | Water-soluble polymer (q) | 700 |
| | Water-soluble polymer (r) | 600 |
| | High b.p. solvent (s) | 2000 |
| | Additive (A) | 1270 |
| | Additive (B) | 683 |
| | Surfactant (e) | 20 |
| The 1st layer: | Gelatin | 280 |
| | Water-soluble polymer (j) | 12 |
| | Water-soluble polymer (g) | 14 |
| | Hardener (p) | 185 |
| Support PET support III-A (thickness: 63 μm) | | |

Additive A

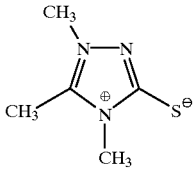

Additive B

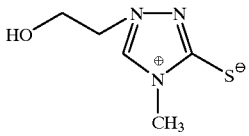

In the treatment of the second step, 10 cc/m$^2$ of water was applied to the second processing sheet, and this sheet was bonded to the light-sensitive material which had undergone the first treatment. The sheet was heated at 60° C. for 30 seconds. Transmission density of color-developed samples of this sheet was measured, whereby so-called characteristic curves were obtained. A relative sensitivity was determined by the reciprocal of the amount of exposure corresponding to a density 0.15 higher than the fog density. Sensitivity was represented with reference to the value of sample III-101, which was taken as 100.

The light-sensitive materials were stored for 3 days at 60° C., and subsequently exposed to light and heat-treated. The results are shown in Table 27.

TABLE 27

| Light-sensitive material No. | Sensitivity | Fogging | Fogging after 3 days at 60° C. |
|---|---|---|---|
| III-101 (Comparative example) | 100 | 0.30 | 0.45 |
| III-102 | 350 | 0.30 | 0.35 |

TABLE 27-continued

| Light-sensitive material No. | Sensitivity | Fogging | Fogging after 3 days at 60° C. |
|---|---|---|---|
| (Present invention) III 103 | 520 | 0.29 | 0.33 |
| (Present invention) III-104 | 205 | 0.31 | 0.40 |
| (Comparative example) III-105 | 90 | 0.29 | 0.35 |
| (Comparative example) | | | |

As shown in Table 27, the light-sensitive materials of the present invention exhibit high sensitivity and excellent storage stability. The test results demonstrate quite surprising effects that cannot be expected from the conventional art.

EXAMPLE 10

Blue-sensitive and red-sensitive emulsions were prepared by use of the components used in Example 9 except for the spectral sensitizing dyes, which were changed to the substances shown below.

Sensitizing dye III-IV for blue-sensitive emulsions

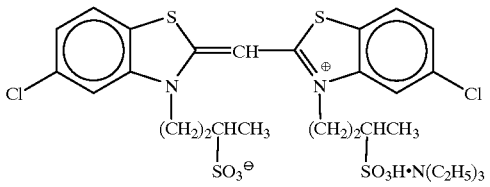

$6.0\times10^{-4}$ mol per mole of silver for respective emulsions

Sensitizing dye III-V for red-sensitive emulsions

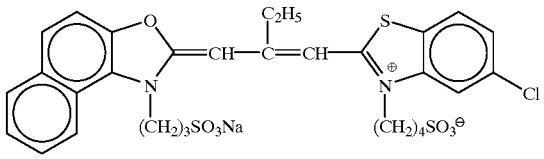

$3.5\times10^{-4}$ mol per mole of silver for respective emulsions

Sensitizing dye III-VI for red-sensitive emulsions

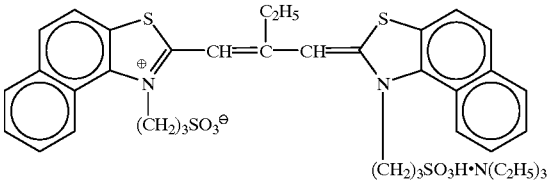

$1.6\times10^{-5}$ mol per mole of silver for respective emulsions

Sensitizing dye III-VII for red-sensitive emulsions

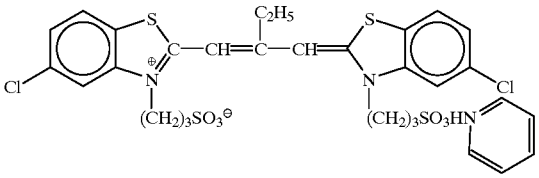

$5.1\times10^{-4}$ mol per mole of silver for respective emulsions

Further, dispersions of cyan and yellow couplers were prepared in accordance with the method of preparing coupler dispersions of Example 9.

Moreover, for the purposes of forming coloring layers which can be decolored at the time of heat development, dispersions of coloring agents were prepared by combination of zinc complex and leuco dyes for yellow, magenta, and cyan.

The thus-obtained silver halide emulsions, coupler dispersions, and dispersions of coloring agents were used to thereby prepare a color light-sensitive material III-201 as shown in Table 28, which has a multi-layered structure and is suitable for heat development.

TABLE 28

| | | | (Unit: mg/m$^2$) Samples III-201 |
|---|---|---|---|
| Protective layer | Lime-treated gelatin | | 1000 |
| | Matting agent (silica) | | 50 |
| | Surfactant (f) | | 100 |
| | Surfactant (g) | | 300 |
| | Water-soluble polymer (h) | | 15 |
| | Hardener (1) | | 98 |
| Intermediate layer | Lime-treated gelatin | | 375 |
| | Surfactant (g) | | 15 |
| | Zinc hydroxide | | 1100 |
| | Water-soluble polymer (h) | | 15 |
| Yellow dye forming layer | Lime-treated gelatin | | 500 |
| | Emulsion (based on the amount of coated silver) | III-B-1b | 1079 |
| | Yellow coupler (u) | | 190 |
| | Developing agent (v) | | 137 |
| | Anti-fogging agent (w) | | 14 |
| | High-b.p. -organic solvent (d) | | 168 |
| | Surfactant (e) | | 8 |
| | Water-soluble polymer (h) | | 4 |
| Yellow dye forming layer | Lime-treated gelatin | | 1500 |
| | Emulsion (based on the amount of coated silver) | III-A-1b | 647 |
| | Yellow coupler (u) | | 570 |
| | Developing agent (v) | | 410 |
| | Anti-fogging agent (w) | | 43 |
| | High-b.p.-organic solvent (d) | | 503 |
| | Surfactant (e) | | 24 |
| | Water-soluble polymer (h) | | 12 |
| Intermediate layer | Lime-treated gelatin | | 750 |
| | Surfactant (e) | | 15 |
| | Leuco dye (x) | | 303 |
| | Developer (v) | | 433 |
| | Water-soluble polymer (h) | | 15 |
| Magenta dye forming layer 1) | Lime-treated gelatin | | 500 |
| | Emulsion (based on the amount of coated silver | III-B-1g | 1079 |
| | Magenta coupler (a) | | 159 |
| | Developing agent (b) | | 111 |
| | Anti-fogging agent (c) | | 0.05 |

TABLE 28-continued

| | | | |
|---|---|---|---|
| | High-b.p.-organic solvent (d) | | 168 |
| | Surfactant (e) | | 8 |
| | Water-soluble polymer (h) | | 4 |
| Magenta dye forming layer 2) | Lime-treated gelatin | | 1500 |
| | Emulsion (based on the amount of coated silver) | III-A-1g | 647 |
| | Magenta coupler (a) | | 477 |
| | Developing agent (b) | | 333 |
| | Anti-fogging agent (c) | | 0.15 |
| | High-b.p.-organic solvent (d) | | 504 |
| | Surfactant (e) | | 24 |
| | Water-soluble polymer (h) | | 12 |
| Intermediate layer | Lime-treated gelatin | | 900 |
| | Surfactant (e) | | 15 |
| | Leuco dye (z) | | 345 |
| | Developer (y) | | 636 |
| | Zinc hydroxide | | 1100 |
| | Water-soluble polymer (h) | | 15 |
| Cyan dye forming layer | Lime-treated gelatin | | 500 |
| | Emulsion | III-B-1r | 1079 |
| | Cyan coupler (aa) | | 218 |
| | Developing agent (b) | | 111 |
| | Anti-fogging agent (c) | | 0.11 |
| | High-b.p.-organic solvent (d) | | 168 |
| | Surfactant (e) | | 8 |
| | Water-soluble polymer (h) | | 4 |
| Cyan dye forming layer | Lime-treated gelatin | | 1500 |
| | Emulsion | III-A-1r | 647 |
| | Cyan coupler (aa) | | 654 |
| | Developing agent (b) | | 333 |
| | Anti-fogging agent (c) | | 0.34 |
| | High-b.p.-organic solvent (d) | | 504 |
| | Surfactant (e) | | 24 |
| | Water-soluble polymer (h) | | 12 |
| Antihalation layer | Lime-treated gelatin | | 750 |
| | Surfactant (e) | | 15 |
| | Leuco dye (ab) | | 243 |
| | Developer (y) | | 425 |
| | Water-soluble polymer (h) | | 15 |
| Transparent PET base (120 μm) | | | |

Yellow Coupler (u)

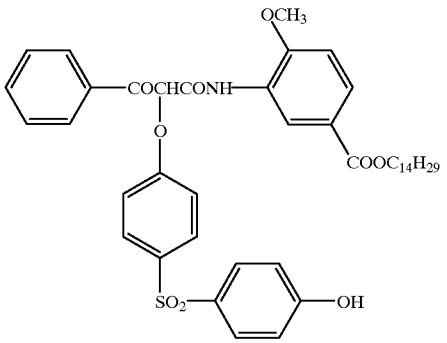

Developing agent (v)

TABLE 28-continued

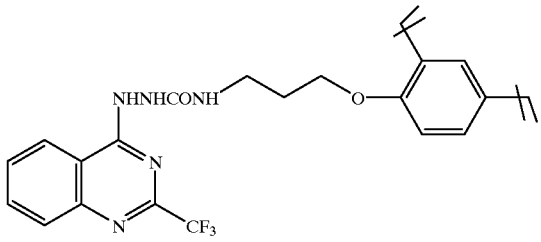

Anti-fogging agent (w)

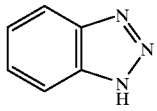

Cyan coupler (aa)

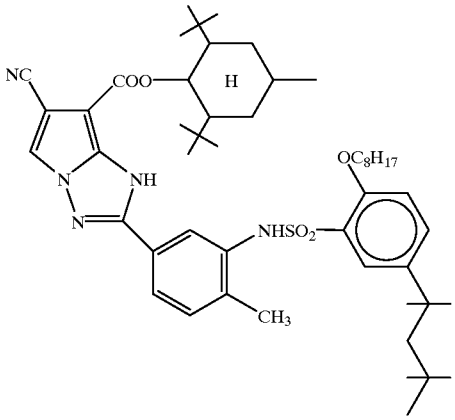

Leuco dye (ab)

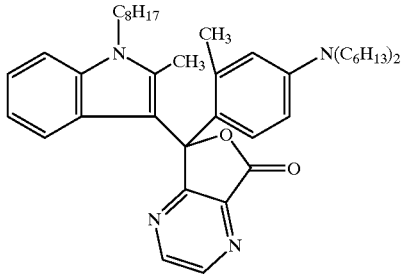

Yellow-developing leuco dye (x)

TABLE 28-continued

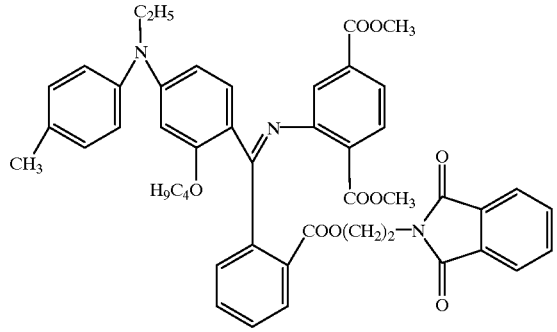

Developer (y)

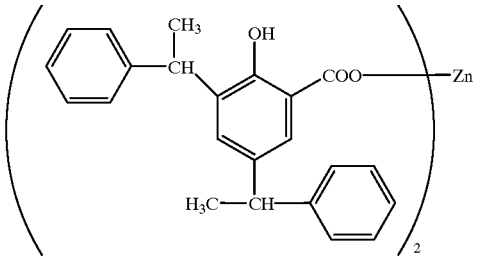

Magenta-developing leuco dye (z)

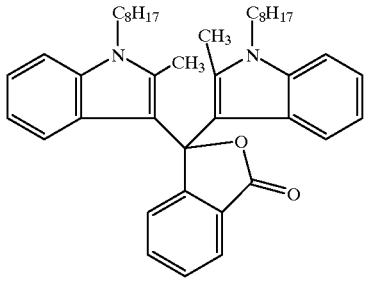

Similar to the manner used for the preparation of light-sensitive material III-201, light-sensitive material III-202 was prepared, with the exception that the emulsion of magenta dye forming layer 1) of light-sensitive material III-201 was changed to III-C-1g. In a similar manner, light-sensitive materials III-203 through III-205 shown in Table 29 were prepared.

These light-sensitive materials were processed as in Example 9, and evaluated. It was concluded that the light-sensitive materials of the present invention provided analogous effects as those obtained in Example 9.

TABLE 29

| Light-sensitive material No. | Emulsion of magenta dye forming layer 1) |
|---|---|
| III-201 (Comparative example) | III-B-1 g |
| III-202 (Comparative example) | III-C-1 g |
| III-203 (Comparative example) | III-D-1 g |
| III-204 | III-E-1 g |

TABLE 29-continued

| Light-sensitive material No. | Emulsion of magenta dye forming layer 1) |
|---|---|
| (Comparative example) III-205 (Comparative example) | III-F-1 g |

What is claimed is:

1. A heat-developable light-sensitive material comprising a support and at least one light-sensitive silver halide emulsion layer provided on the support, the light-sensitive silver halide emulsion layer containing light-sensitive silver halide grains, a developing agent, a compound to form a cyan, magenta, or yellow dye through a coupling reaction with an oxidized product of the developing agent, and a binder, wherein the light-sensitive silver halide emulsion layer comprises an emulsion containing tabular silver halide grains having a mean grain thickness of 0.01–0.07 $\mu$m.

2. A heat-developable light-sensitive material according to claim 1, wherein the developing agent is a compound represented by the following formulas I, II, III, or IV:

I

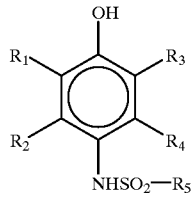

II

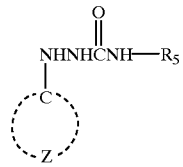

III

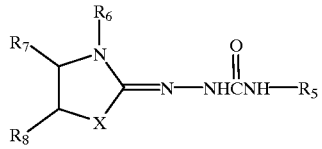

IV

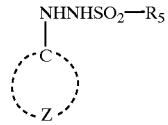

wherein each of $R_1$ through $R_4$ represents a hydrogen atom, a halogen atom, an alkyl group, an aryl group, an alkylcarbonamide group, an arylcarbonamide group, an alkylsulfonamide group, aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form (hetero)aromatic rings wherein, when Z is a benzene ring, the sum of the Hammett's substitution constant ($\sigma$) values of its substituents is not less than 1; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through IV has at least one ballast group having 8 or more carbon atoms in order to impart oil solubility to the molecule.

3. A method of forming color images comprising a step of heating the heat-developable light-sensitive material according to claim 2 at a temperature between 60° C. and 100° C. for 5 to 60 seconds to form color images.

4. A heat-developable light-sensitive material according to claim 1, wherein the developing agent is a compound represented by one of the following formulas I, II, III, and IV:

I

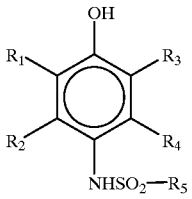

II

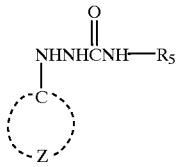

III

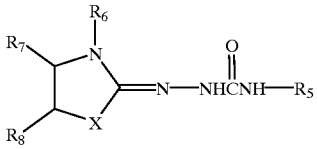

IV

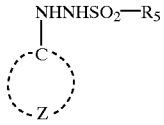

wherein each of $R_1$ through $R_4$ represents a hydrogen atom, a halogen atom, an alkyl group, an aryl group, an alkylcarbonamide group, an arylcarbonamide group, an alkylsulfonamide group, an aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form heteroaromatic rings; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through IV has at least one ballast group having 8 or more carbon atoms in order to impart oil solubility to the molecule.

5. A heat-developable light-sensitive material according to claim 1, wherein the developing agent is a compound represented by one of the following formulas I, II, and III:

I

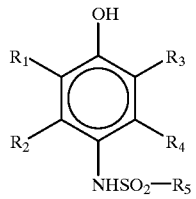

II

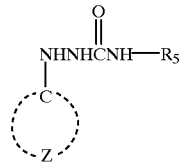

III

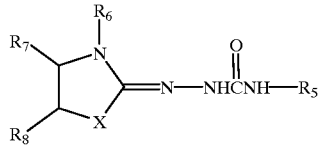

wherein each of $R_1$ through $R_4$ represents a hydrogen atom, a halogen atom, an alkyl group, an aryl group, an alkylcarbonamide group, an arylcarbonamide group, an alkylsulfonamide group, an aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form (hetero) aromatic rings wherein, when Z is a benzene ring, the sum of the Hammett's substitution constant ($\sigma$) values of its substituents is not less than 1; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through III has at least one ballast group having 8 or more carbon atoms in order to impart oil solubility to the molecule.

6. A silver halide color light-sensitive material comprising a first support and a first photographic constitutive layer provided thereon by way of coating and including at least one light-sensitive layer, the light-sensitive layer containing light-sensitive silver halide grains, a compound to form a cyan, magenta, or yellow dye through a coupling reaction with an oxidized product of a developing agent, and a binder, wherein the silver halide color light-sensitive material, after exposure, is adhered to a processing material comprising a second support and a second photographic constitutive layer provided on the second support and including a processing layer, in the presence of water between the surface of the light-sensitive layer and the surface of the processing layer in an amount of 10% to 100% that required to maximally swell the layers of the materials, and subsequently heated to form an image in the silver halide color light-sensitive material, wherein at least one light-sensitive layer of the silver halide color light-sensitive material comprises an emulsion containing tabular silver halide grains each of which has an average equivalent circle diameter of at least 0.7 μm, and a mean thickness of less than 0.07 μm.

7. A silver halide color light-sensitive material according to claim 6, wherein tabular silver halide grains have a (111) plane as their main surfaces.

8. A silver halide color light-sensitive material according to claim 6, wherein the processing layer contains a base and/or a precursor of a base.

9. A silver halide color light-sensitive material according to claim 6, wherein tabular silver halide grains have a (111) plane as their main surfaces and the processing layer contains a base and/or a precursor of a base.

10. A silver halide color light-sensitive material according to claim 6, wherein the silver halide emulsion contains bromides in excess of 70 mol % and at least 0.30 mol % of iodides with respect to the content of silver grains and that latent-image-forming, chemically sensitized sites are present on the grain surfaces.

11. A silver halide color light-sensitive material according to claim 6, wherein the silver halide color light-sensitive material containing either a slightly-soluble metal compound or a compound capable of increasing pH through complex-forming reaction with a constituent metal ion of the slightly-soluble metal compound, while the processing material contains the other.

12. A silver halide color light-sensitive material according to claim 11, wherein the slightly-soluble metal compound is represented by the following formula (A):

$$TpQq \qquad (A)$$

wherein T represents a multivalent metal ion; Q represents a substance which exhibits alkalinity and which is capable of functioning as a counter ion, in water, to a constituent ion of a complex-forming compound; and p and q represent integers to balance valences of T and Q with each other.

13. A silver halide color light-sensitive material according to claim 11, wherein two silver halide emulsions sensitive to light of the same wavelength region and having different mean grain projected areas are used together.

14. A silver halide color light-sensitive material according to claim 11, wherein the slightly-soluble metal compounds are oxides, hydroxides, or basic carbonates of zinc or aluminum.

15. A silver halide color light-sensitive material according to claim 11, wherein the complex-forming compound is represented by the following formula (B):

(B)

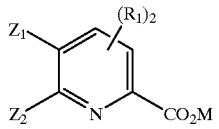

wherein each of $R_1$, $Z_1$, and $Z_2$ represents a hydrogen atom, an aryl group, a halogen atom, an alkoxy group, —$CO_2M$, a hydroxycarbonyl group, an amino group, or an alkyl group, wherein the two $R_1$s may be identical to or different from each other, and $Z_1$ and $Z_2$ may join each other to form a ring that is condensed into a pyridine ring; and M represents an alkali metal, guanidine, amidine, or a quaternary ammonium ion.

16. A heat-developable light-sensitive material according to claim 6, wherein the developing agent is a compound represented by one of the following formulas I, II, III, and IV:

I

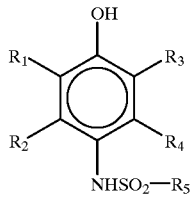

II

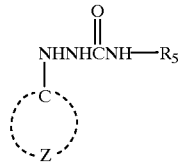

III

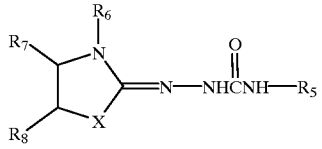

IV

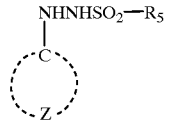

wherein each of $R_1$ through $R_4$ represents a hydrogen atom, a halogen atom, an alkyl group, an aryl group, an alkylcarbonamide group, an arylcarbonamide group, an alkylsulfonamide group, an aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl, an alkylcarbonyl group, an arylcarbonyl group, or an acyloxy group; $R_5$ represents an alkyl group, an aryl group, or a heterocyclic group; Z represents a group of atoms that form heteroaromatic rings; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through IV has at least one ballast group having 8 or more carbon atoms in order to impart oil solubility to the molecule.

17. A silver halide color light-sensitive material according to claim 6, wherein the developing agent is a compound represented by one of the following formulas I, II, and III:

I

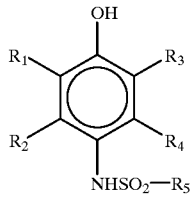

-continued

II

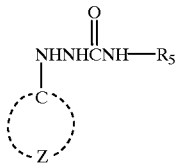

III

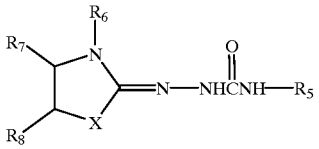

wherein each of $R_1$ through $R_4$ represents a hydrogen atom, a halogen atom, an alkyl group, an aryl group, an alkylcarbonamide group, an arylcarbonamide group, an alkylsulfonamide group, an aryl sulfonamide group, an alkoxyl group, an aryloxy group, an alkylthio group, an alkylcarbamoyl group, an arylcarbamoyl group, a carbamoyl group, an alkylsufamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form (hetero) aromatic rings wherein, when Z is a benzene ring, the sum of the Hammett's substitution constant (σ) values of its substituents is not less than 1; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through III has at least one ballast group having 8 or more carbon atoms in order to impart oil solubility to the molecule.

18. A method of forming color images comprising the steps of:

exposing a silver halide color light-sensitive material comprising a first support and at least one light-sensitive layer provided on the first support, the light-sensitive layer containing light-sensitive silver halide grains, a compound to form a cyan, magenta, or yellow dye through a coupling reaction with an oxidized product of a developing agent, and a binder;

feeding water to the light-sensitive layer surface of the light-sensitive material and/or the processing layer surface of a processing material comprising a second support and a processing layer provided on the second support;

adhering the light-sensitive layer surface and the processing layer surface to each other; and heating the resultant assembly to thereby form an image in the light-sensitive material;

wherein the silver halide color light-sensitive material contains a silver halide emulsion containing tabular silver halide grains having an average equivalent circle diameter of at least 0.7 μm and a mean thickness of less than 0.7 μm in at least one light-sensitive layer; and the silver halide color light-sensitive material contains either one of a slightly-soluble metal compound or a compound capable of increasing pH through a complex-forming reaction with a constituent metal ion of the slightly-soluble metal compound, while the processing material contains the other.

19. A method of forming color images according to claim 18, wherein the slightly-soluble metal compound and the complex-forming compound react with each other by the application of heat in the presence of water and a developing agent to thereby form an image in the silver halide color light-sensitive material.

20. A method of forming color images according to claim 18, wherein after the step of exposing, feeding dampening water having a temperature of 40° C. or higher to the light-sensitive layer surface of the light-sensitive material or the processing layer surface of the processing material in an amount of 10% to 100% that required to maximally swell the layers of the materials, adhering the light-sensitive layer surface and the processing layer surface to each other, and heating the resultant assembly to a temperature between 60° C. and 100° C. and holding the temperature for 5 to 60 seconds to thereby form color images.

21. A method of forming color images according to claim 20, wherein dampening water is fed in an amount of 10% to 50% that required to maximally swell the light-sensitive layer and the processing layer.

22. A method of forming color images according to claim 18, wherein the developing agent is a compound represented by one of the following formulas I, II, III, and IV:

I

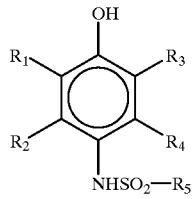

II

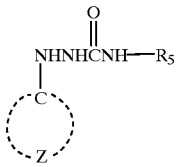

III

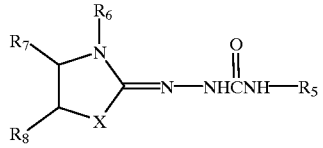

IV

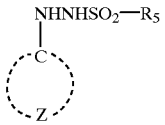

wherein each of $R_1$ through $R_4$ represents a hydrogen atom, a halogen atom, an alkyl group, an aryl group, an alkylcarbonamide group, an arylcarbonamide group, an alkylsulfonamide group, an aryl sulfonamide group, an alkoxyl group, an aryloxy group, an alkylthio group, an alkylcarbamoyl group, an arylcarbamoyl group, a carbamoyl group, an alkylsufamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form heteroaromatic rings; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through IV has at least one ballast group having 8 or more carbon atoms in order to impart oil solubility to the molecule.

23. A method of forming color images according to claim 18, wherein the developing agent is a compound represented by one of the following formulas I, II, and III:

I

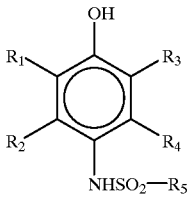

II

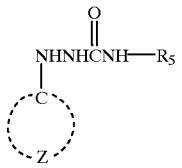

-continued

III

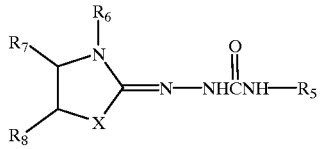

wherein each of $R_1$ through $R_4$ represents a hydrogen atom, a halogen atom, an alkyl group, an aryl group, an alkylcarbonamide group, an arylcarbonamide group, an alkylsulfonamide group, aryl sulfonamide group, an alkoxyl group, an aryloxy group, an alkylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form (hetero) aromatic rings wherein, when Z is a benzene ring, the sum of the Hammett's substitution constant ($\sigma$) values of its substituents is not less than 1; $R_6$ represents an alkyl group; X represents an oxygen atom, a sulfur atom, a selenium atom, or an alkyl-substituted or aryl-substituted tertiary nitrogen atom; and each of $R_7$ and $R_8$, which may join each other to form a double bond or a ring, represents a hydrogen atom or a substituent; wherein each of the compounds of formulas I through III has at least one ballast group having 8 or more carbon atoms in order to impart oil solubility to the molecule.

* * * * *